US006629741B1

(12) United States Patent
Okuda et al.

(10) Patent No.: US 6,629,741 B1
(45) Date of Patent: Oct. 7, 2003

(54) INK JET RECORDING HEAD DRIVE METHOD AND INK JET RECORDING APPARATUS

(75) Inventors: Masakazu Okuda; Toshinori Ishiyama, both of Tokyo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/520,511

(22) Filed: Mar. 8, 2000

(30) Foreign Application Priority Data

Mar. 11, 1999 (JP) ..... 11-064682
Jul. 1, 1999 (JP) ..... 11-188218
Aug. 25, 1999 (JP) ..... 11-237791

(51) Int. Cl.[7] ..... B41J 29/38
(52) U.S. Cl. ..... 347/11; 347/9; 347/10
(58) Field of Search ..... 347/9, 10, 11, 347/68, 69

(56) References Cited

U.S. PATENT DOCUMENTS 6,106,091 A * 8/2000 Osawa et al. ..... 347/9
6,352,335 B1 * 3/2002 Koyama et al. ..... 347/37

FOREIGN PATENT DOCUMENTS

EP 0 648 606 A1 10/1994 ..... B41J/2/045
EP 0 765 750 A1 5/1995 ..... B41J/2/045
EP 0 788 882 A2 1/1997 ..... B41J/2/04
EP 0 841 164 A1 4/1997 ..... B41J/2/045
EP 0 812 689 A1 6/1997 ..... B41J/2/045
EP 0 827 838 A2 * 11/1998 ..... B41J/2/21
JP 53-12138 4/1978 ..... G06K/15/00
JP 55-17589 2/1980 ..... B41J/3/04
JP 6-71876 3/1994 ..... B41J/2/045
JP 10-157100 6/1998 ..... B41J/2/045
JP 10-193587 7/1998 ..... B41J/2/01
JP 11-20165 1/1999
JP 11058719 A * 3/1999 ..... B41J/2/01
JP 11-157064 6/1999 ..... B41J/2/045

* cited by examiner

*Primary Examiner*—Anh T. N. Vo
*Assistant Examiner*—Alfred Dudding
(74) *Attorney, Agent, or Firm*—Dickstein, Shapiro, Morin & Oshinsky, LLP

(57) ABSTRACT

The present invention provides an ink jet recording head drive method for applying a drive voltage to an electro-mechanical converter which changes a pressure within a pressure generation chamber filled with ink, so that an ink droplet is ejected from a nozzle communicating with the pressure generation chamber, wherein the drive voltage has a voltage waveform including: a first voltage change process for increasing a volume of the pressure generation chamber so as to pull the ink meniscus at the nozzle opening toward the pressure generation chamber; and a second voltage change process for decreasing the volume of the pressure generation chamber, so as to eject an ink droplet, and wherein the first voltage change process is preceded by a preparatory voltage change process for slightly pulling an ink meniscus from the nozzle opening toward the pressure generation chamber.

37 Claims, 32 Drawing Sheets

INK JET RECORDING HEAD DRIVE METHOD AND INK JET RECORDING APPARATUS

BACKGROUND OF THE INVENTION

1. Field of the Invention

The present invention relates to an ink jet recording apparatus and in particular, to an ink jet recording head drive method for recording characters and images by discharging ink droplets from a nozzle and an apparatus thereof.

2. Description of the Related Art

Conventionally, there is known a drop-on-demand type ink jet apparatus in which an electro-mechanical converter such as a piezoelectric actuator is used to generate a pressure wave (accoustic wave), which serves to eject an ink droplet from a nozzle connected to a pressure generation chamber. This type of ink jet recording head drive method is disclosed, for example, in Japanese Patent Publication (examined) 53-12138. This type of ink jet recording head is shown in FIG. 25 as an example.

Referring to FIG. 25, a pressure generation chamber 100 is connected to a nozzle 101 for discharging ink and an ink supply path 103 for introducing ink from an ink tank (not depicted) via a common ink chamber 102. Moreover, at the bottom of the pressure generation chamber 100, a diaphragm 104 is provided. When discharging an ink droplet, this diaphragm 104 is displaced by a piezoelectric actuator 105 (electro-mechanical converter) provided outside the pressure generation chamber 100, so as to generate a volume change of the pressure generation chamber 100, thus generating a pressure wave in the pressure generation chamber 100. This pressure wave ejects a portion of ink from the pressure generation chamber 100 outside via the nozzle 101 and the ink droplet 106 flies to a recording medium such as a recording paper to form a recording dot. The formation of recording dot is repeatedly performed according to an image data, so as to record a character and an image on the recording paper.

In order to obtain a high quality image using this type of ink jet recording head, it is necessary to set the diameter of the ink droplet 106 very small. That is, in order to obtain a smooth image without feeling of the respective droplets, it is necessary to make the recording dot (pixel) as small as possible. For this, the diameter of the ink droplet ejected should be set very small. Normally, when the dot diameter is equal to or smaller than 40 micrometers, the image quality is remarkably improved. The ink droplet diameter and the dot diameter depend on the ink droplet flying speed (droplet speed), ink characteristic (such as viscosity and surface tension), the type of the recording paper. Normally, the dot diameter is twice as much as the ink droplet diameter. Accordingly, in order to obtain a dot diameter of 40 micrometers or less, the ink droplet should have a diameter of 20 micrometers or less. It should be noted that in the explanation below, the droplet diameter represents a total ink amount ejected by one eject operation (including a satellite shown by 106' in FIG. 25) which is preceded by a corresponding spherical droplet.

In order to reduce the ink droplet diameter, the nozzle 101 should have a reduced diameter. However, considering technical limits and reliability such as a problem of clogging, the nozzle diameter practically has a lower limit of 25 micrometers. It is difficult to obtain an ink droplet of the 20 micrometers level only by reducing the nozzle diameter. To cope with this, an attempt has been made to reduce the ink droplet diameter through the recording head drive method and several effective methods have been suggested.

As a drive method for discharging a very small droplet by the ink jet recording head, for example, Japanese Patent Publication (unexamined) 55-17589 discloses a drive method for temporarily expanding the pressure generation chamber immediately before eject and an ink surface formed by reserved ink in a nozzle opening (hereinafter, referred to as meniscus) is pulled into the pressure generation chamber and then ejected. FIG. 26(*a*) shows an example of a drive voltage waveform used in this type of drive method. It should be noted that the relationship between the drive voltage and operation of the piezoelectric actuator 105 varies depending on the structure of the actuator 105 and polarization direction. In the explanation given below, it is assumed that increase of the drive voltage decreases the volume of the pressure generation chamber 100 while decrease of the drive voltage increases the volume of the pressure generation chamber 100.

The drive voltage waveform of FIG. 26(*a*) consists of a first voltage change process 1 for expanding the pressure generation chamber 100 so as to pull the meniscus from the nozzle opening into the pressure generation chamber 100 and a second voltage change process 2 that compresses the pressure generation chamber 100, so as to eject an ink droplet.

FIG. 27 schematically shows motion of the meniscus 3 at the nozzle opening when the drive voltage waveform of FIG. 26(*a*) is applied. In the initial state when a reference voltage is applied, the meniscus 3 is flat as shown in FIG. 27(*a*). When the pressure generation chamber 100 is expanded by the first voltage change process 1 immediately before eject, the meniscus 3 is pulled backward as shown in FIG. 27(*b*). That is, the center of the meniscus 3 is recessed than the peripheral portion and a U-shaped meniscus 3 is formed. After the U-shaped meniscus 3 is formed, the pressure generation chamber 100 is compressed by the second voltage change process 2, so that a slender liquid column 4 is formed at the center of the meniscus 3 as shown in FIG. 27(*c*). Subsequently, the tip end of the liquid column 4 is separated to form an ink droplet 106 as shown in FIG. 27(*d*). Here, the ink droplet 106 has a diameter almost identical to the diameter of the liquid column 4, which is smaller than the diameter of the nozzle 101. Accordingly, this drive method enables to eject the ink droplet 106 having a smaller diameter than that of the nozzle 101. Hereinafter, the drive method for discharging a very small droplet by operating the meniscus 3 immediately before eject, that is the configuration of the ink droplet 3 reserved in the nozzle opening will be referred to as the meniscus control method.

As has been described above, by using the meniscus control method, it is possible to eject an ink droplet having a diameter smaller than the diameter of the nozzle. However, when using the drive voltage waveform as shown in FIG. 26(*a*), practically, the droplet diameter has a lower limit of 25 micrometers and it is impossible to satisfy the high quality image requirement.

The applicant of the present invention discloses in Japanese Patent Application 10-318443, a drive voltage waveform as shown in FIG. 26(*b*) as a drive method enabling to eject a further smaller droplet. This drive voltage waveform consists of a first voltage change process 1 for pulling a meniscus 3 toward the pressure generation chamber 100 immediately before eject, a second voltage change process 2 for compressing the volume of the pressure generation chamber 100 so as to form a liquid column for eject, a third voltage change process 5 for separating an ink droplet 106 quickly from the tip end of the liquid column 4, and a fourth voltage change process 6 for suppressing the residual pressure wave remaining after eject of the ink droplet. That is, the drive waveform of FIG. 26(*b*) includes the third voltage change process 5 for early separation of the ink droplet 106 and the fourth voltage change process 6 for suppressing reverberation in addition to the conventional meniscus control method as shown in FIG. 26(*a*). This enables to obtain a stable eject of the ink droplet 106 having a diameter in the order of 20 micrometers.

When discharging a very small droplet using the aforementioned meniscus control method, the greatest problem is to assure a stable eject. That is, the ink droplet diameter and eject speed of the ink droplet ejected by the meniscus control method greatly depend on the configuration of the meniscus 3 immediately before eject as shown in FIG. 27(*b*). Accordingly, in order to realize a stable eject, it is necessary to stabilize the configuration of the meniscus 3. Moreover, in the case of a multi-nozzle head having a plurality of nozzles, it is necessary to obtain identical meniscus configurations in the different nozzles. Practically, however, it is difficult to obtain identical meniscus configurations. As a result, irregularities are caused in the ink droplet diameter and droplet speed, deteriorating the image quality.

One of the causes which make the meniscus unstable and irregular is change of the initial meniscus configuration caused by an eject immediately before. Hereinafter, its mechanism will be explained with reference to FIG. 28.

When the ink droplet 106 is ejected from the nozzle 101, the amount of ink in the nozzle 101 is reduced and the meniscus 3 retreats toward the pressure generation chamber as shown in FIG. 28(*a*). The meniscus 3 which has retreated finally moves toward the nozzle opening plane as shown in FIG. 28(*b*) by the ink surface tension (capillary effect) so as to be ready for the next ejection. Such a recovery operation of the meniscus 3 is normally called refill operation.

In this refill operation, the meniscus 3 does not return directly to the still state of FIG. 28(*b*) from the state of FIG. 28(*a*). The meniscus is gradually converged to the still state while performing attenuation vibration around the nozzle opening plane. That is, the meniscus 3 which has retreated after ejection is restored to the nozzle opening plane as shown in FIG. 28(*b*) and overshoots to protrude from the nozzle opening plane as shown in FIG. 28(*c*) to form a convex meniscus 3. Then, the meniscus 3 again retreats to form a concave meniscus 3 as shown in FIG. 28(*d*). After repeating the convex and concave states, the meniscus gradually reaches the still state as shown in FIG. 28(*b*) or FIG. 28(*f*). The meniscus vibration cycle during this refill operation depends on the ink surface tension, the opening diameter of the nozzle 101, inertance of the fluid path system (nozzle, pressure generation chamber, ink supply path), and the like. Generally, the meniscus vibration cycle in an ordinary ink jet recording head is in the order of 80 to 150 seconds.

Here, what is important is the convex meniscus configuration caused by the overshoot of the meniscus 3. The overshoot of the meniscus 3 is especially remarkable in a head designed for high-speed recording. Moreover, the overshoot amount varies depending on the diameter of the droplet which has been ejected immediately before and the number of successive ejections. That is, in the case when an ejection has been performed immediately before, there the initial meniscus configuration for the following ejection may be of convex configuration, and the overshoot amount may not be constant. The applicant of the present invention has performed a number of ejection observation experiments and fluid analysis and found that the meniscus initial state of the convex configuration causes the stability of a very small droplet ejected by the meniscus control method to deteriorate. The mechanism will now be explained with reference to FIG. 29.

If the initial meniscus 3 has a convex configuration as shown in FIG. 29(*a*), the meniscus 3 is pulled in such a manner that the peripheral portion is pulled earlier than the center portion of the meniscus, which leads to the meniscus configuration as shown in FIG. 29(*b*). After that, as shown in FIG. 29(*c*), the center portion sinks partially. In this state, pressure for ejection is applied. Accordingly, normal liquid column formation cannot be performed. The ink droplet diameter and the droplet ejection speed are greatly changed. It should be noted that FIG. 29(*d*) shows abnormally slender liquid column 4, but this is not always the case when the initial meniscus is of convex configuration. For example, a slight difference in the meniscus configuration may greatly change the ejection phenomenon and the ejection speed may be greatly lowered in comparison to a normal ejection. That is, if the initial meniscus is of convex configuration, the droplet diameter and ejection speed fluctuate in a wide range. When a plurality of nozzles are used, irregularities between the nozzles are increased. Moreover, when an abnormal ejection phenomenon is caused as shown in FIG. 29, there also arises a problem that air bubbles are introduced into the nozzle, which causes a nozzle eject failure.

The aforementioned problem is especially severe when performing a droplet diameter modulation for changing the ink droplet diameter in multiple steps. That is, when performing a droplet diameter modulation, there is a case that a droplet of a large diameter is ejected immediately before discharging a very small droplet. The overshoot amount of the meniscus 3 increases as the droplet diameter increases. Accordingly, in this case, there is a high possibility that the initial meniscus has a convex configuration. This leads to great irregularities of the very small droplet diameter and ejection speed, remarkably deteriorating the image quality.

Moreover Japanese Patent Publication B53-12138 and Japanese Patent Publication A10-193587 disclose a so-called on-demand type ink jet recording apparatus.

With requirement for improvement of the recording image quality, in this type of ink jet recording head also, it is required to perform a high-quality recording. For this, it is necessary to express a smooth intermediate gradation.

For performing a gradation recording, there are two known methods. One of them uses a plurality of ink droplets of a fixed diameter to form a pixel (pseudo gradation), the other changes the ink droplet diameter in multiple steps for each bit.

In order to obtain a high quality image with the former method, it is necessary to highly increase the recording resolution. For this, the number of dots required for recording is greatly increased, causing a disadvantage that the recording speed is lowered.

On the other hand, the latter method can change concentration for each of the dots and enables to obtain a high image quality with a comparatively low recording resolution, which in turn enables to obtain a high recording speed.

Changing the ink droplet diameter in multiple steps can be realized by applying a plurality of drive voltage waveforms to the piezoelectric actuator 236 as shown in FIG. 33. FIG. 33 shows drive voltage waveforms for generating a small, intermediate, and large diameter of ink droplets. FIG. 33(*a*) is for the small diameter droplet, FIG. 33(*b*) is for the intermediate diameter droplet, and FIG. 33(*c*) is for the large diameter droplet. In FIG. 33(*b*) and FIG. 33(*c*), like portions as in the FIG. 33(*a*) are denoted by like reference symbols with a single or double quotation mark.

In FIG. 33, the pressure generation chamber 231 is expanded where the graph changes downward (portions indicated by 251 and 253) and the pressure generation chamber 231 is compressed where the graph changes upward (portions indicated by 252 and 254).

As shown in FIG. 33(*c*), if the pressure generation chamber 231 is slowly compressed taking a comparatively long time $t_3''$, the compressed state of the pressure generation chamber 231 is maintained for a comparatively long time $t_4''$, and the pressure generation chamber 231 is slowly expanded taking a comparatively long time $t_7''$, then an ink droplet of a large diameter is ejected from the opening of the nozzle.

On the contrary, as shown in FIG. 33(*a*), if the pressure generation chamber 231 expanded is rapidly compressed taking a short time $t_3$ and then rapidly expanded, an ink droplet of a small diameter is ejected from the opening of the nozzle.

FIG. 33(*b*) show a waveform that is in an ink ejecting state between that shown by FIGS. 33(*a*) and 33(*c*), that ejects an ink droplet of intermediate diameter is ejected from the opening of the nozzle.

The changing of the ink droplet diameter by changing the drive voltage waveform is disclosed as a so-called meniscus control method in the aforementioned Japanese Patent Publication A10-193587.

However, as has been described above, a number of pressure generation chambers are arranged in the ink jet recording head, and the piezoelectric actuator is also provided in the proximity. Accordingly, interference between the vibrations driven by the piezoelectric actuators makes it difficult to eject an ink droplet of a desired diameter.

Especially, as shown in FIG. 32, when adjacent piezoelectric actuators 236 are simultaneously driven (arrows in the figure indicate the vibration drive direction of the piezoelectric actuators), support members 237 for supporting the piezoelectric actuators 236 are deformed in the direction indicated by arrows. This deformation affects the pressure generation chambers 231 other than the corresponding one and causes a vibration loss. This results in irregularities of diameter and ejection speed of the ink droplets A, and is detrimental to obtaining a high quality recording image.

In order to solve this problem, i.e., the so-called cross talk, it is recommended to use a material of high rigidity for the members constituting the ink jet recording head such as piezoelectric actuators and pressure generation chambers, so as to eliminate affect of the piezoelectric actuators on the pressure generation chamber other than the corresponding one and to eliminate vibration loss.

However, forming an ink jet recording head from a material of high rigidity has various problems such as processing difficulty, increase of the ink jet recording head size, and increase of the production cost.

In Japanese Patent Publication A10-193587, the cross talk problem is solved by alternatively driving adjacent piezoelectric actuators. However, this leads to a problem that the recording time is prolonged.

Moreover as shown in FIG. 34, in this type of ink jet recording head, normally, one ink droplet reaching the recording medium forms one recording dot, and the dot size and the image quality are in inverse proportion. Accordingly, in order to satisfy the image quality, it is necessary to form a recording dot of a small diameter on the recording medium. In order to obtain a smooth image (high quality image) having no particle appearance for human eyes, the dot diameter should be 40 micrometers or below. If the dot diameter is 30 micrometers or below, the respective recording dots cannot be distinguished by visual observation even in a highlight portion of the image, and the image quality is by far improved.

The relationship between the ink droplet diameter and the dot diameter depends on the ink droplet flying speed, the ink properties (viscosity, surface tension), the type of the recording medium and the like. Normally, the dot diameter is about twice larger than the ink droplet. Accordingly, in order to obtain a dot diameter of 30 micrometers, the droplet diameter should be about 15 micrometers. It should be noted that in this Specification, an ink droplet diameter represents a total ink amount (including satellite) ejected by one ink droplet ejection, which amount is converted into a diameter of a sphere. Here, the satellite is a small secondary ink droplet formed together with an ink droplet.

On the other hand, experimentally it is known that the minimum value of the droplet diameter obtained from a nozzle having a predetermined opening diameter is almost equal to the opening diameter (nozzle diameter). Accordingly, in order to obtain a droplet of 15 micrometers, the nozzle diameter should be 15 micrometers or below. However, in order to make a nozzle having a diameter of 15 micrometers or below, various difficulties are involved in production and nozzle clogging is often caused. This significantly deteriorates the reliability and service life of the ink jet recording head. Accordingly, the nozzle diameter has a practical lower limit of 20 to 25 micrometers. Consequently, it has been difficult to obtain a stable ejection of ink droplets having a diameter of 15 micrometers or below. Moreover, if the nozzle diameter is reduced for reducing the ink droplet diameter, there arises a problem that a droplet of the maximum diameter for a desired resolution cannot be easily ejected.

In order to solve the aforementioned problem, for example, Japanese Patent Publication A55-17589 discloses an ink jet recording head drive method in which a drive waveform signal of reversed trapezoidal configuration as shown in FIG. 35 is applied to the piezoelectric actuator so as to perform the so-called meniscus control immediately before discharging an ink droplet, so as to eject an ink droplet having a diameter smaller than the nozzle diameter.

The drive waveform shown in FIG. 35 consists of a first voltage change process 308 for reducing to 0V for example, the voltage V which has been set to a reference voltage $V_1$ (>0V) for application to the piezoelectric actuator; a voltage maintaining process 309 for maintaining the application voltage V which has been reduced to 0V for a certain period of time (time $t_2$); and a voltage change process 310 for increasing the piezoelectric actuator application voltage V to the height of voltage $V_2$, so as to reduce the volume of the pressure generation chamber to eject an ink droplet and to be ready for a subsequent eject operation.

It should be noted that the movement of the piezoelectric actuator by the increase or decrease of the voltage of the drive waveform signal depends on the configuration of the piezoelectric actuator and polarization direction. That is, there also exists a piezoelectric actuator moving in the reversed direction to the aforementioned piezoelectric actuator. For this piezoelectric actuator of the reversed movement, the voltage of the drive waveform signal can be reversed to obtain the same ejection operation as has been described above. For simplification, in this Specification, explanation will be given on a piezoelectric actuator which operates to reduce the volume of the pressure generation chamber when the voltage of the drive waveform signal is increased and to increase the volume of the pressure generation chamber when the voltage of the drive waveform signal is reduced.

FIG. 36 schematically shows movement of a meniscus 312 at the opening plane 311*a* of the nozzle 311 when the drive waveform signal shown in FIG. 35 is applied to the piezoelectric actuator. Firstly, when no ink droplet is to be ejected, as shown in FIG. 36(*a*), the meniscus 312 is at the opening plane 311*a* of the nozzle 311. When an ink droplet ejection is required, firstly, in order to increase the volume of the pressure generation chamber, the first voltage change process 308 of the drive waveform signal 1 is applied to the piezoelectric actuator. Then, as shown in FIG. 36(*b*), the meniscus 312 is pulled into the nozzle 311 from the opening plane 311*a* of the nozzle 311 and the meniscus configuration becomes concave (pulling process). After this, in order to reduce the volume of the pressure generation chamber, the second voltage change process 310 of the drive waveform signal is applied to the piezoelectric actuator. Then, as shown in FIG. 36(*c*), a liquid column 313 is formed at the center of the meniscus 312 and the tip end of the liquid column 313 is separated and as shown in FIG. 36(*d*), an ink droplet 314 is ejected (pushing process). The diameter of the ink droplet 314 ejected here is almost identical to the thickness of the liquid column 313 and smaller than the diameter of the nozzle 311.

However, in the conventional ink jet recording head drive method using the reversed trapezoidal drive waveform signal shown in FIG. 35, the ink droplet diameter actually obtained is about 25 micrometers at the smallest, which cannot satisfy the high quality request.

To cope with this, the inventor of the present invention has disclosed in Japanese Patent Application 10-318443 an ink jet recording head drive method in which a drive waveform signal having a waveform shown in FIG. 37 is applied to a piezoelectric actuator so as to eject a further small ink droplet.

The drive waveform signal shown in FIG. 37 consists of: a first voltage change process 315 for reducing the voltage V applied to the piezoelectric actuator from a reference voltage $V_1$ (>0V) to 0V, so as to increase the volume of the pressure generation chamber and make the meniscus retreat; a first voltage maintaining process 316 for maintaining the voltage V reduced to 0 for a certain period of time (time $t_2$); a second voltage change process 317 for increasing the piezoelectric actuator application voltage V to $V_2$ so as to reduce the volume of the pressure generation chamber and to form a liquid column at the center of the meniscus; a second voltage maintaining process 318 for maintaining the voltage $V_2$ for a certain period of time (time $t_4$); a third voltage change process 319 for reducing the voltage V from $V_2$ to 0V for example, so as to increase the volume of the pressure generation chamber and separate an ink droplet from the tip end of the liquid column; a third voltage maintaining process 320 for maintaining the application voltage V at 0V for a certain period of time (time $t_6$); and a fourth voltage change process 321 for increasing the piezoelectric actuator application voltage V to voltage $V_1$, so as to reduce the volume of the pressure generation chamber and suppress reverberation of the pressure wave remaining after the ink droplet eject.

That is, the drive waveform signal of FIG. 37 is a combination of the conventional meniscus control and an additional pressure wave control for early separation of an ink droplet and reverberation suppression. This enables stable ejection of an ink droplet having a diameter in the order of 20 micrometers.

However, in the conventional ink jet recording head drive method using the drive waveform signal having the waveform shown in FIG. 37, it is difficult to eject an ink droplet having a diameter smaller than 20 micrometers and it is impossible to eject an ink droplet of 15 micrometers or below.

To cope with this, the inventor of the present invention has disclosed in Japanese Patent Application 11-20613, an ink jet recording head drive method in which a drive waveform signal having a waveform shown in FIG. 38 is applied to the piezoelectric actuator, so as to eject an ink droplet having a diameter equal to or smaller than 15 micrometers.

The drive waveform signal shown in FIG. 38 consists of: a first voltage change process 322 for reducing the piezoelectric actuator application voltage V from a reference voltage $V_b$ (>0V) to ($V_b$–$V_1$) for a trailing time $t_1$ which is greater than a natural period $T_a$ of the natural vibration of a drive block consisting of a piezoelectric actuator and a diaphragm, so as to increase the volume of the pressure generation chamber and make the meniscus retreat; a first voltage maintaining process 323 for maintaining the voltage $V_b$–$V_1$) for a certain period of time (time $t_2$); a second voltage change process 324 for increasing the piezoelectric actuator application voltage V up to the voltage ($V_b$–$V_1$+$V_2$) for a trailing time $t_3$ which is smaller than the natural period $T_a$, so as to reduce the volume of the pressure generation chamber and form a liquid column at the center of the meniscus; a second voltage maintaining process 325 for maintaining the application voltage V at the voltage ($V_b$–$V_1$+$V_2$) for a certain period of time (time $t_4$); a third voltage change process 326 for reducing the application voltage V from the voltage ($V_b$–$V_1$+$V_2$) to 0V for example for a trailing time $t_5$ which is smaller than the natural period $T_a$, so as to increase the volume of the pressure generation chamber and to separate an ink droplet from the liquid column at an early stage; a third voltage maintaining process 327 for maintaining the application voltage V at 0V for a certain period of time (time $t_6$); and a fourth voltage change process 328 for increasing the piezoelectric actuator application voltage V up to the reference voltage $V_b$, so as to reduce the volume of the pressure generation chamber and suppress the reverberation of the pressure wave remaining after an ink droplet ejection.

That is, the drive waveform signal of FIG. 38 is a combination of the conventional meniscus control and a ejection mechanism utilizing the natural vibration of the piezoelectric actuator itself. Thus, the natural vibration of the piezoelectric actuator itself is excited and a high frequency vibration can be generated in the meniscus. This enables ejection of an ink droplet having a diameter of 15 micrometers or below.

However, in the conventional ink jet recording head drive method using the waveform shown in FIG. 38, the piezoelectric actuator deformation speed is increased. This significantly deteriorates the piezoelectric actuator reliability and service life.

Moreover, as has been described above, in order to excite the natural vibration of the piezoelectric actuator itself, it is necessary to change the voltage V applied to the piezoelectric actuator for a rise time $t_3$ and trailing time $t_5$ (1 microsecond for example) which are smaller than the natural period. In this case, a great current flows to the piezoelectric actuator instantaneously. Accordingly, the ink jet recording head drive circuit, especially, the piezoelectric actuator drive circuit should use a circuit part such as a semiconductor integrated circuit having a high current drive capability for instantaneously supplying a great current. Consequently, the circuit parts cost is increased, and a great current causes an increased heat dissipation, requiring a radiation unit. This increases the cost and size of the ink jet recording head drive circuit.

SUMMARY OF THE INVENTION

According to a first aspect of the present invention there is provided an ink jet recording head drive method and apparatus capable of stable ejection of a very small ink droplet by a meniscus control method to thereby achieve a high quality image.

An ink jet recording head drive method according to the first aspect of the present invention applies a drive voltage to an electro-mechanical converter which changes a pressure within a pressure generation chamber filled with ink, so that an ink droplet is ejected from a nozzle communicating with the pressure generation chamber, wherein the drive voltage has a voltage waveform including: a first voltage change process for increasing a volume of the pressure generation chamber so as to pull the ink meniscus from the nozzle opening toward the pressure generation chamber; and a second voltage change process for decreasing the volume of the pressure generation chamber, so as to eject the ink droplet, and wherein the first voltage change process is preceded by a preparatory voltage change process for slightly pulling the ink meniscus from the nozzle opening toward the pressure generation chamber.

That is, prior to the first voltage change process, the preparatory voltage change process is performed to slightly pull the ink meniscus at the nozzle opening toward the pressure generation chamber, so that the tip end of the meniscus is slightly pulled to the vicinity of the nozzle opening or to the pressure generation chamber. Thus, it is possible to obtain a stable and uniform initial meniscus state. This solves the various aforementioned problems.

Moreover, the preparatory voltage change process for slightly pulling the ink meniscus at the nozzle opening toward the pressure generation chamber prior to the first voltage change process can be realized by a preparatory voltage change process for increasing the volume of the pressure generation chamber. This voltage change process is to be performed prior to the first voltage change process, for stabilizing the meniscus configuration. Accordingly, its voltage change speed is preferably set at a smaller value than the voltage change speed of the first voltage change process, so that unnecessary vibration of meniscus is prevented.

Furthermore, in the preparatory voltage change process, by the same reason, the voltage change time of the voltage change process for increasing the volume of the pressure generation chamber is preferably set greater (longer) than the natural period of the pressure wave generated in the pressure generation chamber.

It should be noted that when the volume of the pressure generation chamber is increased, prior to the first voltage change process, so that the meniscus is slightly pulled toward the pressure generation chamber, the meniscus at the nozzle opening plane or retrieved from the nozzle opening plane upon completion of the preceding ejection is further pulled toward the pressure generation chamber. The applicant of the present invention has confirmed that a slight retrieval of the meniscus from the nozzle opening plane does not cause a large fluctuation of the droplet diameter or the droplet speed.

Moreover, the preparatory voltage change process for slightly pulling the ink meniscus at the nozzle opening toward the pressure generation chamber prior to the first voltage change process can be realized by a preparatory voltage change process consisting of a voltage change process for decreasing the volume of the pressure generation chamber and a voltage maintaining process for maintaining the voltage for a predetermined period of time.

In this method, firstly, the volume of the pressure generation chamber is decreased to cause a temporal overshoot state of the meniscus. However, while the voltage is maintained for the predetermined period of time, the meniscus overshoot state naturally disappears by the ink surface tension. In the same way as when the volume of the pressure generation chamber is increased prior to the first voltage change process, it is possible to obtain a stable and uniform initial meniscus configuration at the start of the first voltage change process.

In this case also, in order to stabilize the meniscus configuration earlier, by preventing a sudden overshoot generation and vibration, the voltage change time of the voltage change process, in the preparatory voltage change process, for decreasing the pressure generation chamber volume is preferably set greater (longer) than the natural period of the pressure wave generated in the pressure generation chamber.

Furthermore, duration of the voltage maintaining process following the voltage change process for decreasing the pressure generation chamber volume is optimally set at ⅓ to ⅔ of the natural period of vibration of the ink droplet at the nozzle opening, i.e., the natural period of the attenuation vibration of the meniscus.

Thus, even if the meniscus protrudes by overshoot at the final stage of the voltage change process for decreasing the pressure generation chamber volume, the aforementioned first voltage change process can be started at the trough of the amplitude generated by attenuation vibration, i.e., at the meniscus retrieved from the nozzle surface as the initial state.

Moreover, when the present invention is applied to an apparatus, one or more than one waveform generation unit for generating a drive voltage to be applied to an electro-mechanical converter include a function to generate a waveform having the preparatory voltage change process for slightly pulling an ink meniscus toward the pressure generation chamber prior to the first voltage change process.

The electro-mechanical converter may be a piezoelectric actuator.

According to a second aspect of the present invention, there is provided an ink jet recording head drive method and drive apparatus which solves the structural problem of cross talk in the ink jet recording head without lowering the printing speed and enables both high quality and a high speed recording.

An ink jet recording head drive method according to the second aspect the present invention provides an ink jet recording head comprising: a plurality of pressure generation chambers filled with ink; nozzles provided in the pressure generation chambers for discharging the ink; and a vibration generation unit provided for each of the pressure generation chambers that causes a pressure change in the respective pressure generation chamber, wherein drive voltage waveforms to be applied to the vibration generation units are prepared according to a diameter of ink droplets to be ejected, so that the drive voltage waveforms corresponding to different ink droplet diameters are applied at predetermined different timings.

Further according to the method of the second aspect, drive voltage waveforms are generated according to droplet diameters and the drive voltage waveforms are applied to vibration generation unit provided for each of the pressure generation chambers, at predetermined different timings. Accordingly, when an ink droplet is ejected from one of the pressure generation chambers, the vibration will not affect the other pressure generation chambers. Thus, an ink droplet of a desired diameter can be generated in each of the pressure generation chambers and ejected from a nozzle at a desired speed.

Moreover, since the drive voltage waveforms are generated according to the ink diameters, it is possible to successively eject ink droplets of different diameters within a short period of time, without prolonging time required for recording.

According to the second aspect of the present invention, the drive voltage waveforms are set so that a smaller diameter ink droplet is ejected earlier.

As the ink droplet becomes smaller, i.e., the mass becomes smaller, the air resistance becomes greater and it takes more time to reach a recording medium. According to this method, a droplet of smaller diameter is ejected earlier. This reduces the difference in time to reach the recording medium, which improves the recording image quality.

Further according to the second aspect of the present invention, the drive voltage waveform for discharging a small diameter ink droplet includes a portion for pulling the meniscus at the nozzle toward the pressure generation chamber.

According to this method, it is possible to obtain an ink droplet of a desired diameter with a high accuracy, which enables obtaining a recorded image of a high quality.

An apparatus according to a second aspect the present invention, is comprised of an ink jet recording head drive apparatus for an ink jet recording head including: a plurality of pressure generation chambers; nozzles provided to communicate with the pressure generation chambers for discharging ink; and vibration generation units provided for generating vibration to cause an inner pressure change in the pressure generation chambers wherein a drive voltage waveforms are applied to the vibration generation unit for discharging ink droplets from the nozzle, the apparatus comprising a plurality of waveform generation units provided according to the diameter of ink droplets to be ejected, so as to generate drive voltage waveforms according to the ink droplet diameter, wherein the drive voltage waveforms generated according to the ink droplet diameter by the waveform generation unit are set so as to be generated at different ejection times according to the different ink droplet diameters.

According to this configuration, drive voltage waveforms are generated according to the ink droplet diameters, and the drive voltage waveform are applied, with different timing, to the vibration generation unit provided for the respective pressure generation chambers. Accordingly, when an ink droplet is ejected from a pressure generation chamber, the vibration will not affect the other pressure generation chambers. Thus, an ink droplet of a desired diameter can be obtained in each of the pressure generation chambers and ejected from the nozzle at a desired speed.

Moreover, since the drive voltage waveforms are generated according to the different diameters of ink droplets, it is possible to successively eject ink droplets of different diameters within a short period of time without prolonging the time required for recording.

Further according to the second aspect of the present invention, the vibration generation unit is a piezoelectric actuator.

This enables to reduce the apparatus size and control the pressure wave generation in the pressure generation chamber with a high accuracy.

Further according to the second aspect of the present invention, the piezoelectric actuator generates a longitudinal vibration.

By using the piezoelectric actuator of longitudinal vibration type, it is possible to reduce the size of the actuator in comparison to the actuator of deflection vibration type, which in turn enables a high density arrangement of nozzles.

According to a third aspect of the present invention, there is provided an ink jet recording head drive method and a circuit thereof capable of discharging a small ink droplet having a diameter equal to or smaller than 20 micrometers without deteriorating the reliability and service life of the piezoelectric actuator, and at a reasonable cost and with a small size configuration.

With a view to solving the above-mentioned problem, an ink jet recording head drive method according to the third aspect of the invention applies to an ink jet recording head comprising a pressure generation chamber filled with ink, a pressure generation unit for generating a pressure in the pressure generation chamber, and a nozzle communicating with the pressure generation chamber, wherein a drive waveform signal is applied to the pressure generation unit so as to change the volume of the pressure generation chamber so that an ink droplet is ejected from the nozzle, the drive waveform signal having a waveform including at least: a first voltage change process for applying a voltage in the direction to increase the volume of the pressure generation chamber; and a second voltage change process for applying a voltage in the direction to decrease the volume of the pressure generation chamber, wherein the first voltage change process has a voltage change time set within a range of about ⅓ to ⅔ of a natural period TC of a pressure wave generated in the pressure generation chamber, and the second voltage change process has a start time set immediately after completion of the first voltage change process.

Moreover, an ink jet recording head drive method according to the third aspect of the invention is characterized in that the first voltage change process in the waveform of the drive waveform signal has a voltage change time set to ½ of the natural period TC.

Moreover, an ink jet recording head drive method according to the third aspect of the invention is characterized in that the waveform of the drive waveform signal is such that a time interval between the end time of the first voltage change process and the start time of the second voltage change process is set to a length equal to or shorter than about ⅕ of the natural period TC.

Moreover, an ink jet recording head drive method according to the third aspect of the invention is characterized in that the waveform of the drive waveform signal is such that the second voltage change process has a voltage change time set to about ⅓ of the natural period TC or below.

Moreover, an ink jet recording head drive method further according to the third aspect of the invention is characterized in that the waveform of the drive waveform signal is such that the second voltage change process is followed by a third voltage change process for applying a voltage in the direction to increase the volume of the pressure generation chamber.

Moreover, an ink jet recording head drive method according to a first variation of the third aspect of the invention is characterized in that the waveform of the drive waveform signal is such that the third voltage change process has a voltage change time set to about ⅓ of the natural period TC.

Moreover, an ink jet recording head drive method according to a second variation of the third aspect of the invention is characterized in that the waveform of the drive waveform signal is such that a time interval between the second voltage change process end time and the third voltage change process start time is set to about ⅕ of the natural period TC or below.

Moreover, an ink jet recording head drive method according to a third variation of the third aspect of the invention is characterized in that the waveform of the drive waveform signal is such that the third voltage change process has a voltage change amount set to be greater than the voltage change amount of the second voltage change process.

Moreover, an ink jet recording head drive method according to a fourth variation of the third aspect of the invention is characterized in that the waveform of the drive waveform signal is such that the third voltage change process is followed by a fourth voltage change process for applying voltage in the direction to reduce the volume of the pressure generation chamber.

Moreover, an ink jet recording head drive method according to a first variant of the fourth variation of the third aspect of the invention is characterized in that the drive waveform signal has a such a waveform that the fourth voltage change process has a voltage change time set to about ½ of the natural period TC or below.

Moreover, an ink jet recording head drive method according to a second variant of the fourth variation of the third aspect of the invention is characterized in that the drive waveform signal has a such a waveform that the time interval between the end of the third voltage change process and the start time of the fourth voltage change process is set to about ⅓ of the natural period $T_C$ or below.

Moreover, an ink jet recording head drive method according to a fifth variation of the third aspect of the invention is characterized in that the natural period TC is 15 microseconds or below.

Moreover, an ink jet recording head drive method according to a sixth variation of the third aspect of the invention is characterized in that the pressure generation unit is an electro-mechanical converter.

Moreover, an ink jet recording head drive method according to a first variant of the sixth variation of the third aspect of the invention is characterized in that the electro-mechanical converter is a piezoelectric actuator.

An ink jet recording head drive circuit for an ink jet recording head according to the third aspect of the invention comprises a pressure generation chamber filled with ink, pressure generation unit for generating a pressure in the pressure generation chamber, and a nozzle communicating with the pressure generation chamber, wherein a drive waveform signal is applied to the pressure generation unit so as to change the volume of the pressure generation chamber so that an ink droplet is ejected from the nozzle, the circuit comprising a waveform generation unit operating according to a drive waveform signal having a waveform consisting of at least: a first voltage change process for applying a voltage in the direction to increase the volume of the pressure generation chamber; and a second voltage change process for applying a voltage in the direction to decrease the volume of the pressure generation chamber, wherein the first voltage change process has a voltage change time set within a range of about ⅓ to ⅔ of a natural period $T_C$ of a pressure wave generated in the pressure generation chamber, and the second voltage change process has a start time set immediately after completion of the first voltage change process.

Moreover, an ink jet recording head drive circuit according to the third aspect of the invention, is further characterized in that said waveform generation unit generates a drive waveform signal having a waveform in which the voltage change time of the first voltage change process is set to about ½ of the natural period $T_C$.

Moreover, a first variation of an ink jet recording head drive circuit according to the third aspect of the invention is further characterized in that said waveform generation unit generates a drive waveform signal having a waveform in which the time interval between the end time of the first voltage change process and the start time of the second voltage change process is set to about ⅕ of the natural period or below.

Moreover, a second variation of an ink jet recording head drive circuit according to the third aspect of the invention is further characterized in that the waveform generation unit generates such a drive waveform signal that the second voltage change process has a voltage change time set to about ⅓ of the natural period $T_C$ or below.

Moreover, a third variation of an ink jet recording head drive circuit according to the third aspect of the invention is further characterized in that the waveform generation unit generates such a drive waveform signal that the second voltage change process is followed by a third voltage change process for applying a voltage in the direction to increase the volume of the pressure generation chamber.

Moreover, a first variant of the third variation of an ink jet recording head drive circuit according to a third aspect of the invention is characterized in that the waveform generation unit generates a drive waveform signal having such a waveform that the third voltage change process has a voltage change time set to about ⅓ of the natural period $T_C$.

Moreover, a second variant of the third variation of an ink jet recording head drive circuit according to the third aspect of the invention is characterized in that the waveform generation unit generates a drive waveform signal having is such waveform that a time interval between the second voltage change process end time and the third voltage change process start time is set to about ⅕ of the natural period $T_C$ or below.

Moreover, a third variant of the third variation of an ink jet recording head drive circuit according to the third aspect of the invention is characterized in that the waveform generation unit generates a drive waveform signal having such a waveform that the third voltage change process has a voltage change amount set to be greater than the voltage change amount of the second voltage change process.

Moreover, a fourth variant of the third variation of an ink jet recording head drive circuit according to the third aspect of the invention is characterized in that the waveform generation unit generates a drive waveform signal having such a waveform that the third voltage change process is followed by a fourth voltage change process for applying voltage in the direction to reduce the volume of the pressure generation chamber.

Moreover, a first variant of the fourth variant of the third variation of an ink jet recording head drive circuit according to the third aspect of the invention is characterized in that the waveform generation unit generates a drive waveform signal having a such a waveform that the fourth voltage change process has a voltage change time set to about ½ of the natural period $T_C$ or below.

Moreover, a second variant of the fourth variant of the third variation of an ink jet recording head drive circuit according to the third aspect of the invention is characterized in that the waveform generation unit generates a drive waveform signal having a such a waveform that the time interval between the end of the third voltage change process and the start time of the fourth voltage change process is set to about ⅓ of the natural period $T_C$ or below.

Moreover, a fourth variation of an ink jet recording head drive circuit according to the third aspect of the invention is characterized in that the natural period $T_C$ is 15 microseconds or below.

Moreover, a fifth variation of an ink jet recording head drive circuit according to the third aspect of the invention is characterized in that the pressure generation unit is an electro-mechanical converter.

Moreover, a first variant of the fifth variation of an ink jet recording head drive circuit according to the third aspect of the invention is characterized in that the electro-mechanical converter is a piezoelectric actuator.

According to the present invention, it is possible to eject a small ink droplet having a diameter of 20 micrometers or below without deteriorating the piezoelectric actuator reliability and service life, and with a small size configuration at a low cost.

Before describing the invention in detail, an explanation will be given on a theoretical basis of the validity of the present invention using a lumped parameter circuit model.

FIG. 20(*a*) is circuit diagram equivalent to the ink jet recording head filled with ink shown in FIG. 12(*a*). In FIG. 20, $m_0$ represents inertance (acoustic mass) [kg/m$^4$] of a drive block consisting of a piezoelectric actuator 336 and a diaphragm 335; $m_2$ represents inertance of an ink supply hole 333; $m_3$ represents inertance of a nozzle 334; $r_0$ represents acoustic resistance of the drive block [Ns/m$^5$]; $r_2$ represents acoustic resistance of the ink supply hole 333; $r_3$ represents acoustic resistance of the nozzle 334; $c_0$ represents acoustic capacity [m$^5$/N] of the drive block; $c_1$ represents acoustic capacity of the pressure generation chamber 331; $c_3$ represents acoustic capacity of the nozzle 334; $u_1$ represents volume velocity in the ink supply hole 333; $u_2$, volume velocity in the ink supply hole 333; $u_3$ represents volume velocity in the nozzle 334; and θ represents pressure [Pa] applied to the ink.

Here, if the piezoelectric actuator 336 is a highly-rigid layered type piezoelectric actuator, it is possible to ignore the drive block inertance $m_0$, the acoustic resistance $r_0$, and the acoustic capacity $c_0$. Moreover, when analyzing a pressure wave, it is also possible to ignore the acoustic capacity $c_3$. Accordingly, the equivalent circuit of FIG. 20(*a*) can approximately be represented by an equivalent circuit of FIG. 20(*b*).

Moreover, assuming that the intertances $m_2$ and $m_3$ of the ink supply hole 333 and the nozzle 334 are in the relationship of $m_2=km_3$ and that the acoustic resistances $r_2$ and $r_3$ of the ink supply hole 333 and the nozzle 334 are in the relationship of $r_2=kr_3$, and if a drive waveform signal having a rise angle of θ is input for circuit analysis as shown in FIG. 21(*a*), a particle velocity (velocity of ink molecule) V3' [m/s] in the nozzle 334 within the rise time $0 \leqq t \leqq t_1$ is given by Equation (1). In Equation (1), A3 represents an area of the opening of the nozzle 334, and the particle velocity (velocity of ink molecule) $V_3'$ in the nozzle 334 is an volume velocity $u_3$ in the nozzle 334 divided by the area $A_3$ of the opening of the nozzle 334.

$$v_3'(t,\theta) = \frac{c_1 \tan\theta}{A_3\left(1+\frac{1}{k}\right)}\left[1 - \frac{W}{E_c}\exp(-D_c \cdot t)\sin(E_c \cdot t - \phi_0)\right] \tag{1}$$

$$E_c = \sqrt{\frac{1+\frac{1}{k}}{c_1 m_3} - D_c^2}$$

$$D_c = \frac{r_3}{2m_3}$$

$$w^2 = \frac{1+\frac{1}{k}}{c_1 m_3}$$

$$\phi_0 = \tan^{-1}\left(\frac{E_c}{D_c}\right)$$

Next, when using a drive waveform signal of a complicated (trapezoidal) configuration as shown in FIG. 21(*b*), the particle velocity can be obtained by superimposing a pressure wave generated at the turning points (A, B, C, D) of the drive waveform signal. That is, when the drive waveform signal of FIG. 21(*b*) is used, the particle velocity $V_3$ [m/s] in the nozzle 334 can be given by Equation (2).

$$\left.\begin{aligned}
&v_3(t) = v_3'(t,\theta_1) \quad (0 \le t < t_1)\\
&v_3(t) = v_3'(t,\theta_1) + v_3'(t-t_1,\theta_2) \quad (t_1 \le t < t_1+t_2)\\
&v_3(t) = v_3'(t,\theta_1) + v_3'(t-t_1,\theta_2) +\\
&\qquad v_3'(t-t_1-t_2,\theta_3) \quad (t_1+t_2 \le t < t_1+t_2+t_3)\\
&v_3(t) = v_3'(t,\theta_1) + v_3'(t-t_1,\theta_2) +\\
&\qquad v_3'(t-t_1-t_2,\theta_3) +\\
&\qquad v_3'(t-t_1-t_2-t_3,\theta_4) \quad (t \ge t_1+t_2+t_3)
\end{aligned}\right\} \tag{2}$$

Here, FIG. 23 shows a particle velocity change according to time when a drive waveform signal of FIG. 22 is used, the change being calculated by using Equation (2) considering only a vibration component of Equation (1). The drive waveform signal shown in FIG. 22 consists of a first voltage change process 341 for reducing the piezoelectric actuator application voltage from a reference voltage $V_1$ (>0V) to 0V for example, so as to increase the volume of the pressure generation chamber and make the meniscus retreat; a voltage maintaining process 342 for maintaining the application voltage V at 0V for a certain period of time (time $t_2$); and a second voltage change process 343 for increasing the piezoelectric actuator application voltage V to $V_2$, so as to reduce the volume of the pressure generation chamber, eject an ink droplet, and be ready for the subsequent eject operation.

In FIGS. 23(*a*) and 23(*b*), thin lines "a" to "d" represent particle velocity change at the turning points A, B, C, and D of the drive waveform signal shown in FIG. 22, and the thick line "s" represents a sum of the particle velocities, i.e., particle velocity change according to the time actually generated in the meniscus.

(1) In the drive waveform signal shown in FIG. 22, when $t_1$ is set as ½ of the natural period $T_c$ (=2/Ec) of the pressure wave generated in the pressure generation chamber and $t_2$ is set to a very small value, as shown in FIG. 23(*a*), the time change phases of the particle velocity at the turning points A, B, and C are almost matched with one another. Accordingly, in the time interval ($t>t_1+t_2$), the particle velocity is suddenly increased.

Next, explanation will be given on the meniscus configuration change when such a sudden change has occurred in the particle velocity with reference to FIG. 23 and FIG. 24.

When the particle velocity change shown in FIG. 23(*a*) is applied to the meniscus 354, within the time $t_1$, the meniscus 354 is pulled from the opening plane of the nozzle 351 into the nozzle 351 and becomes concave. Next, within the time $t_2$, the meniscus 354 is pushed out of the nozzle 351. When push is applied to the concave configuration of the meniscus 354 is pushed out of the nozzle 351. When push is applied to the concave configuration of the meniscus 354, a slender liquid column 352 is formed at the center of the meniscus 354.

There has been no detailed study about the formation mechanism of this liquid column 352. The inventor of the present invention performed observation of the ink droplet ejection and fluid analysis and confirmed that the thickness of the liquid column 352 depends on the velocity of the liquid surface when the meniscus 354 is pushed out. That is, when a push out force is applied to the concave meniscus 354, as shown in FIGS. 24(*a*) and 24(*b*), each of the meniscus 354 portions moves in the direction of the normal lines (arrows in the figures). As a result, a large amount of ink is concentrated in the center of the nozzle 351. This local ink volume increase forms the liquid column 352 at the center of the nozzle 351. Here, if the liquid surface movement velocity is high, the ink volume is also rapidly increased at the center of the nozzle 351 and accordingly, a very slender liquid column 352 is rapidly formed (see FIG. 24(*a*)). Conversely, when the liquid surface movement velocity is low, the ink volume increase at the center of the nozzle 351 becomes also slow and accordingly, the liquid column 352 becomes thicker and the column growth also becomes slow (see FIG. 24(*b*)).

It should be noted that, as has been described above, the diameter of the ink droplet 353 ejected from the nozzle 351 using the "meniscus control" method is almost identical to the thickness of the liquid column 352 formed. Moreover, the ink droplet flying velocity (droplet velocity) is almost identical to the growth velocity of the liquid column 352.

Accordingly, in order to eject a small ink droplet at a high speed, it is necessary to increase the liquid surface movement velocity at the "push" process to cause a rapid ink volume increase at the center of the nozzle 351.

Based on the aforementioned observation, in the drive waveform signal of FIG. 22, the conditions of time $t_1$ set to ½ of the natural period $T_c$ and the time $t_2$ set to a very small value are significantly advantageous for discharging a small ink droplet. That is, under such a condition, as shown in FIG. 23(*a*), the time change phases of the particle velocities at the turning points A, B, and C are almost overlapped. Accordingly, within a time interval ($t>t_1+t_2$), the particle velocity is suddenly increased and the liquid surface movement velocity becomes high. This causes a rapid ink volume increase at the center of the nozzle 351, which forms a slender liquid column 352. As a result, a very small ink droplet 353 can be ejected at a high speed. That is, the sudden increase of the liquid surface movement velocity of the meniscus 354 is an important condition for discharging the very small ink droplet 353.

(2) On the other hand, in the drive waveform signal shown in FIG. 22, if the time $t_1$ has not been set to ½ of the natural period $T_C$, the time change phases of the particle velocities at the turning points A, B, and C are not matched as shown in FIG. 23(*b*) and the sum (thick line s) of the particle velocities becomes a dull change.

That is, if the time $t_1$, is shorter than ½ of the natural period $T_C$, while the particle velocity generated at the turning point A is negative, a positive particle velocity is generated at the turning point B. These velocities cancel each other, and the increase of the movement velocity of the liquid surface of the meniscus 354 becomes dull. On the other hand if the time $t_1$ is longer than ½ of the natural period $T_C$, the particle velocity generated at the turning point A becomes positive before generation of the positive particle velocity at the turning point B. In this case also, it is impossible to obtain a rapid increase of the liquid surface movement velocity of the meniscus 354.

Under these conditions, it becomes difficult to obtain a rapid ink volume increase at the center of the nozzle 351, and the liquid column 352 becomes thicker. As a result, the diameter of the ink droplet 353 ejected becomes larger and the droplet velocity becomes slower (see FIG. 24(*b*)). Thus, it becomes impossible to obtain a very small ink droplet having a diameter of 20 micrometers or below required for high quality recording.

As has been described above, the droplet diameter and the droplet velocity of the ink droplet 353 ejected from the nozzle 351 greatly depend on the voltage change time $t_1$ of the first voltage change process 341 and the voltage maintaining time $t_2$, i.e., a time interval between the end time of the first voltage change process 341 and the start time of the second voltage change process 343 in the drive waveform signal shown in FIG. 22. By setting the voltage change time $t_1$ at about ½ of the natural period $T_C$ and setting the voltage maintaining time $t_2$ at a sufficiently short value, it is possible to eject a very small ink droplet at a high velocity.

It should be noted that in this case, because the natural vibration of the piezoelectric actuator itself is not utilized, there is no danger of deteriorating the reliability and the service life of the piezoelectric actuator. Moreover, the drive circuit of the ink jet recording head, especially the drive circuit of the piezoelectric actuator is identical to the conventional configuration and accordingly, there is no need of increase the production cost and size of the ink jet recording head drive circuit.

BRIEF DESCRIPTION OF THE DRAWINGS

FIG. 5(*a*) shows a waveform for discharging the small droplets; FIG. 5(*b*) shows a waveform for discharging the intermediate droplets; and FIG. 5(*c*) shows a waveform for discharging large droplets.

FIG. 6(*a*) shows the relationship between the eject frequency and the droplet diameter. FIG. 6(*b*) shows the relationship between the ejection frequency and the droplet speed.

FIG. 7(*a*) is a graph showing a drive voltage waveform for discharging a small diameter ink droplet; FIG. 7(*b*) is a graph showing a drive voltage waveform for discharging an intermediate diameter ink droplet; and FIG. 7(*c*) is a graph showing a drive voltage waveform for discharging a large diameter ink droplet.

FIG. 10(*a*) is a graph showing a drive voltage waveform for discharging a small diameter ink droplet; FIG. 10(*b*) is a graph showing a drive voltage waveform for discharging an intermediate diameter ink droplet; and FIG. 10(*c*) is a graph showing a drive voltage waveform for discharging a large diameter ink droplet.

FIG. 26(*a*) shows an example of drive waveform which has been used in a conventional ink jet recording head; and FIG. 26(*b*) shows an improved example.

FIG. 27(*a*) shows an initial state of the meniscus when a reference voltage is applied; FIG. 27(*b*) shows a state immediately before eject when voltage of the first voltage change process is applied; FIG. 27(*c*) shows a eject start state when voltage of the second voltage change process is applied; and FIG. 27(*d*) shows an ink droplet separated from the liquid column and ejected.

FIG. 28(*a*) shows a state immediately after an ink droplet eject. FIG. 28(*b*) and FIG. 28(*f*) show a state in which the meniscus has returned to the nozzle opening plan. FIG. 28(*c*) shows a meniscus protrusion caused by overshoot. FIG. 28(*d*) shows a concave meniscus in the process of vibration attenuation. FIG. 28(*e*) shows a state of meniscus overshoot at an stage that the vibration has attenuated to some extent.

FIG. 29(*a*) shows an initial state when a reference voltage is applied. FIG. 29(*b*) shows a state immediately before eject when voltage of the first voltage change process is applied. FIG. 29(*c*) shows a state of eject start when voltage of the second voltage change process is applied. FIG. 29(*d*) shows an ink droplet is separated from the liquid column and ejected.

FIG. 33(*a*) is for the small diameter ink droplet, (*b*) is for the intermediate ink droplet, and (*c*) is for the large diameter ink droplet.

DETAILED DESCRIPTION OF EMBODIMENTS OF THE INVENTION

[First Embodiments]

Figure 1:
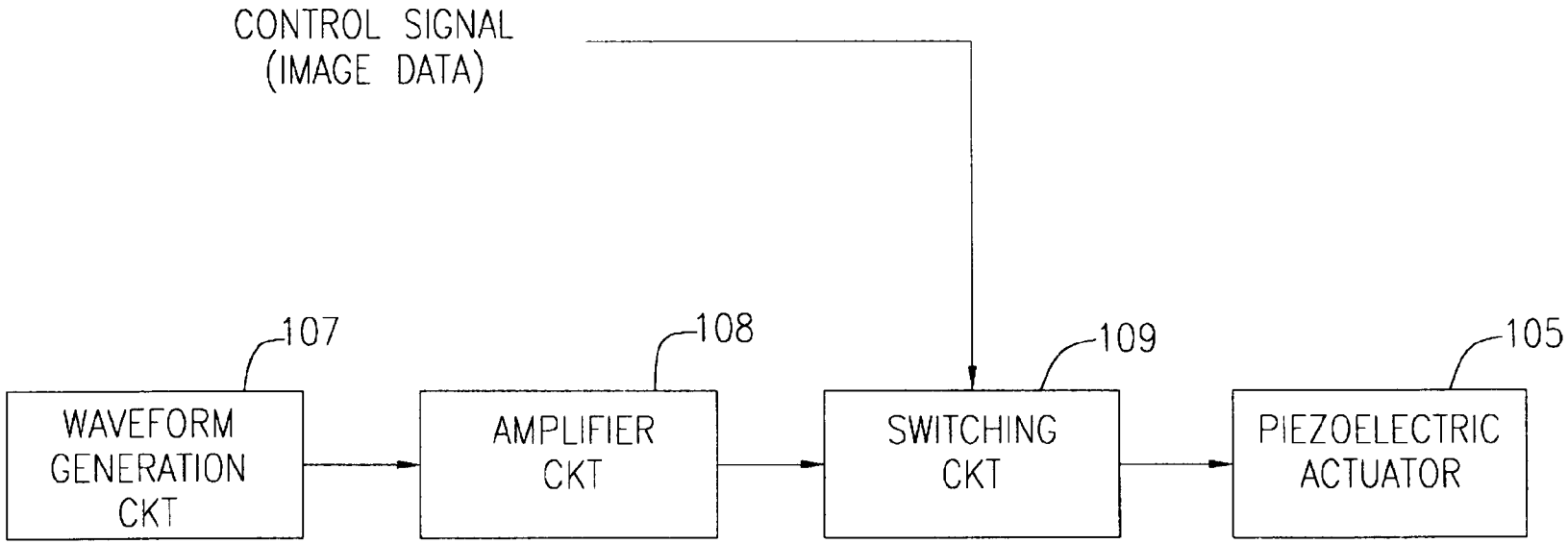
FIG. 1 is a block diagram showing an example of a drive circuit when using a fixed diameter of ink droplets to be ejected.

Hereinafter, description will be directed to embodiments of the present invention with reference to the attached drawings. In a first embodiment of the present invention, an ink jet recording head has used basically identical configuration as the ink jet recording head shown in FIG. 25. The head is prepared by a plurality of thin plates each having a holes formed by etching or the like. The thin plates are layered and attached to each other with an adhesive agent. In this embodiment, stainless plates having a thickness of 50 to 75 micrometers were adhered to each other using an adhesive layer (thickness about 20 micrometers) of a thermosetting resin. The head has a plurality of pressure generation chambers 100 (arranged in the direction vertical to the sheet surface in FIG. 25) which are connected by a common ink chamber 102. The common ink chamber 102 is connected to an ink tank (not depicted) and serves to introduce ink into the respective pressure generation chambers 100. Each of the pressure generation chambers 100 communicates with the common ink chamber 102 via an ink supply path 103 and each of the pressure generation chambers 100 are filled with ink. Moreover, each of the pressure generation chambers 100 has a nozzle 101 for discharging the ink.

In this embodiment, the nozzle 101 and the ink supply path 103 have an identical configuration: open diameter about 30 micrometers, bottom diameter 65 micrometers, and tapered length 75 micrometers. The holes were formed by a press. Moreover, the nozzle surface was subjected to water-repel treatment.

At the bottom of the pressure generation chamber 100, there is provided a diaphragm 104 which can increase or decrease the volume of the pressure generation chamber by the piezoelectric actuator (piezoelectric actuator) 105 as the electro-machine converter. In this embodiment the diaphragm 104 is a thin plate made from nickel and formed by electroforming. The piezoelectric actuator 105 is made from layered type piezoelectric ceramics.

When the piezoelectric actuator 105 has caused a volume change of the pressure generation chamber 100, a pressure wave is generated in the pressure generation chamber 100. This pressure wave moves the ink reserved in the opening of the nozzle 101, so as to be ejected outside from the nozzle 101 to form an ink droplet 106. It should be noted that the pressure wave of the head used in this embodiment has a natural period of 14 microseconds. Here, the natural period is defined as follows. When the piezoelectric actuator 105 vibrates the diaphragm 104 to compress or expand the pressure generation chamber 100, the inner pressure change caused by the configuration change of the diaphragm 104 functions on the pressure generation chamber 100. Here, the time required for functioning on the entire region inside the pressure generation chamber 100 is the natural period.

Next, explanation will be given on a basic configuration of a drive circuit for driving the piezoelectric actuator with reference to FIG. 1 and FIG. 2.

FIG. 1 shows an example of a drive circuit when the ink droplet diameter is fixed (without performing droplet diameter modulation). This drive circuit generates and amplifies a drive waveform signal, which is supplied to the piezoelectric actuator, so as to record a character or image on a recording paper. As shown in FIG. 1, the drive circuit includes a waveform generation circuit 107, an amplification circuit 108, a switching circuit (transfer gate circuit) 109, and a piezoelectric actuator 105. The waveform generation circuit 107 consists of a digital-to-analog converter circuit and an integration circuit. The drive waveform data is converted into analog data, before subjected to integration operation, to generate a drive waveform signal. The amplification circuit 108 amplifies in voltage and current the drive waveform signal supplied from the waveform generation circuit 107 and outputs an amplified drive waveform signal. The switching circuit 109 performs on/off control of the ink droplet eject. According to a signal generated according to an image data, the switching circuit 109 applies the drive waveform signal to the piezoelectric actuator 105.

Figure 2:
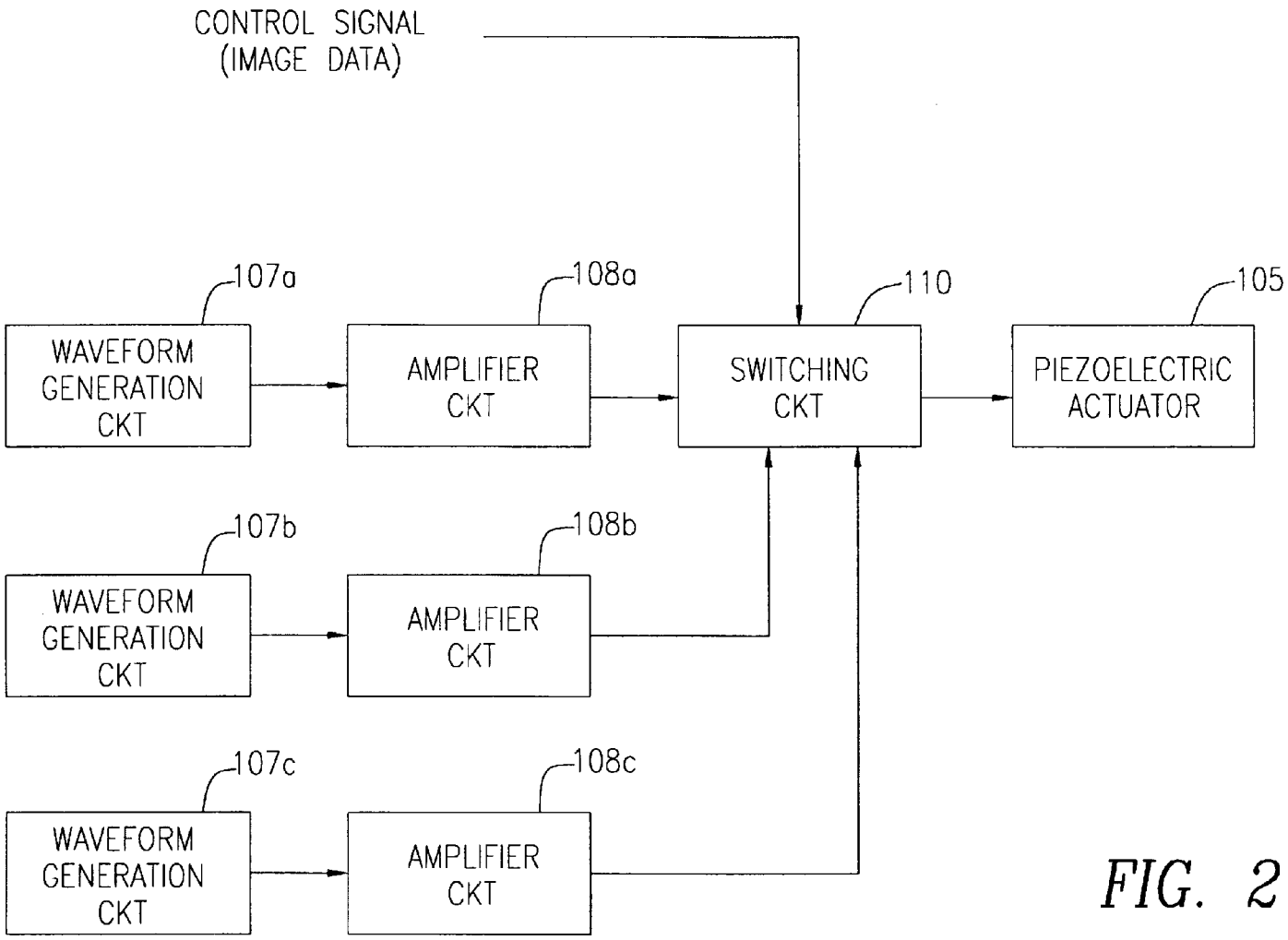
FIG. 2 is a block diagram showing an example of a drive circuit when switching between multiple diameter steps of the ink droplets to be ejected.

FIG. 2 shows a basic configuration of a drive circuit when performing droplet diameter modulation, i.e., switching the ink droplet diameter in multiple steps. In this example of the drive circuit, in order to modulate the droplet diameter in three steps (large, intermediate, and small droplets), three waveform generator circuits 107*a,* 107*b,* and 107*c* are provided. The respective waveforms are amplified by amplification circuits 108*a,* 108*b,* and 108*c*. During recording, according to an image data, the drive waveform applied to the piezoelectric actuator 105 is switched by the switching circuit 110, so that an ink droplet of a desired diameter is ejected.

It should be noted that the drive circuit for driving the piezoelectric actuator is not to be limited to the aforementioned but can have other configuration.

Figure 3:
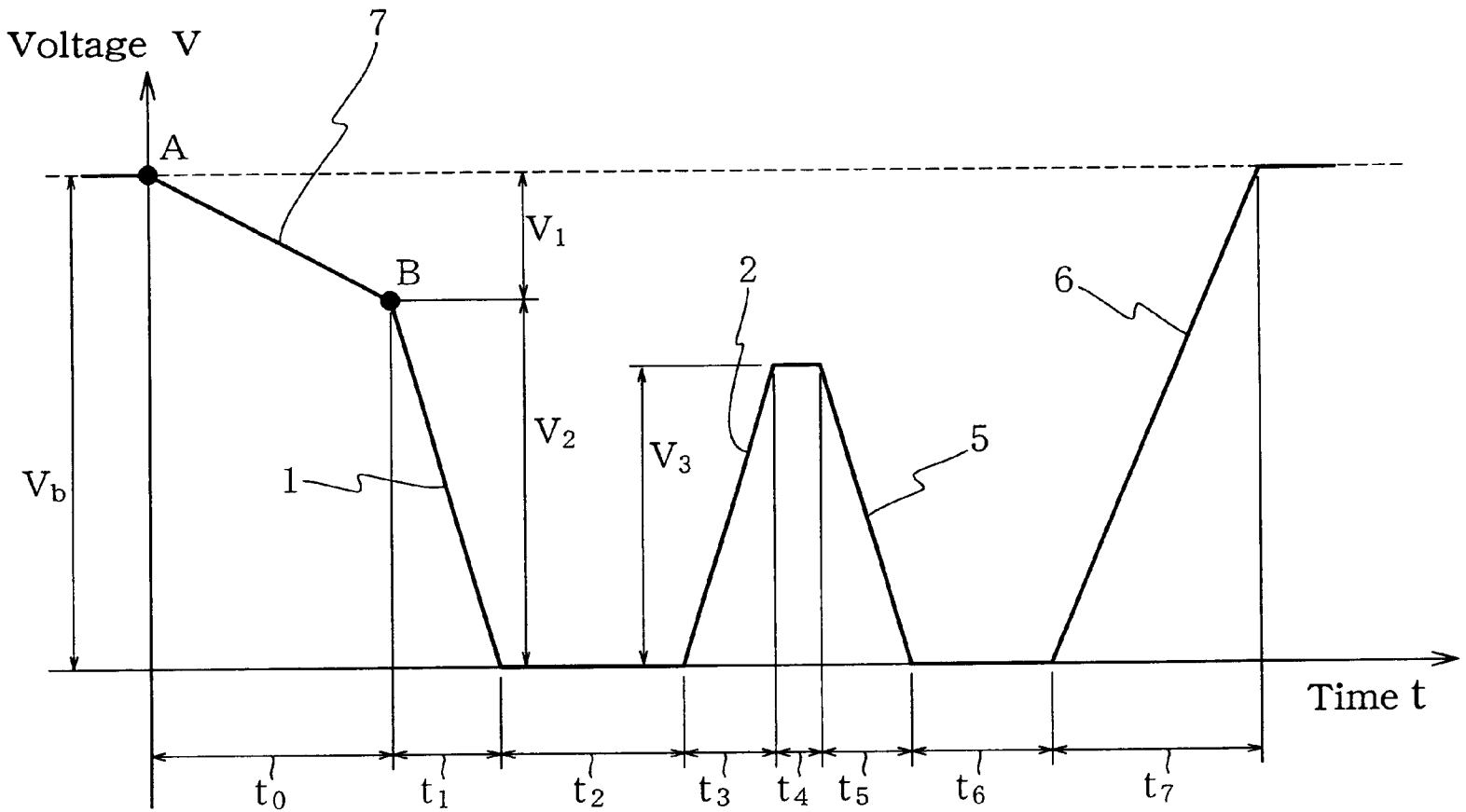
FIG. 3 shows an example of drive waveform used for discharging a very small droplet having a diameter in the order of 20 micrometers.

FIG. 3 shows an example of drive waveform used for discharging a very small droplet having a diameter about 20 micrometers by using the ink jet recording head based on the configuration of FIG. 1.

The drive waveform is constituted by: a preparatory voltage change process 7 for slowly expanding the pressure generation chamber volume for time $t_0$=30 microseconds; a first voltage change process 1 for rapidly expanding the pressure generation chamber volume for time $t_1$=2 microseconds; a second voltage change process 2 for rapidly compressing the pressure generation chamber volume for time $t_3$=2 microseconds; a third voltage change process 5 for rapidly expanding the pressure generation chamber volume for time $t_5$=2 microseconds; and a fourth voltage change process 6 for slowly resetting the application voltage to a reference voltage ($V_b$=20V) for time $t_7$=30 microseconds. It should be noted that $t_2$, $t_4$, and $t_6$ were set to 4 microseconds, 0.3 microseconds, and 8 microseconds, respectively; and $V_1$, $V_2$, and $V_3$ were set to V5, 15V, and 10V, respectively.

The preparatory voltage change process 7 has a function to slowly pull the meniscus 3 from the nozzle opening toward the pressure generation chamber 100. Accordingly, even if the initial meniscus has a convex configuration at t=0 microsecond, the meniscus 3 is pulled into the nozzle 101 by the preparatory voltage change process 7, which prevents adverse effect of the meniscus 3 of convex configuration. That is, at $t=t_0$ immediately before starting the first voltage change process 1, the meniscus 3 is in the vicinity of the opening plane of the nozzle 101 or slightly pulled into the nozzle 101. In the present embodiment, the drive waveform is such that the meniscus center position x at $t=t_0$ was confirmed to be within a range from +1 to −5 microseconds (see the meniscus position in the coordinate system shown in FIG. 27(*b*)).

Moreover, the voltage change time ($t_0$=30 microseconds) of the preparatory voltage change process 7 is set sufficiently longer than the natural period (14 microseconds in this embodiment) of the pressure wave and accordingly, at the point A in FIG. 3, no large pressure wave is generated to affect the ejection, and it is possible to obtain a stable pull-in of the meniscus.

The first voltage change process 1 has a function to rapidly pull the meniscus into the nozzle. Because the first voltage change process 1 has the voltage change time ($t_1$=2 microseconds) set smaller than the pressure wave natural period (14 microseconds in this embodiment), a large pressure wave is generated at point B in FIG. 3. By the function of this pressure wave, the meniscus 3 is rapidly pulled into the nozzle 101 to form a concave meniscus 3. In the drive waveform of the present embodiment, it was confirmed that at time $t=t_0+t_1+t_2$, the center portion x of the meniscus 3 is pulled to a position of −50 to −45 micrometers (see the coordinate system showing the meniscus position in FIG. 27(*b*)).

In the second voltage change process 2, the pressure generation chamber 100 is rapidly compressed. This forms a slender liquid column 4 as shown in FIG. 27(*c*) at the center portion of the concave meniscus 3. Immediately after this, the meniscus 3 is rapidly pulled back by the third voltage change process 5. Accordingly, the tip end of the liquid column 4 is separated and a very small ink droplet 106 as shown in FIG. 27(*d*) is ejected. In the present embodiment it was observed that the ink droplet 106 having a diameter of 19 micrometers was ejected at the speed of 6 m/s from the nozzle having the open diameter of 26 micrometers.

The fourth voltage change process 6 has a function to return the pressure generation chamber 100 to its initial volume. Here, the voltage change time ($t_7$=30 microseconds) is set sufficiently long in comparison to the pressure wave natural period (14 microseconds in this embodiment). Accordingly, no pressure wave is generated which affects the subsequent eject.

Figure 6A:
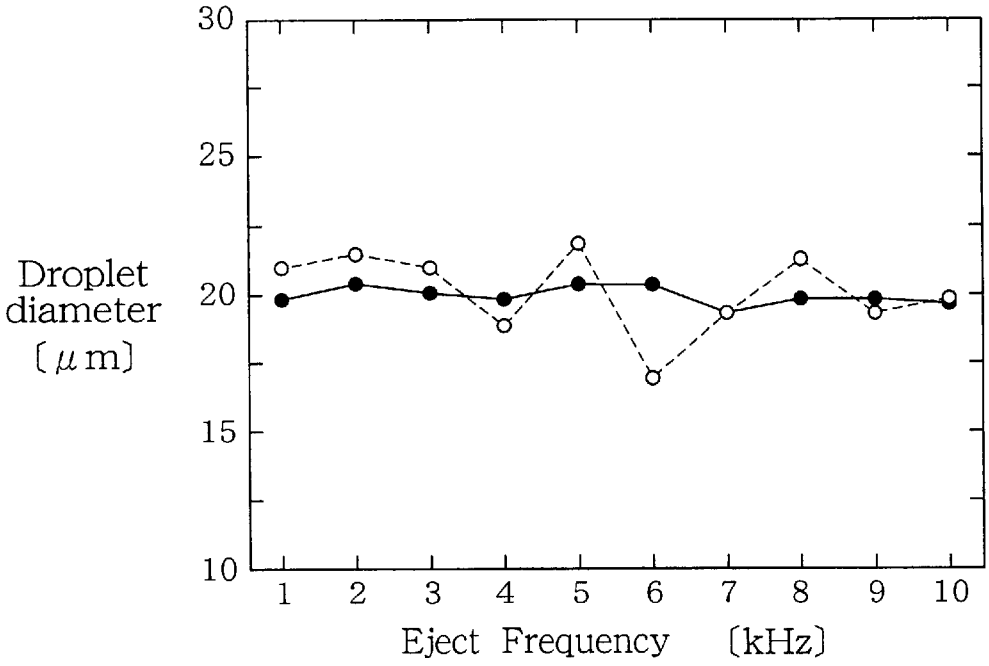
FIG. 6 shows the difference between the effects obtained by the waveform according to the first embodiment of the present invention and a conventional waveform.
Figure 6B:
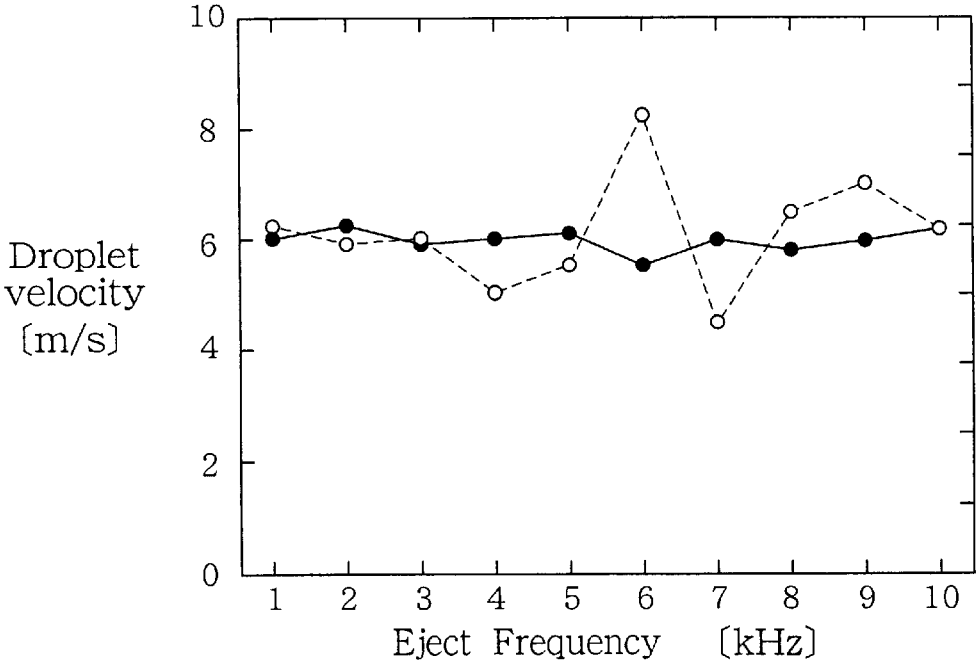
Figure 26A:
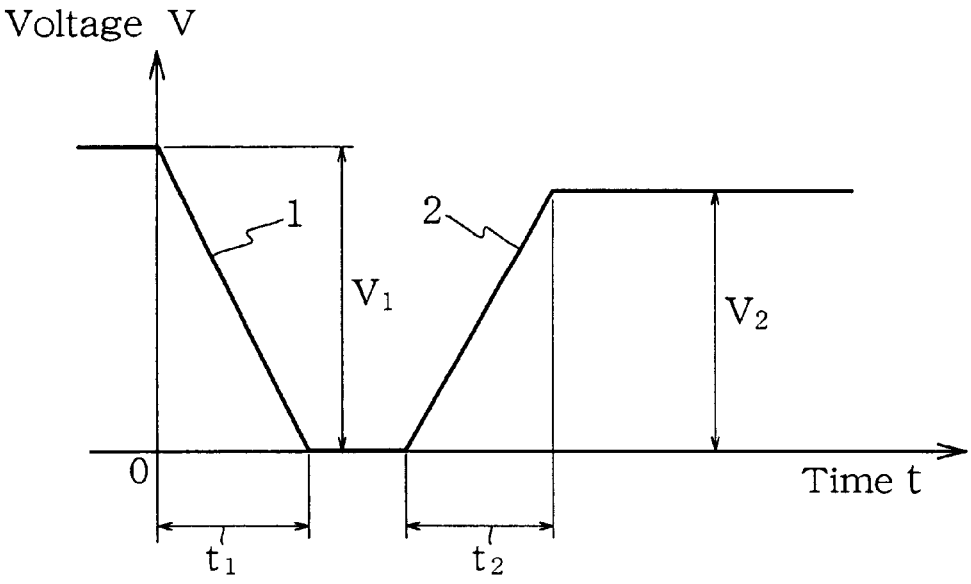
FIG. 26 shows examples of ink jet recording head drive waveforms.
Figure 26B:
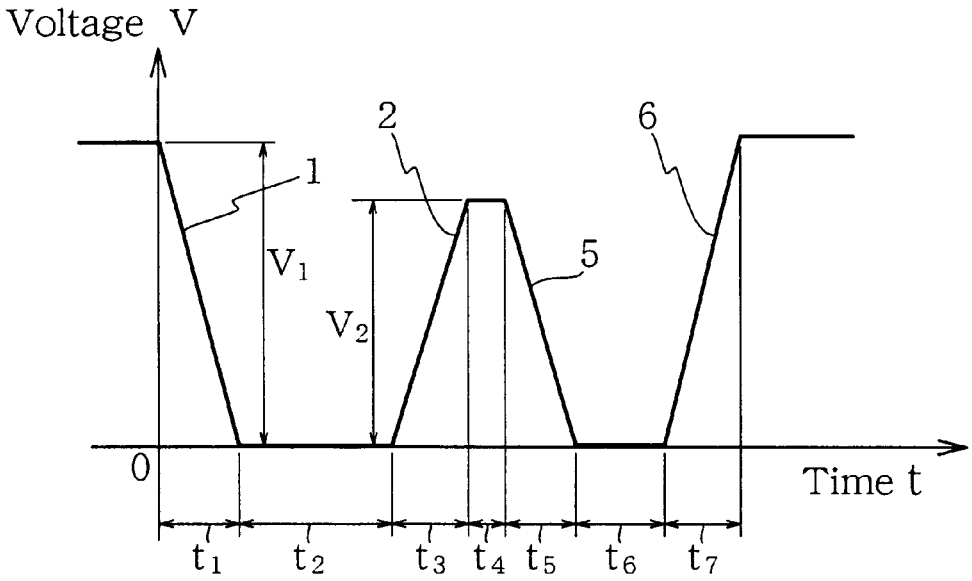
Figure 27A:
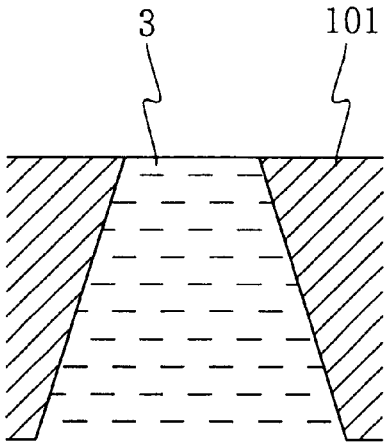
FIG. 27 schematically shows a meniscus movement when a drive waveform is applied.
Figure 27B:
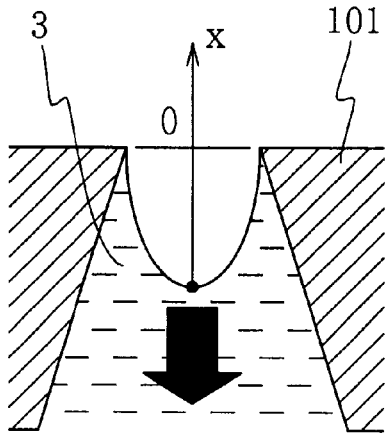
Figure 27C:
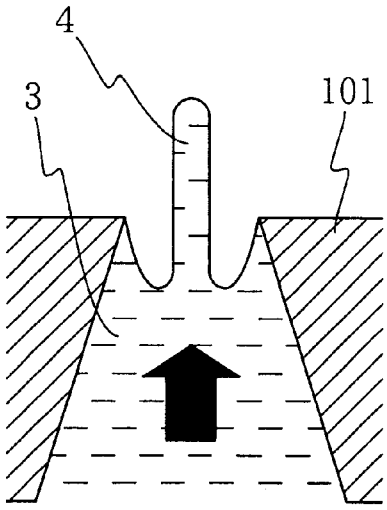
Figure 27D:
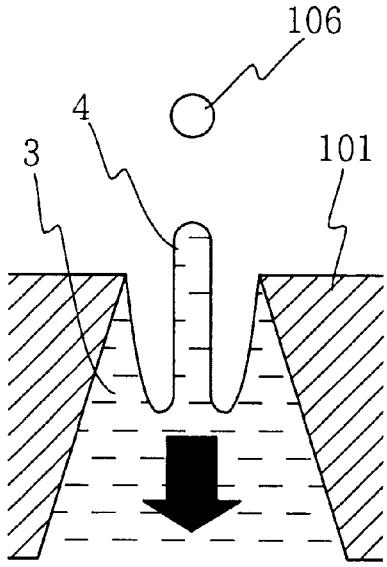
Figure 28A:
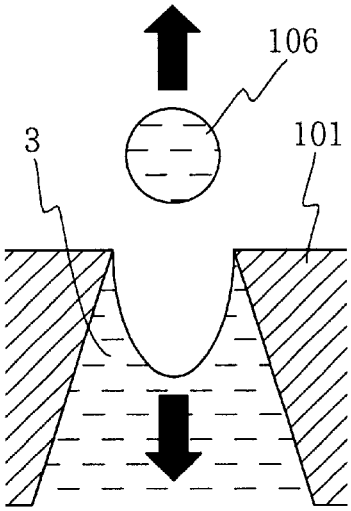
FIG. 28 shows a concept of a vibration phenomenon causing an unstable meniscus configuration.
Figure 28B:
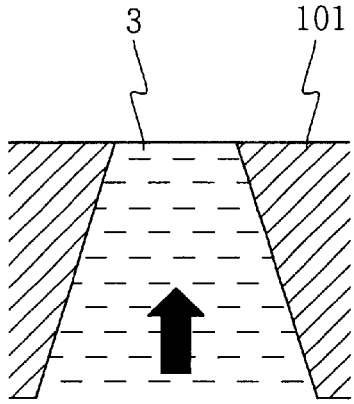
Figure 28C:
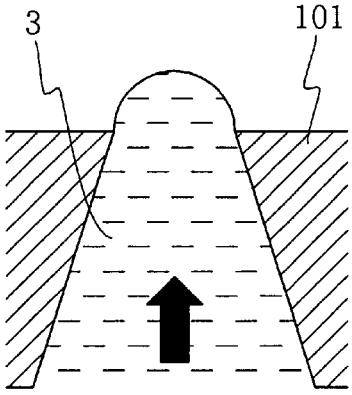
Figure 28D:
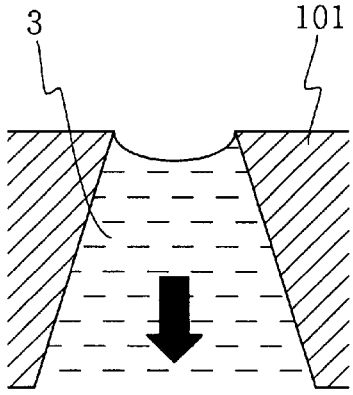
Figure 28E:
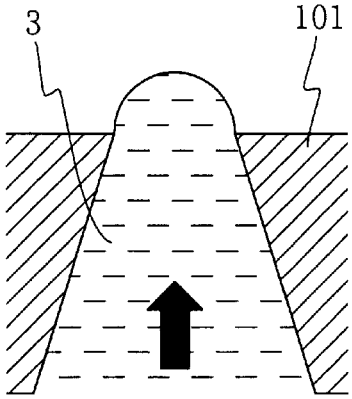
Figure 28F:
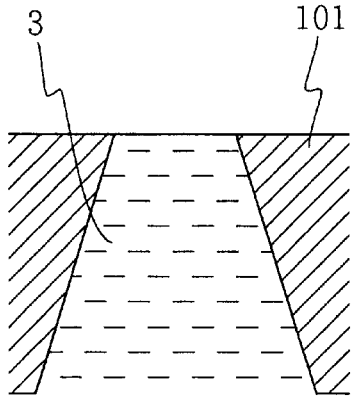
Figure 29A:
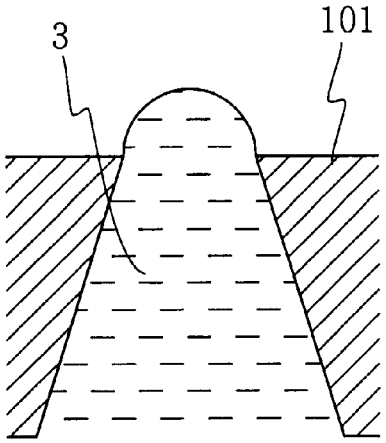
FIG. 29 shows a concept of an abnormal eject operation caused by an unstable meniscus configuration.
Figure 29B:
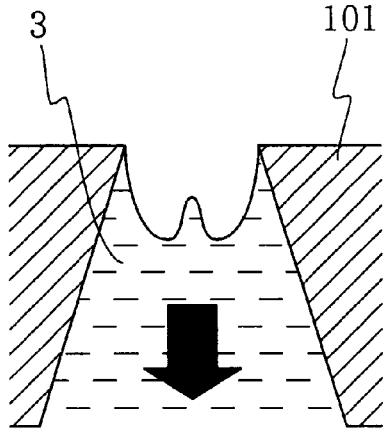
Figure 29C:
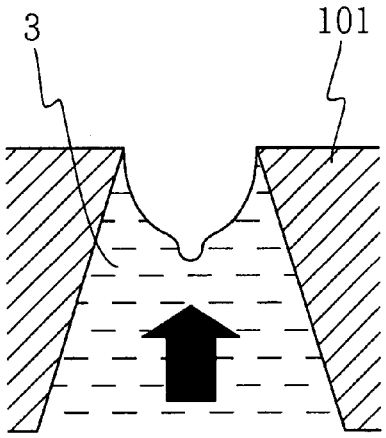
Figure 29D:
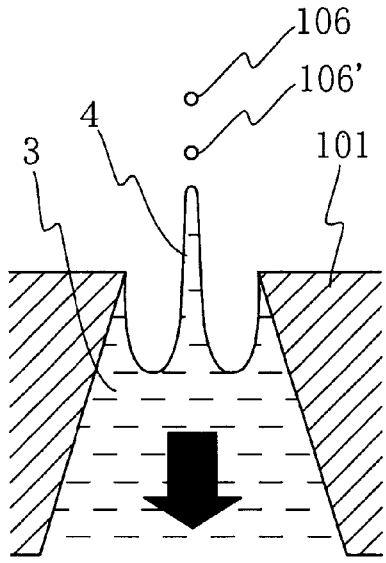

FIG. 6 shows an eject stability experimentally evaluated when the drive waveform of FIG. 3 is applied to the ink jet recording head of FIG. 2. FIG. 6(*a*) (solid line) shows a small droplet diameter measured while the ejection interval (ejection frequency) is changed when alternately discharging the small droplet of the 19 micrometer diameter by the drive waveform of the present invention and a large droplet of 40 micrometer diameter by a large droplet drive waveform (5 (*c*)) which will be detailed later. Moreover, FIG. 6(*b*) (solid line) shows the relationship between the eject interval (eject frequency) and the droplet speed. Broken lines in FIGS. 6(*a*) and (*b*) show observation results when a conventional waveform (FIG. 26(*b*)) was used without performing the preparatory voltage change process 7.

When the conventional waveform is used, as shown by the broken lines in FIG. 6(*a*) and FIG. (*b*), the droplet diameter and droplet speed greatly changes in the range of 4 to 6 kHz of the eject frequency (diameter irregularities ±3 micrometers; droplet speed irregularities 1.8 m/s). The reason of this is considered to be that in this eject frequency region, the initial meniscus 3 had a convex configuration and an abnormal eject phenomenon was caused as shown in FIG. 29 when discharging a small droplet. Observation of the meniscus 3 state using a laser Doppler meter showed that in the 4 to 6 kHz drive frequency range, the meniscus 3 made overshoot in the range of 8 to 15 microseconds immediately before discharging a small droplet.

On the other hand, when using the drive waveform of the present embodiment, it has been confirmed that in a wide frequency range from 0.1 to 10 kHz, the droplet diameter change is within ±0.5 micrometers as shown by the solid line in FIG. 6(*a*), and the droplet speed change is within ±0.3 micrometers as shown in FIG. 6(*b*). This is considered to be an effect obtained by the preparatory voltage change process 7 for pulling the meniscus 3 toward the pressure generation chamber 100, which prevents convex configuration of the initial meniscus at the start of the voltage application of the first voltage change process 1.

As has been described above, by using the drive method of the present embodiment, it is possible to obtain a stable ejection of very small droplets in a wide frequency range.

Figure 4:
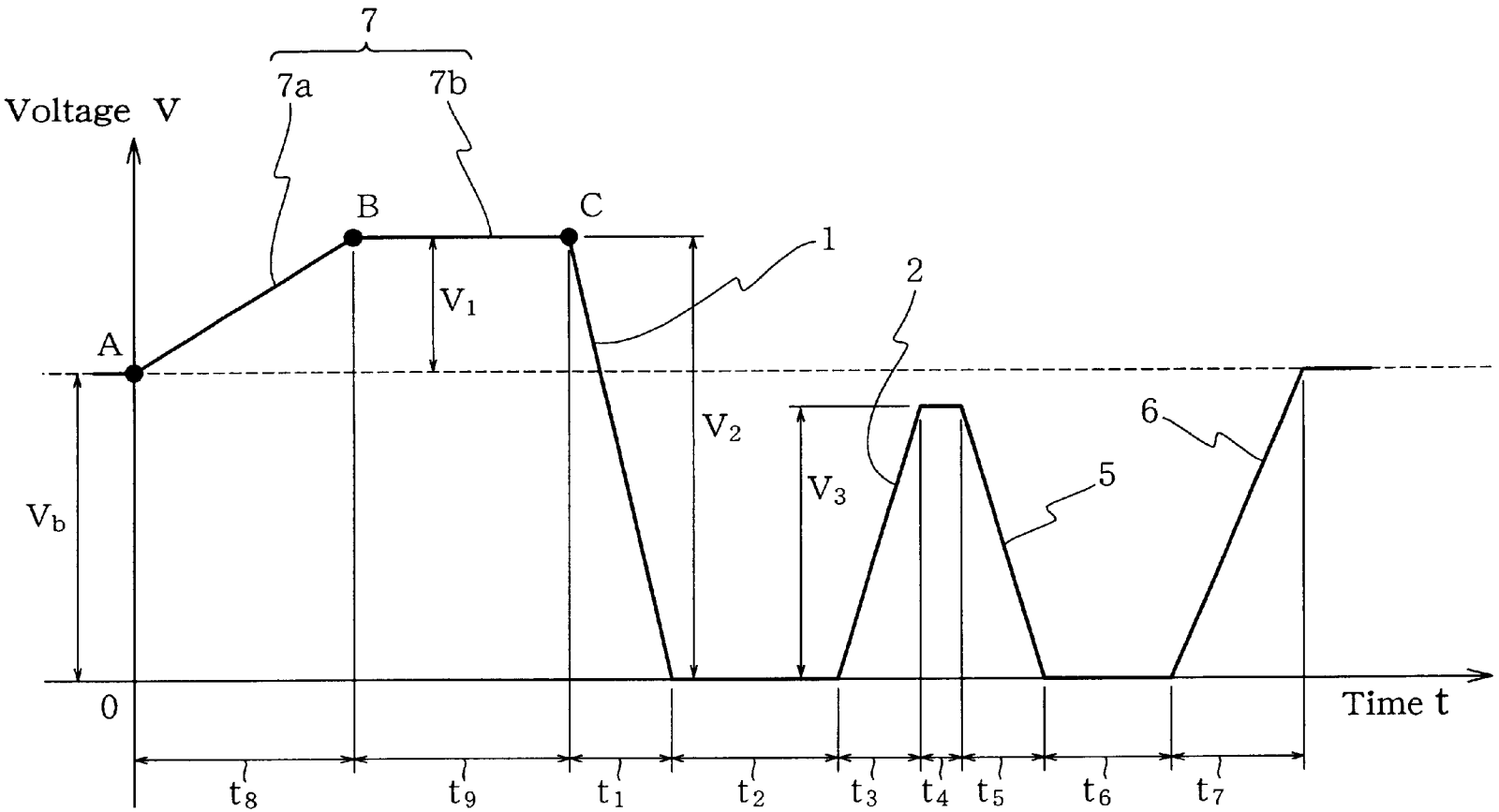
FIG. 4 shows another example of drive waveform used for discharging a very small droplet having a diameter in the order of 20 micrometers.

Moreover, FIG. 4 shows another example of a drive waveform used for discharging a very small droplet in the order of 20 micrometers.

This drive waveform has a preparatory voltage change process 7 consisting of a voltage change process 7*a* for slowly compressing (decreasing) the volume of the pressure generation chamber 100 for $t_8$=30 microseconds and a voltage maintaining process 7*b* for maintaining the voltage for a predetermined period of time $t_9$=50 microseconds. Furthermore, the drive waveform includes: a first voltage change process 1 for rapidly expanding the volume of the pressure generation chamber 100 for $t_1$=2 microseconds; a second voltage change process 2 for rapidly compressing the volume of the pressure generation chamber 100 for $t_3$=2 microseconds; a third voltage change process 5 for rapidly expanding the volume of the pressure generation chamber 100 for $t_5$=2 microseconds; and a fourth voltage change process 6 for slowly returning the application voltage to a reference voltage ($V_b$=15V) for $t_7$=30 microseconds. It should be noted that $t_2$, $t_4$, and $t_6$ were set to 4 microsecond, 0.3 microseconds, and 8 microseconds, respectively; and $V_1$, $V_2$, and $V_3$ were set to 5V, 15V, and 8V, respectively.

The voltage change process 7*a* constituting a part of the preparatory voltage change process 7 has a function to slowly push out the meniscus 3 from the nozzle. Accordingly, irrespective of the initial meniscus configuration, the meniscus 3 is temporarily forced to overshoot. Subsequently, during the voltage maintaining process 7*b*, the meniscus 3 is displaced toward the pressure generation chamber by the function of the surface tension. At point C ($t=t_8+t_9$), the meniscus 3 is positioned in the vicinity of the opening plane of the nozzle 101 or slightly pulled into the nozzle 101. That is, vibration of the meniscus 3 by the surface tension is forcibly excited and irrespective of the initial meniscus configuration, it is possible to prevent the convex configuration of the meniscus at the time (point C) when the first voltage change process 1 is applied. In the drive waveform of this embodiment, it was confirmed that at the time $t=t_8+t_9$, the center position x of the meniscus 3 was in the range of +2 to −4 micrometers (see the meniscus position in the coordinate system in FIG. 27(*b*)).

Moreover, the first half of the preparatory voltage change process 7, i.e., the voltage change process 7*a* has a voltage change time ($t_8$=30 microseconds) which is set sufficiently longer than the pressure wave natural period (14 microseconds in this embodiment) and accordingly, at points A and B in FIG. 4, no large pressure wave is generated which may affect the eject. Moreover, in order to obtain a meniscus position at time C in the vicinity of the nozzle opening plane or slightly pulled into the nozzle, it is preferable to set the voltage maintaining process 7*b* constituting the latter half of the preparatory voltage change process 7, so as to satisfy the condition: $(1/3)Tm \leqq t_9 \leqq (2/3)Tm$ (wherein Tm represents the natural period of the meniscus vibration caused by the ink surface tension).

The first voltage change process 1, the second voltage change process 2, the third voltage change process 5, and the fourth voltage change process 6 have the same functions as the first voltage change process 5, the third voltage change process 5, and the fourth voltage change process 6, in the first embodiment.

A eject experiment was performed using the drive waveform and it was observed that a droplet of 20 micrometer diameter was ejected from a nozzle of 26 micrometer opening diameter at a drop speed of 6.3 m/s. Moreover, in an experiment of discharging small droplets and large droplets also, it was possible to obtain an improved eject stability in comparison to the conventional waveform. It was confirmed that within the eject frequency 1 to 7 kHz, the diameter irregularities were within ±0.5 micrometers and the droplet speed irregularities were within ±0.3 m/s.

However, the drive waveform of the present embodiment requires the voltage maintaining process 7*a,* which increases the entire length of the waveform. This is a disadvantage for a high frequency eject. That is, the drive waveform of FIG. 4 has an entire length of 128.3 microseconds and it is impossible to eject at 7.8 kHz or more.

Thus, the drive waveform of FIG. 4 is not appropriate for a high frequency drive but enables to set a low reference voltage ($V_b$) and increase the droplet diameter modulation range when performing the droplet diameter modulation.

That is, in the aforementioned first embodiment of FIG. 3, the reference voltage $V_b$ should be set greater than the sum ($V_1$+$V_2$) of the voltage change amount $V_1$ required for the preparatory voltage change process 7 and the voltage change amount $V_2$ required for the first voltage change process 1. Accordingly, the $V_b$ is fairly at a high level. The diameter of a large droplet is roughly determined by the difference between the maximum allowable application voltage and the reference voltage. Accordingly, if the reference voltage is increased, the large droplet diameter is decreased and the droplet diameter modulation range is decreased. Conversely, in the drive waveform of FIG. 4, the reference voltage $V_b$=$V_2$−$V_1$. Accordingly, the reference voltage $V_b$ can be set smaller than the case of the drive waveform of FIG. 3. As a result the large droplet diameter can be increased (the difference between the maximum allowable application voltage and the reference voltage is increased), which enables to increase the droplet diameter modulation range.

Figure 5A:
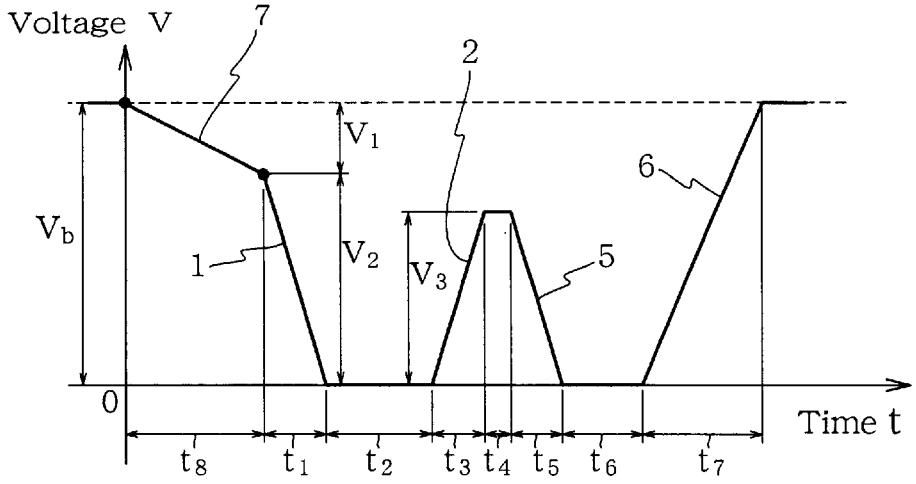
FIG. 5 shows drive waveforms used for discharging small, intermediate, and large droplets.
Figure 5B:
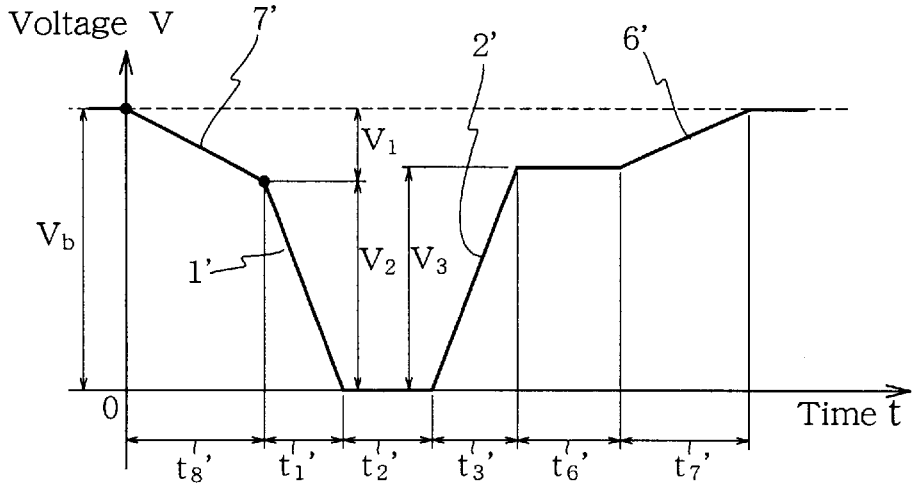
Figure 5C:
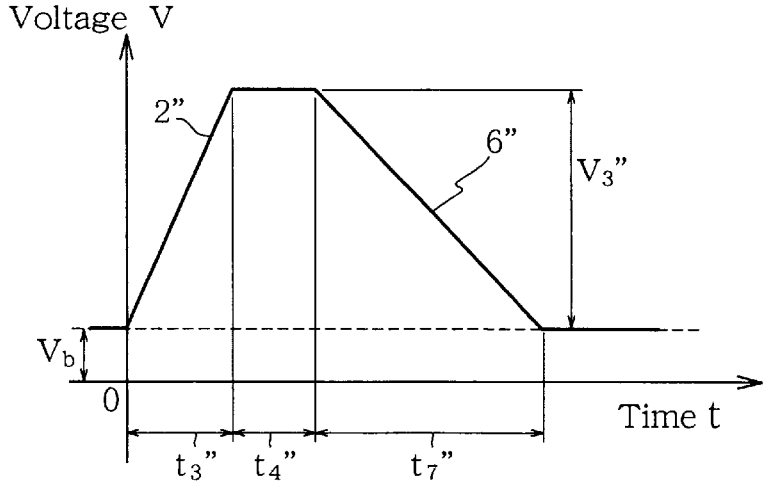

FIG. 5 shows drive waveform used for discharging small, intermediate, and large droplets according to still another embodiment of the present invention.

FIG. 5(*a*) shows a drive waveform for discharging a small droplet. This drive waveform is identical to the drive waveform shown in FIG. 3 for discharging a droplet of 19 micrometer diameter at speed of 6 m/s. The preparatory voltage change process 7 functions to reduce the droplet diameter fluctuation by the eject frequency within ±0.5 micrometers and the droplet speed fluctuation within ±0.6 m/s.

FIG. 5(*b*) is a drive waveform for discharging an intermediate droplet. In the case of the intermediate droplet drive waveform also, the control method for stabilizing the meniscus 3 is used for reducing the ink droplet size. For this, the preparatory voltage change process 7' is included. The drive waveform includes: the preparatory voltage change process 7' for slowing expanding the volume of the pressure generation chamber 100 for time $t_8$'=30 microseconds; a first voltage change process 1' for rapidly expanding the volume of the pressure generation chamber 100 for the time $t_1$'=2 microseconds; a second voltage change process 2' for rapidly compressing the volume of the pressure generation chamber for time $t_3$'=2 microseconds; and a voltage change 6' for slowly returning the application voltage to the reference voltage ($V_b$=20 V) for time $t_7$'=30 microseconds; ($t_2$'=4 microseconds, $t_6$'=8 microseconds, $V_1$'=5V, $V_2$'=15V, $V_3$'=18V)

A comparison with the small droplet drive waveform of FIG. 5(*a*) shows that, the second voltage change process 2' is not followed by expansion of the pressure generation chamber 100 (no third voltage change process is involved) and the ink eject amount is increased to increase the droplet diameter compared to the small droplet. With the drive waveform for the intermediate droplet diameter according to this embodiment, an ink droplet of 28 micrometers diameter was ejected at a speed of 6 m/s. The preparatory voltage change process 7', similarly as in the case of the small droplet drive waveform, has a function to slowly pull the meniscus from the nozzle opening toward the pressure generation chamber 100. Accordingly, even if the meniscus 3 has a large overshoot and a convex form as the initial state, the meniscus 3 is pulled into the nozzle by the preparatory voltage change process 7'. Thus, it is possible to prevent an adverse affect of the meniscus 3 of the convex configuration. In this embodiment, the meniscus position x upon completion of the preparatory voltage change process 7' (t=$t_8$') was confirmed to be within a range +1 to −5 micrometers (see the coordinate system in FIG. 27(*b*)). As a result, the droplet diameter fluctuation and the droplet speed fluctuation were very small. It was confirmed that in the eject frequency range from 0.1 to 10 kHz, the intermediate droplet had diameter fluctuation within ±0.5 micrometers and droplet speed fluctuation within ±0.6 m/s.

On the other hand, in the large droplet drive waveform shown in FIG. 5(*c*), no control is performed to stabilize the meniscus 3 having no control process corresponding to the preparatory voltage change process 7 or 7'. That is, the meniscus 3 is not pulled immediately before ejection. The drive waveform consists of a second voltage change process 2" for compressing the pressure generation chamber 100 for a large rise time ($t_3$"=10 microseconds) and a fourth voltage change process 6" for slowly returning the application voltage to the reference voltage $V_b$, ($V_3$"=20V, $t_7$"=30 microseconds). With the large droplet drive waveform according to the present embodiment, a droplet of 28 micrometers diameter was ejected at a droplet speed of 6 m/s. The diameter fluctuation and speed fluctuation by the eject frequency were within ∀0.9 micrometers and ∀0.5 m/s, respectively.

The drive waveforms for the small, intermediate, and large droplets as shown in FIG. 5(*a*), FIG. 5(*b*), and FIG. 5(*c*) were generated by the separate waveform generation circuits (107*a,* 107*b,* and 107*c*) as shown in FIG. 2, and a gradation recording was performed by switching between the waveforms to be applied to the piezoelectric actuator 105 according to an image data. The large, intermediate, and small droplets could be ejected with a sufficient stability with the drive frequency of 0.1 to 10 kHz. The droplet diameter fluctuations of the small and the intermediate droplets were within ±0.5 micrometers, and the speed fluctuations were within ±0.5 m/s.

It should be noted that the present invention for droplet diameter modulation is not to be limited to the combination of the drive waveforms shown in FIG. 5. For example, the large droplet drive waveform can also include the preparatory voltage change process for making the meniscus slightly convex immediately before eject. Moreover, in the intermediate droplet drive waveform of the present embodiment, the droplet diameter is increased than the small droplet by not expanding the pressure generation chamber 100 immediately after the second voltage change process 2'. However, the droplet diameter can also be increased by setting a large value for the voltage change time ($t_3$') of the second voltage change process, or by not using the meniscus stability control method (for example, not performing the preparatory voltage change process 7' in FIG. 5(*b*)).

Moreover, in the embodiment shown in FIG. 5, the droplet gradation is in three steps of large, intermediate, and small droplets. However, it is clear that the present invention can also be applied when the number of gradation steps more than three or less than three.

As has been described above, even when performing a gradation recording by droplet diameter modulation, it is possible to obtain a high stability of droplet diameter and droplet speed by including the preparatory voltage change process in the small and intermediate drive waveforms used for control process for stabilizing the meniscus. Thus, it is possible to improve the image quality.

The present invention is not to be limited to the configuration of the aforementioned three examples. For example, in the embodiments of FIG. 3, FIG. 4, and FIG. 5, a flat portion is present between the first voltage change process and the second voltage change process, but this flat portion can also be removed.

Moreover, in the aforementioned embodiments, the bias voltage (reference voltage) $V_b$ has been set so that a positive voltage is applied to the piezoelectric actuator. However, if there is no problem of applying a negative voltage to the piezoelectric actuator, the bias voltage $V_b$ may be set at another voltage such as 0V.

Furthermore, in the aforementioned embodiments the actuator used is a layered piezoelectric actuator of longitudinal vibration mode. However, it is also possible to use other types of actuator such as an actuator of horizontal vibration mode, a unitary plate type actuator, a piezoelectric actuator of flexible vibration mode.

Figure 25:
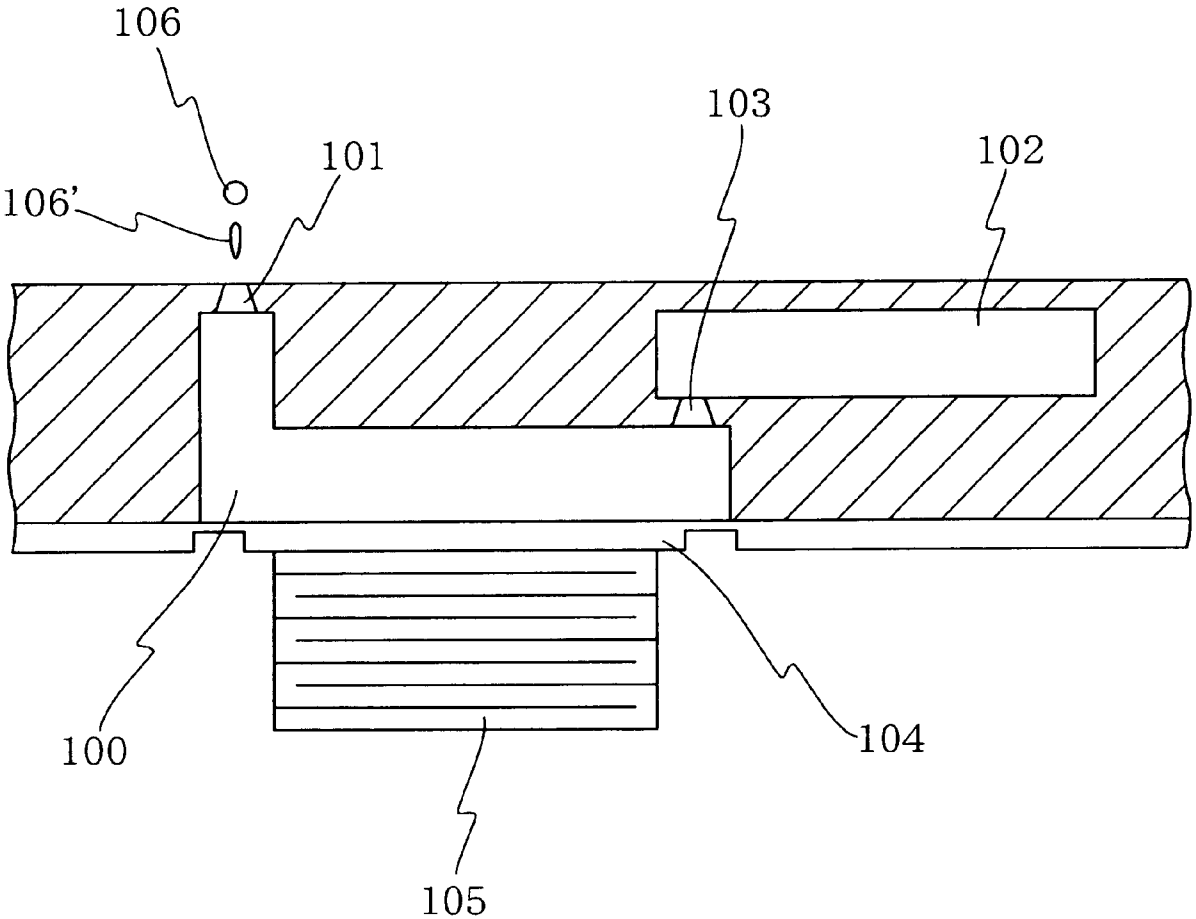
FIG. 25 is a cross sectional view of a basic configuration of an ink jet recording head used conventionally and in the present invention.

Moreover, the aforementioned embodiments used the Kyser type ink jet recording head as sown in FIG. 25. However, the present invention can also be applied to various types of ink jet recording head for discharging ink by controlling the pressure of a pressure generation chamber including a recording head using a groove provided in the piezoelectric actuator as a pressure generation chamber.

Furthermore, the present invention can be applied to an ink jet recording head using an actuator which utilizes an electro-mechanical converter other than the piezoelectric actuator such as an actuator utilizing electrostatic force and magnetic force.

As has been described above, in the ink jet recording head drive method of the present invention, prior to start of the first voltage change process conventionally required for an appropriate ink eject operation, in order to eliminate the meniscus initial configuration failure which affects the meniscus behavior in the first voltage change process and after, the meniscus is slowly pulled toward the pressure generation chamber to obtain an appropriate initial meniscus configuration, i.e., a flat or slightly concave configuration. This enables to eliminate various unstable factors which cannot be removed by the first voltage change process alone. For example, it is possible to prevent with a high probability the abnormal eject phenomenon accompanying the initial meniscus configuration failure as shown in FIG. 29(*a*). The present invention assures to obtain a high stability of the droplet diameter and droplet speed, and to prevent involving of air bubbles into the nozzle due to an abnormal eject.

According to the present invention, prior to the first voltage change process required for a stable ink eject operation, the preparatory voltage change process is performed, so as to obtain an optimal ink droplet (meniscus) state at the nozzle opening at the start of the first voltage change process. This can suppress abnormal eject such as an ink diameter fluctuation and a droplet speed fluctuation caused by an abnormal initial meniscus state. As a result, it is possible to greatly improve the output image quality.

Moreover, since the abnormal eject operation is suppressed, secondary abnormal operations due to the abnormal eject can also be reduced. For example, involving of air bubbles into the nozzle is reduced. This further improves the apparatus reliability and stability.

Moreover, even if the meniscus has a convex configuration after an eject completion, the configuration can be corrected before starting the next eject operation. Accordingly, there is almost no need of prolonging the ink droplet eject operation cycle for stabilizing the meniscus configuration. In comparison to the conventional method, it has become possible to realize an ink droplet eject with a higher frequency, facilitating the high speed printing of characters and images.

[Second Embodiments]

Hereinafter, a detailed explanation will be given on the ink jet recording head drive method and drive apparatus according to the present invention with reference to the attached drawings.

Figure 7A:
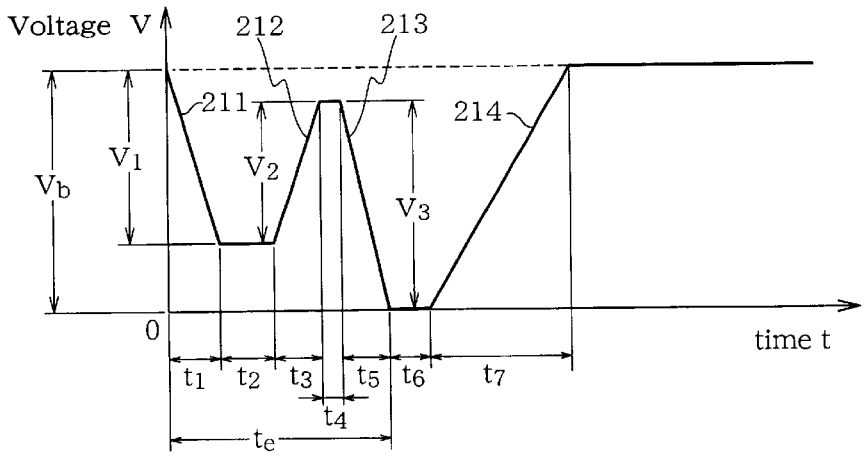
FIG. 7 shows a drive method according to a second embodiment of the present invention.
Figure 7B:
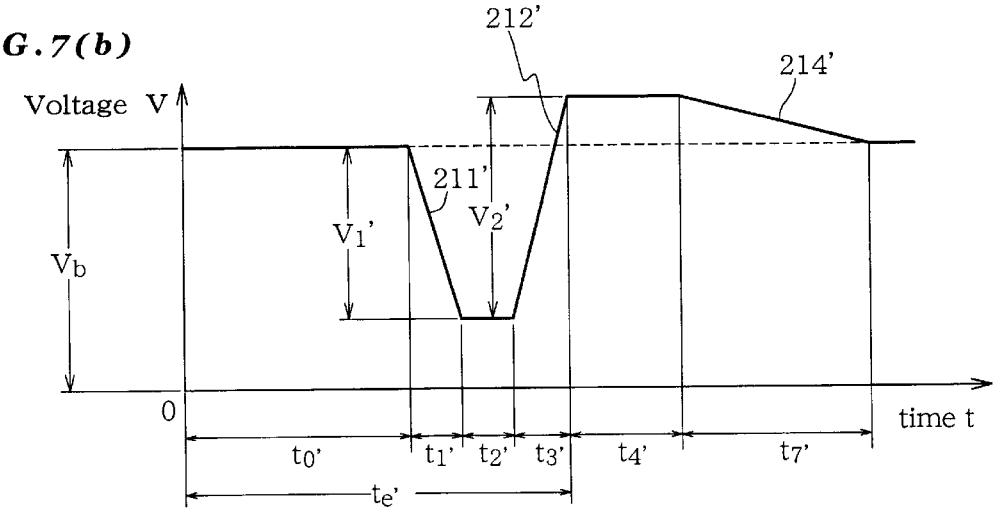
Figure 7C:
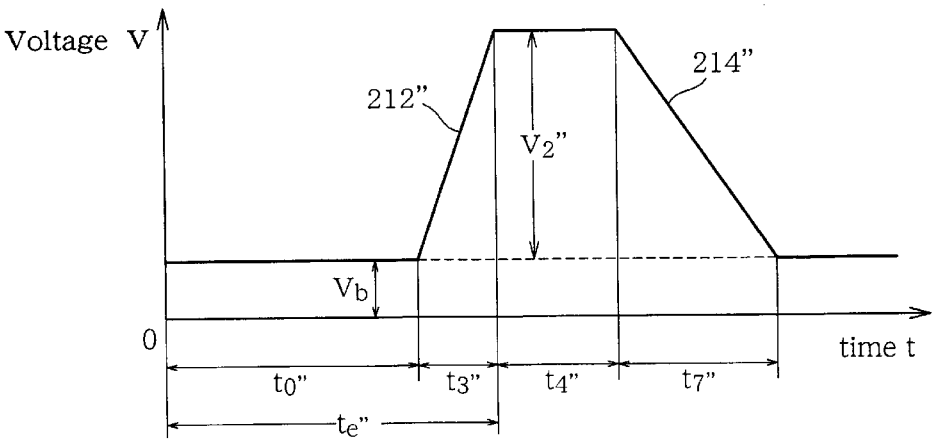

FIG. 7 is a graph showing drive voltage waveforms of the ink jet recording head drive method according to a second embodiment of the present invention. FIG. 7(*a*) shows a drive voltage waveform for discharging an ink droplet of a small diameter; FIG. 7(*b*) shows a drive voltage waveform for discharging an ink droplet of an intermediate diameter; and FIG. 7(*c*) shows a drive voltage waveform for discharging an ink droplet of a large diameter.

The recording method of the present invention is characterized in that different drive voltage waveforms are provided according to the diameter of the ink droplet to be ejected and the drive voltage waveforms are created so that ink droplets of different diameters are ejected at different ejection timings.

The recording method of the present invention is further characterized in that the ejection timing of an ink droplet of the smallest diameter is set earlier than the eject timings of the ink droplets of the other diameters.

As shown in the graph of FIG. 7(*a*), when discharging a small diameter ink droplet, voltage $V_1$ ($V_1$=15V) is applied to rapidly expand the volume of the pressure generation chamber for time $t_1$ ($t_1$=2 microseconds) and the expanded state is maintained for time $t_2$ ($t_2$=4 microseconds), after which voltage $V_2$ ($V_2$=10V) is applied to rapidly compress the volume for time $t_3$ ($t_3$=2 microseconds). The compressed state is maintained for $t_4$ ($t_4$=0.3 microseconds) and then voltage $V_3$ ($V_3$=15V) is applied for time $t_5$ ($t_5$=2 microseconds), so as to rapidly expand the volume of the pressure generation chamber 231. The expanded state is maintained for time $t_6$ ($t_6$=8 microseconds) and then the application voltage is slowly returned to the reference voltage $V_b$ ($V_b$=20V) taking time $t_7$ ($t_7$=30 microseconds).

During the voltage change portion 211 of time $t_1$ in the graph, a meniscus is rapidly pulled into the nozzle, leaving a concave meniscus. In this embodiment, during the time $t=t_1+t_2$, the center of the meniscus was pulled to a position of −50 to −45 micrometers.

During the voltage change portion 212 of time $t_3$, the pressure generation chamber is rapidly compressed and a slender liquid column is formed at the center of the concave meniscus.

During the voltage change portion 213 of time $t_6$, the meniscus is rapidly pulled in and the tip end of the liquid column is separated to be ejected as an ink droplet of a small diameter.

In the drive voltage waveform of this embodiment, the time from the voltage change (pressure change) to the start of ejection of the small ink droplet is $t_1+t_2$=6 microseconds, and the time $t_e$ (ejection timing) of completion of the voltage change concerning the eject is about 10.3 microseconds.

In this embodiment, with the drive voltage waveform of FIG. 7(*a*), an ink droplet having a diameter of about 20 micrometers was ejected at the speed of 6 m/s.

As shown in FIG. 7(*b*), when discharging an ink droplet of an intermediate diameter also, the ink droplet is ejected by meniscus control in the same way as the eject of a small diameter droplet.

In the drive voltage waveform shown in FIG. 7(*b*), voltage $V_1'$ ($V_1'$=15V) is applied and the volume of the pressure generation chamber is rapidly expanded for time $t_1'$ ($t_1'$=2 microseconds). This expanded state is maintained for time $t_{2v}'$ ($t_2'$=4 microseconds), after which voltage $V_2'$ ($V_2'$=20V) is applied and the volume of the pressure generation chamber is rapidly compressed for time $t_3'$ ($t_3$=2 microseconds).

After lapse of time $t_4'$ ($t_4'$=8 microseconds), the application voltage is slowly returned to the reference voltage $V_b$ ($V_b$=20V) taking time $t_7'$ ($t_7'$=30 microseconds).

In FIG. 7(*b*), the voltage change portions 211', 212', and 214' respectively correspond to the voltage change portions 211, 212, and 214 of FIG. 7(*a*) for discharging a small diameter ink droplet.

When compared to the drive voltage waveform (of FIG. 7(*a*)) for discharging a small ink droplet, the expansion of the pressure generation chamber immediately after the voltage change portion 212' is not so rapid as in generating a small diameter ink droplet and accordingly, more ink is ejected to form an ink droplet of a greater diameter.

With the drive voltage waveform for the intermediate ink droplet according to the present embodiment, an ink droplet of 30 micrometer diameter was ejected at a droplet speed of 6 m/s (in the case of a single nozzle eject).

It should be noted that in the drive voltage waveform for the intermediate diameter ink droplet in this embodiment, the time $t_0'$ before the eject start is set to about 11 microseconds. Accordingly, the voltage change (pressure change) for discharging the intermediate ink droplet starts after completion of the small diameter ink droplet eject ($t_0'>t_e$)

Accordingly, even if a pressure generation chamber 231 for discharging a small ink droplet is surrounded by pressure generation chambers 231 for discharging an intermediate ink droplet, this does not lower the small ink droplet eject speed due to a structural cross talk or generate a eject failure. Thus, it is possible to obtain a high eject stability of the small diameter ink droplet.

As shown in FIG. 7(*c*), in the drive voltage waveform for discharging an ink droplet of large diameter, voltage $V_2''$ ($V_2''$=22V) is applied with a greater rise time ($t_3''$=10 microseconds) than in the case of the small and the intermediate ink droplets, and this state is maintained for time $t_4$ ($t_4$=15 microseconds), after which the application voltage is slowly returned to the reference voltage $V_b$ ($V_b$=20V) taking time $7_t''$ ($t_7''$=30 microseconds).

With the drive voltage waveform of FIG. 7(*c*), an ink droplet of 40 micrometer diameter was ejected at a droplet speed of 7 m/s (in the case of a single nozzle).

In the drive voltage waveform for the large diameter ink droplet, $t_2''$=11 microseconds and accordingly, the voltage change (pressure change) starts after completion of eject of a small diameter ink droplet. Even if the pressure generation chamber 231 for discharging the small diameter ink droplet is surrounded by pressure generation chambers 231 for discharging a large diameter ink droplet, there is no danger of lowering the ink droplet speed due to a structural cross talk or generation of eject failure.

Next, explanation will be given on the drive apparatus configuration for applying the drive voltage waveforms to the piezoelectric actuator according to the ink droplet diameter, with reference to FIG. 8.

The drive voltage waveforms for the small ink droplet, intermediate ink droplet, and large ink droplet are generated by the waveform generation circuits 241A, 241B, and 241C, respectively. The drive voltage waveforms generated by the waveform generation circuits 241A, 241B, and 241C are identical to the drive voltage waveforms shown in FIGS. 7(*a*), 7(*b*), and 7(*c*).

The drive voltage waveforms generated in the respective waveform generation circuits 241A, 241B, and 241C are amplified by the amplification circuits 242 and transmitted to the lines 244A, 244B, and 244C, respectively.

Between each of the piezoelectric actuators 236 and the lines 244A, 244B, and 244C, there is provided a switching circuit 243 for switching connections between the lines 244A, 244B, and 244C and the piezoelectric actuator 236. According to an image data, the switching circuit 243 switches between the lines 244A, 244B, and 244C, so that the drive voltage waveforms to be applied to the piezoelectric actuator 236 are switched, thus switching between the ink droplet diameters of the ink droplet ejected from the nozzle. Thus, gradation recording is performed.

Figure 8:
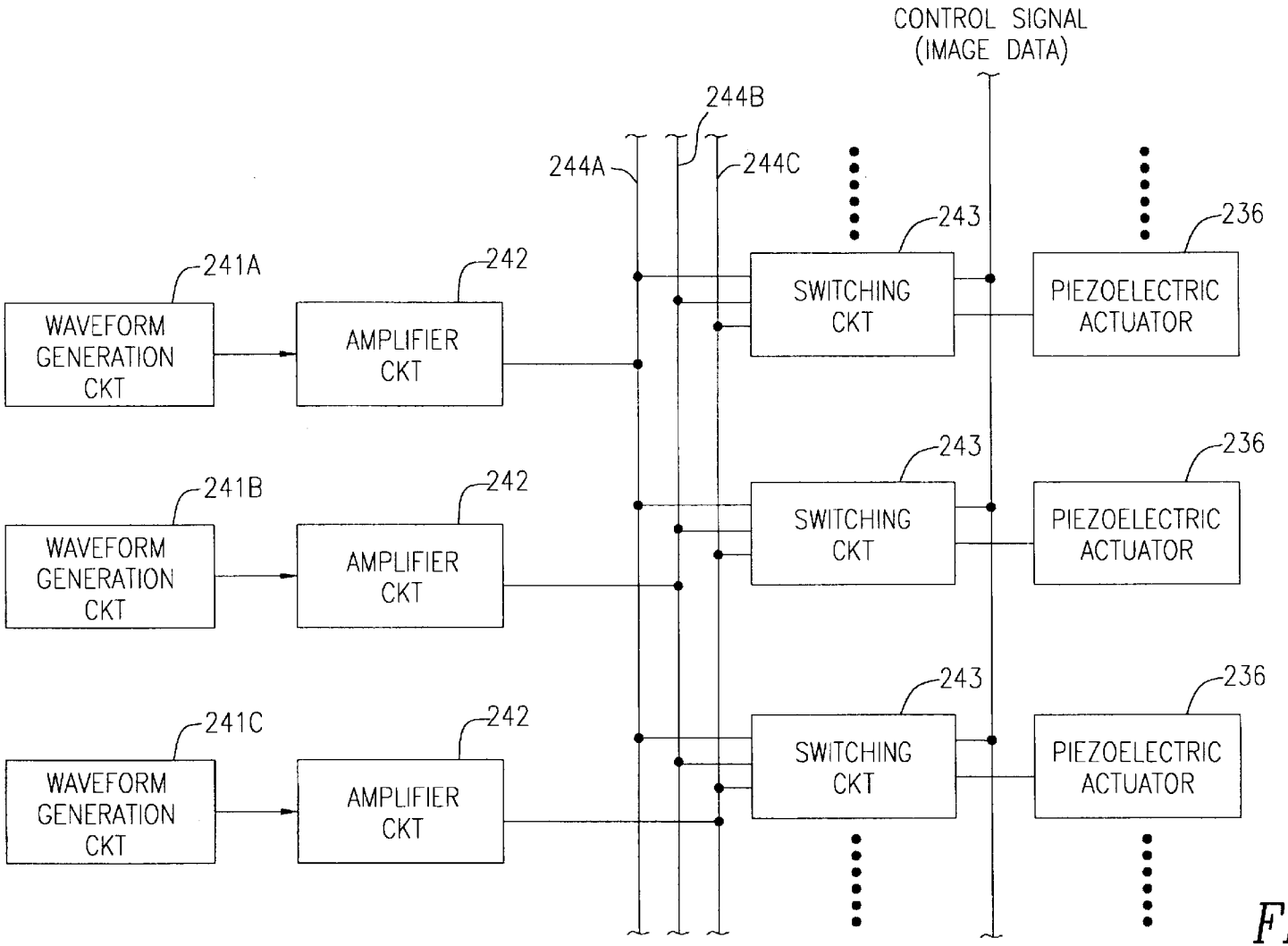
FIG. 8 is a block diagram showing a drive circuit of an ink jet recording head according to second embodiment of the present invention.
Figure 9A:
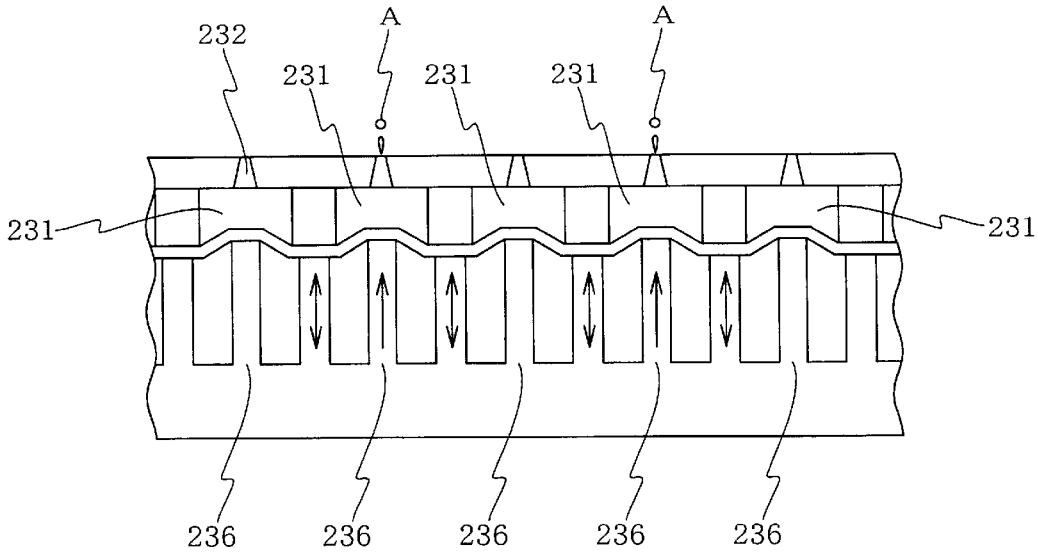
FIGS. 9(*a*)–(*b*) explain a function of the drive apparatus of FIG. 8 and shows a small diameter, intermediate diameter, and large diameter ink droplet ejected from nozzle.
Figure 9B:
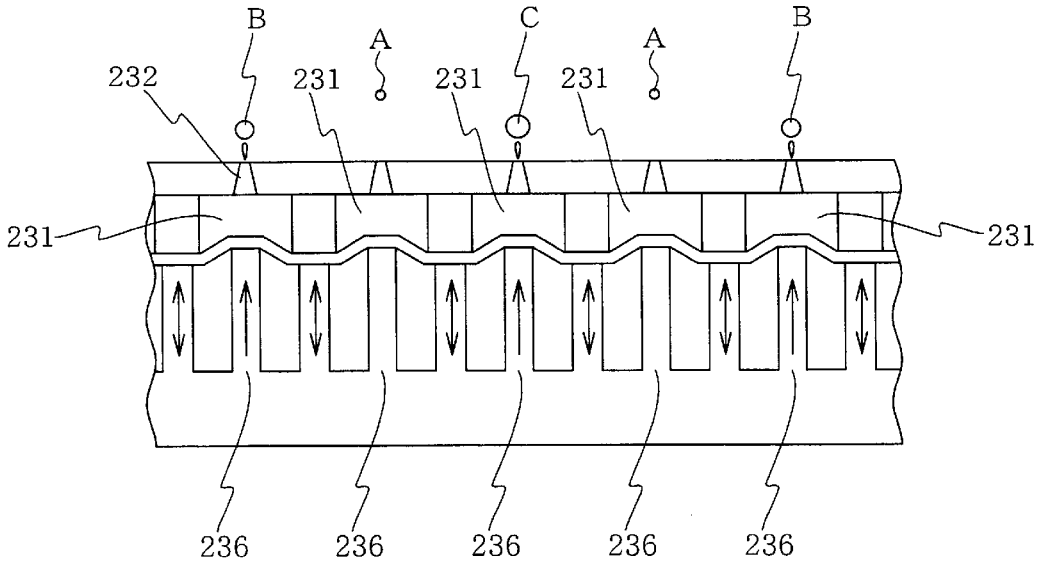

FIG. 9 explains function of the drive apparatus of FIG. 8. This is a side view of a state when the ink droplets A, B, and C of small, intermediate, and large diameter are ejected from the nozzle 232.

When a small diameter ink droplet is ejected (state of FIG. 9(*a*)) according to a drive voltage waveform generated by the waveform generation circuit 241A, the piezoelectric actuator 236 is driven according to the drive voltage waveform generated by the waveform generation circuits 241B and 241C, and an intermediate diameter droplet B and a large diameter droplet C are simultaneously ejected from the nozzle 232 (FIG. 9(*b*)).

In this embodiment, it is possible to obtain a stable ejection of the small diameter ink droplet A, the intermediate diameter ink droplet B, and the large diameter ink droplet C with a drive frequency from 0.1 to 10 kHz. Moreover, it has been confirmed that no droplet speed fluctuation or ejection failure is caused which may affect the recorded image quality even if the number of piezoelectric actuators 236 simultaneously driven or the eject pattern is changed.

Figure 33A:
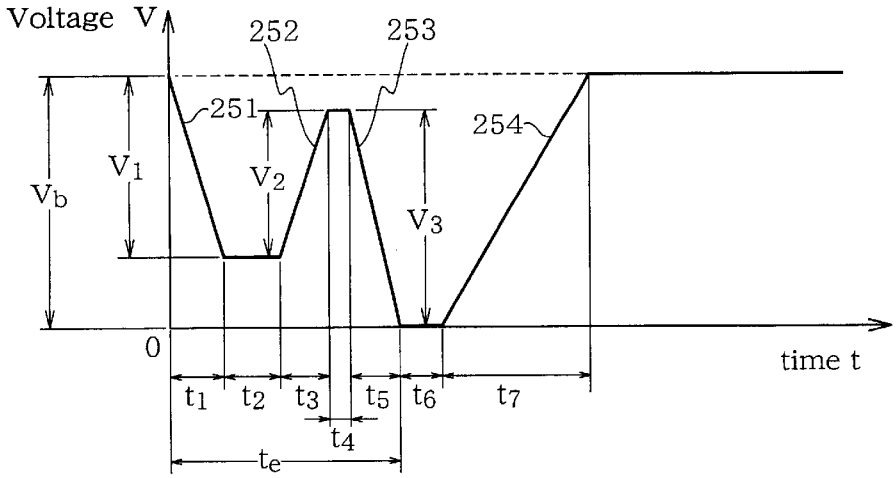
FIG. 33 shows drive voltage waveforms for generating a small, intermediate, and large diameter ink droplets.
Figure 33B:
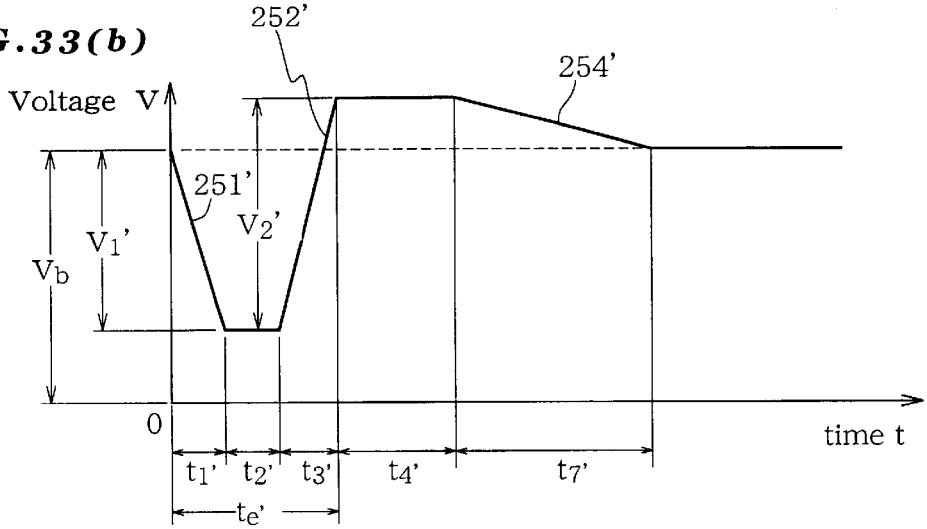
Figure 33C:
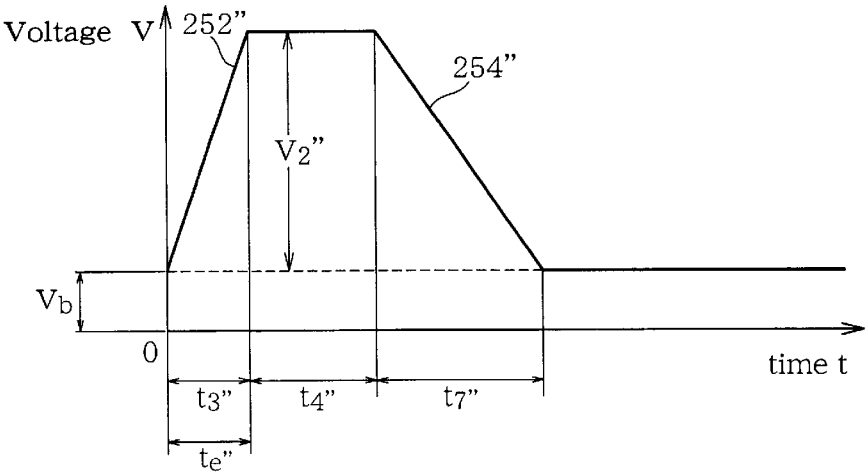
Figure 34:
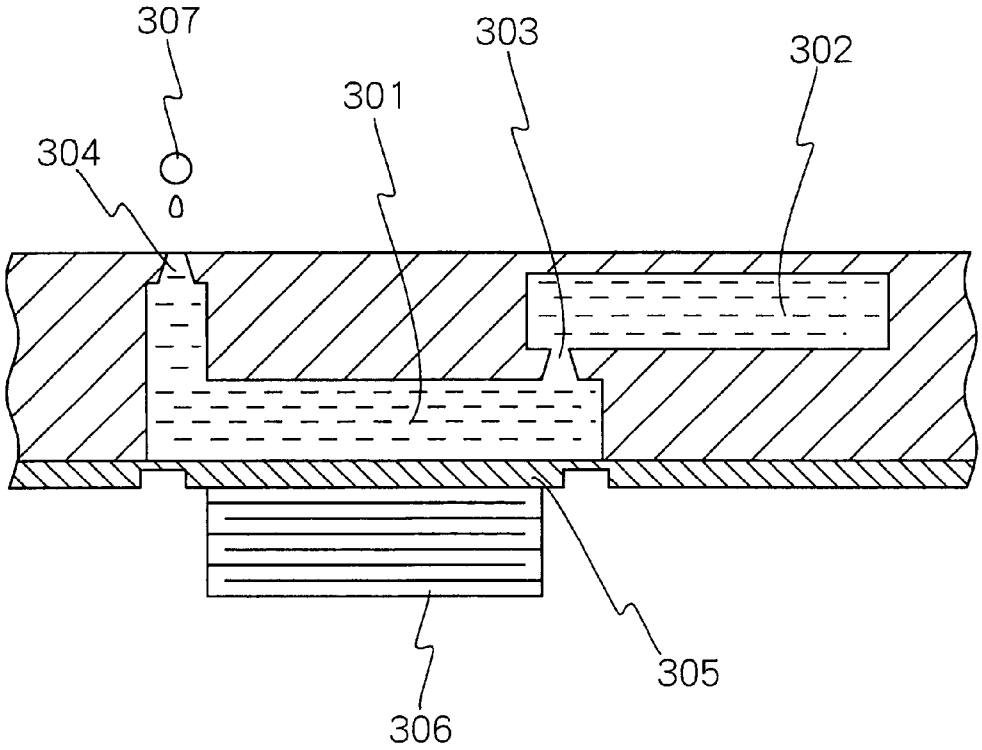
FIG. 34 schematically shows a basic configuration of a Kyser type ink jet recording head which is a drop-on-demand type ink jet recording head for explaining the conventional technique.
Figure 35:
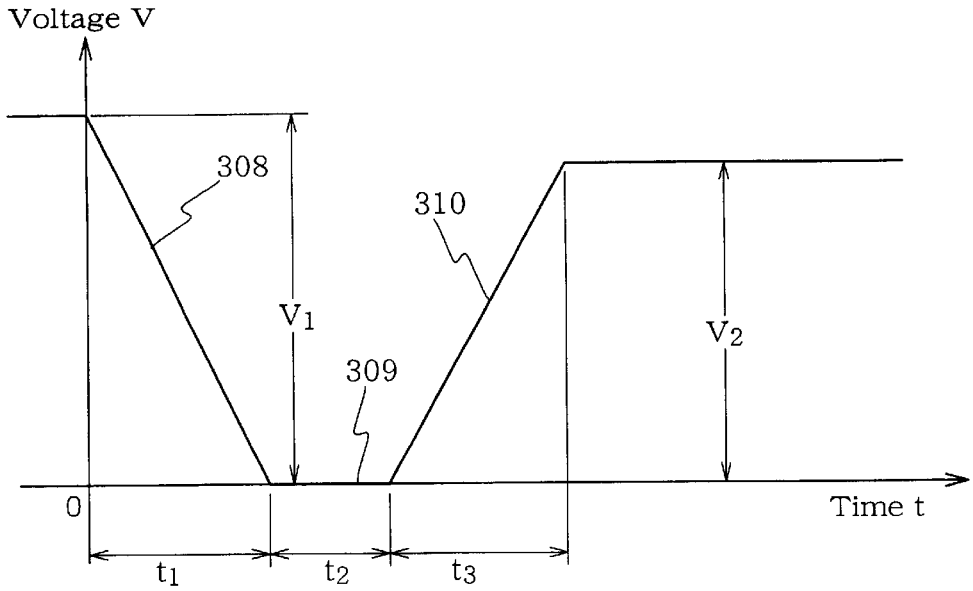
FIG. 35 shows an example of waveform profile of a drive waveform signal used in the conventional ink jet recording head.
Figure 36A:
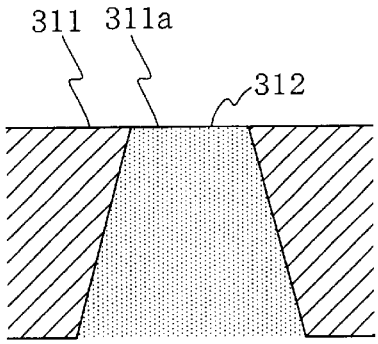
FIGS. 36(*a*)–(*d*) show a cross sectional view of nozzle opening for explaining an ink eject process in the conventional ink jet recording head drive method.
Figure 36B:
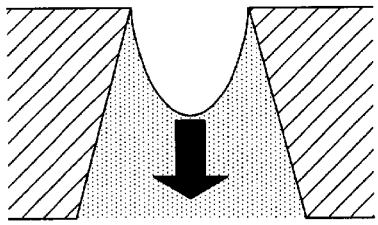
Figure 36C:
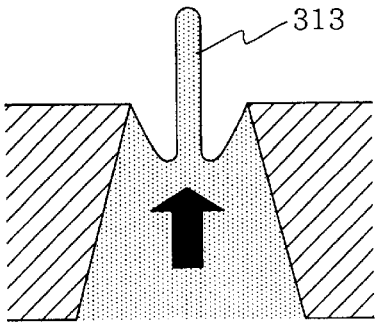
Figure 36D:
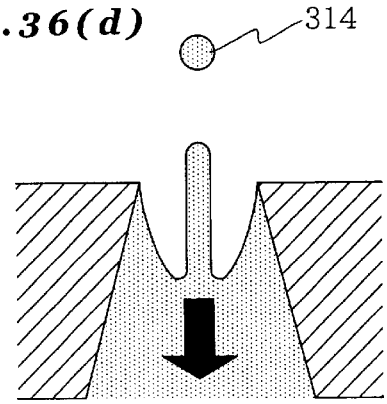
Figure 37:
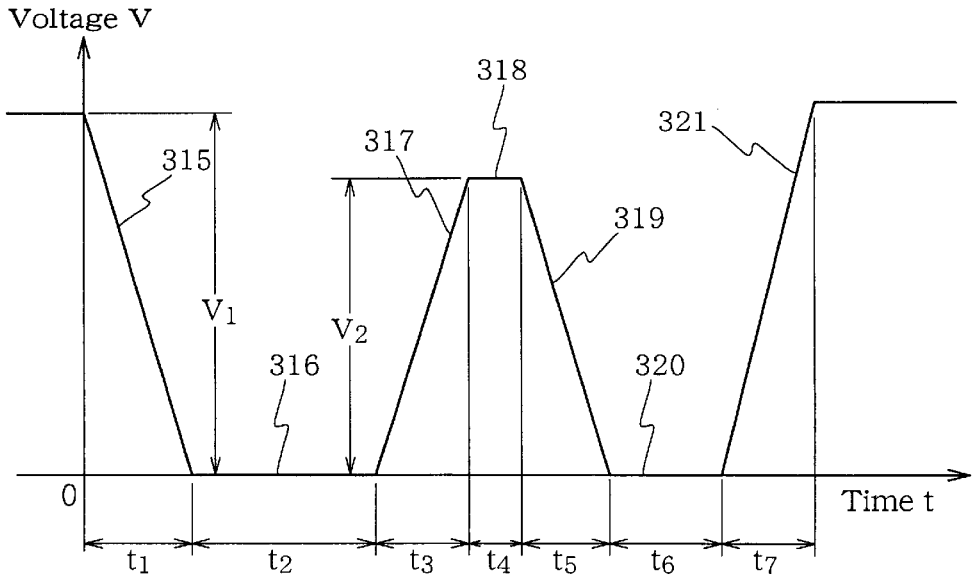
FIG. 37 shows another example of waveform profile of a drive waveform signal used in the conventional ink jet recording head.

On the other hand, a recording experiment was performed using the conventional waveform of FIG. 33 (time and parameters are identical as the waveform of FIG. 7) in the ink jet recording apparatus used in this embodiment. The ejection state of the small diameter ink droplet A was clearly deteriorated. Especially for an image pattern where the small diameter ink droplet A, intermediate diameter ink droplet B, and large diameter ink droplet C are mixed, the small ink droplet A dropped at a position greatly shifted and ejection failure of the small ink droplet A occurred.

This is because, in the conventional drive voltage waveform shown in FIG. 33, the voltage change (pressure change) for discharging the intermediate and the large diameter droplets occurs within the time (time range $\leqq t \leqq t_e$) before the small ink droplet A is ejected, and the structural cross talk greatly affects the ejection.

It should be noted that the ejection timing of the intermediate and the large diameter ink droplets shown in FIGS. 7(*b*) and (*c*) is only shifted by about 11 microseconds compared to the conventional drive voltage waveform (FIG. 30) and there is almost no affect to the ink droplet eject frequency. More specifically, it is possible to obtain a stable ejection even with the same drive frequency as the limit eject frequency (15 kHz) of the conventional drive voltage waveform.

As has been described above, by using the drive method and drive apparatus of the present invention, it is possible to eliminate unstable ejection of the small ink droplet ejected due to the structural cross talk without reducing the eject frequency. Thus, it is possible to obtain a high quality image at a high speed.

It should be noted that the drive voltage waveform for droplet diameter modulation using the present invention is not to be limited to the drive voltage waveform shown in this embodiment.

For example, the drive voltage waveform for the large diameter ink droplet may include a voltage change process for making the meniscus slightly concave immediately before ejection.

Moreover, in the drive voltage waveform for the intermediate ink droplet, the droplet diameter is made larger than the small diameter ink droplet without expanding the pressure generation chamber 231 immediately after the voltage change portion 212'. However, it is also to increase the droplet diameter by setting the voltage change time ($t_1$') to a greater value. Moreover, it is also possible to increase the droplet diameter without using the meniscus control.

Moreover, in the present embodiment, explanation has been given for the three-step droplet diameter gradation of large, intermediate, and small droplets. However, the gradation steps may be set to two or four or more than four.

Furthermore, the drive voltage waveform is set for discharging the small diameter ink droplet prior to the intermediate diameter ink droplet and the large diameter ink droplet. However, for the purpose of the present invention, it is also possible that the ejection timing of the small diameter ink droplet is set after eject of the intermediate diameter ink droplet and the large diameter ink droplet. It should be noted that the small diameter ink droplet is easily affected by the air resistance and delayed to reach a recording medium. Accordingly, it is preferable that the small diameter ink droplet ejection be performed prior to the ejection of the intermediate and the large diameter ink droplet.

Moreover, in the present embodiment, the drive voltage waveform is set so that the small diameter ink droplet is not affected by the structural cross talk. However, it is also possible to set the small diameter ink droplet and the intermediate diameter ink droplet at the same ejection timing, and shift only the ejection timing of the large diameter ink droplet which easily causes structural cross talk.

[Third Embodiment]

Figure 10A:
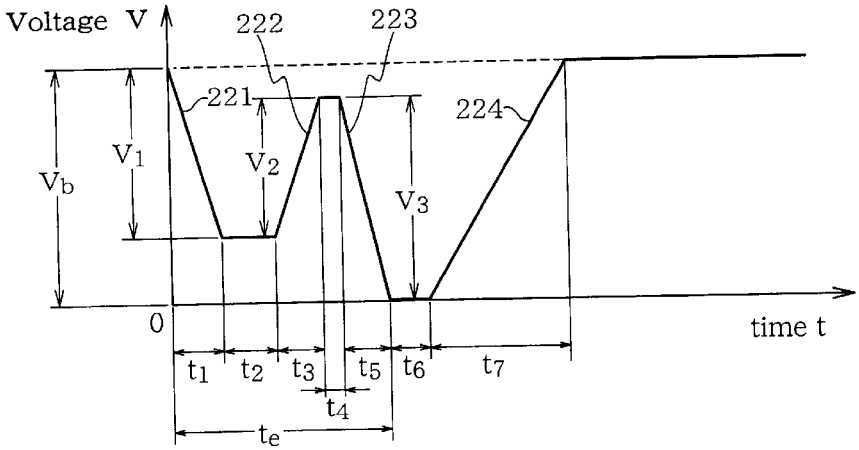
FIG. 10 shows a drive method according to a third embodiment of the present invention.
Figure 10B:
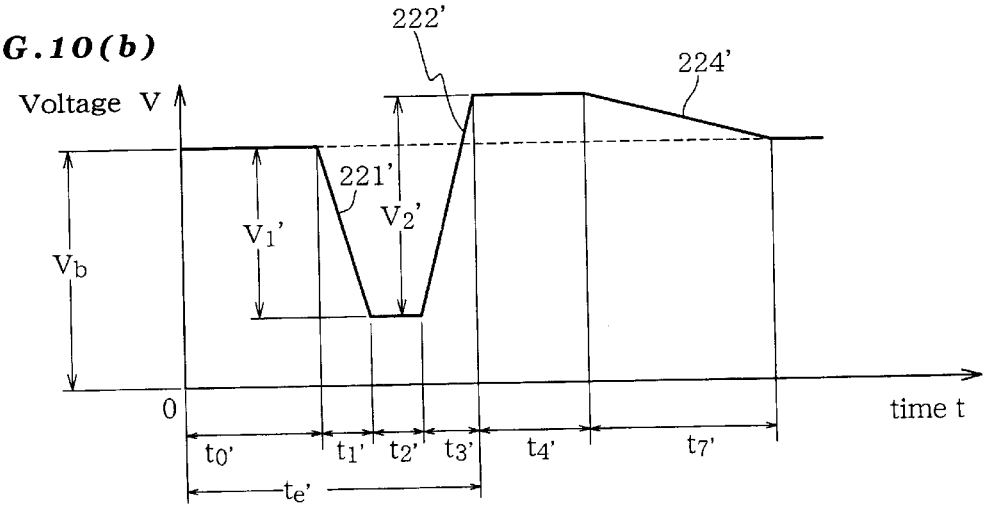
Figure 10C:
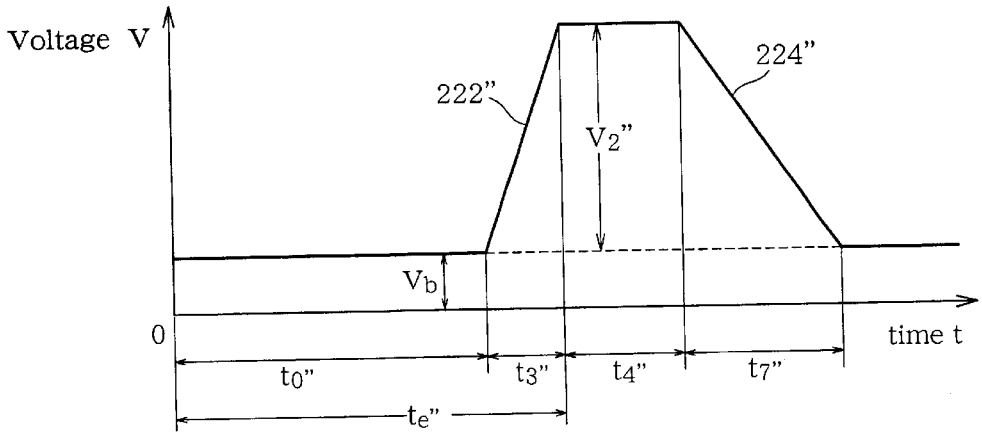

FIGS. 10(*a*)–(*c*) show drive voltage waveforms of the drive method according to the third embodiment of the present invention. FIG. 10(*a*) is for discharging a small diameter ink droplet; FIG. 10(*b*) is for discharging an intermediate diameter ink droplet; and FIG. 10(*c*) is for discharging a large diameter ink droplet.

It should be noted that in this third embodiment, the small diameter ink droplet is set to about 20 micrometers; the intermediate diameter ink droplet is set to about 30 micrometers; and the large diameter ink droplet is set to about 40 micrometers.

When the ejection timing is shifted according to the droplet diameter as in this embodiment, it is possible to reduce the maximum instantaneous current required for drive of the piezoelectric actuator, which in turn reduces the drive circuit system cost.

The drive voltage waveform of the present embodiment is characterized in that the small diameter ink droplet, the intermediate diameter ink droplet, and the large diameter ink droplet are ejected at different timings.

The drive voltage waveforms for the small diameter ink droplet, the intermediate diameter ink droplet, and the large diameter ink droplet have configurations and functions basically identical to the ones shown in FIG. 7. However, in the graphs of FIG. 10, unlike the second embodiment (graph of FIG. 7), the drive voltage waveform (graph (b)) for the intermediate diameter ink droplet has a voltage change start time ($t_0$') set to 5 microseconds, and the drive voltage waveform (graph (c)) for the large diameter ink droplet has a voltage change start time ($t_0$") set to 13 microseconds.

In the present embodiment, because the drive voltage waveform for the intermediate diameter ink droplet is set to $t_0$'=5 microseconds, the compression timing of the pressure generation chamber 231 by the voltage change portion 222' is after completion of the voltage application (voltage change portions 211 to 213) for discharging the small diameter ink droplet. Consequently, even if the pressure generation chamber discharging the small diameter ink droplet is surrounded by pressure generation chambers for discharging the intermediate diameter ink droplets, there is no danger of the structural cross talk causing ink droplet speed lowering or eject failure. Thus, it is possible to obtain a high stability of the small diameter ink droplet ejection.

It should be noted that in the drive voltage waveform of the present embodiment, the meniscus control process (voltage change portion 221') of the intermediate diameter ink droplet is performed during ejection of the small diameter ink droplet. Accordingly, the small diameter ink droplet ejection is slightly subjected to the structural cross talk. However, because the voltage change portion 221' displaces the piezoelectric actuator in the direction of expanding the pressure generation chamber, the structural cross talk functions to increase the small diameter ink droplet speed. Consequently, it is possible to suppress the affect to the image quality compared to the droplet speed lowering and ejection failure of the small diameter ink droplet.

In the drive voltage waveform for the large diameter ink droplet, $t_0$,"=13 microseconds. Accordingly, the voltage change is started after completion of the voltage change (voltage change portions 221 to 223, and voltage change portions 221' to 222') for discharging the small diameter ink droplet and the intermediate diameter ink droplet.

Figure 11:
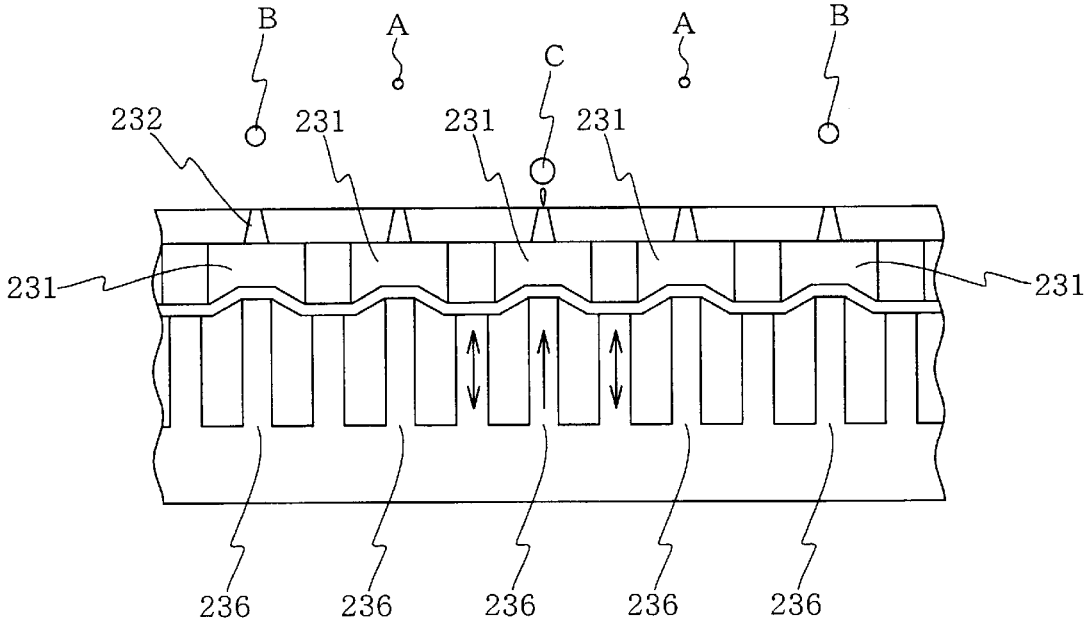
FIG. 11 is a side view of a recording head showing ink droplet ejected from nozzles.

FIG. 11 is a side view of a recording, head showing ink droplets ejected from the nozzle 232. As shown in FIG. 11, the ink droplets A, B, C are ejected in the order of the small, intermediate, and large diameter ink droplets.

Accordingly, even if the pressure generation chambers 231 for discharging the small diameter ink droplet A and the intermediate diameter ink droplet B are surrounded by pressure generation chambers 231 for discharging the large diameter ink droplet C, there is no danger of lowering speed of the small diameter ink droplet A and intermediate ink droplet B, or eject failure.

In this embodiment also, the drive voltage waveforms for the small, intermediate, and large diameter ink droplets are generated by the separate waveform generation circuits (241A, 241B, and 241C) as shown in FIG. 8. According to an image data, the drive voltage waveforms to be applied to the piezoelectric actuators 236 are switched for performing gradation recording.

As a result, it has been confirmed that it is possible to obtain a stable eject in the drive frequency of 0.1 to 10 kHz without causing an eject failure. It should be noted that in this third embodiment, the small diameter ink droplet A, the intermediate diameter ink droplet B, and the large diameter ink droplet C are ejected in this order. However, the order may be changed if it can prevent the structural cross talk.

However, the affect of the structural cross talk increases as the ink droplet diameter becomes smaller. Accordingly, it is preferable that the smaller ink droplet be ejected earlier.

The present invention is not to be limited to the aforementioned embodiments. For example, in the embodiments, the vibration generation unit is realized by a layered piezoelectric actuator 236 of longitudinal vibration mode using a piezoelectric constant d233. However, it is also possible to use other types of piezoelectric generation unit such as vibration generation unit of longitudinal vibration mode having a piezoelectric constant of D231, single-plate type piezoelectric actuator, piezoelectric actuator of deflection vibration mode.

Figure 30:
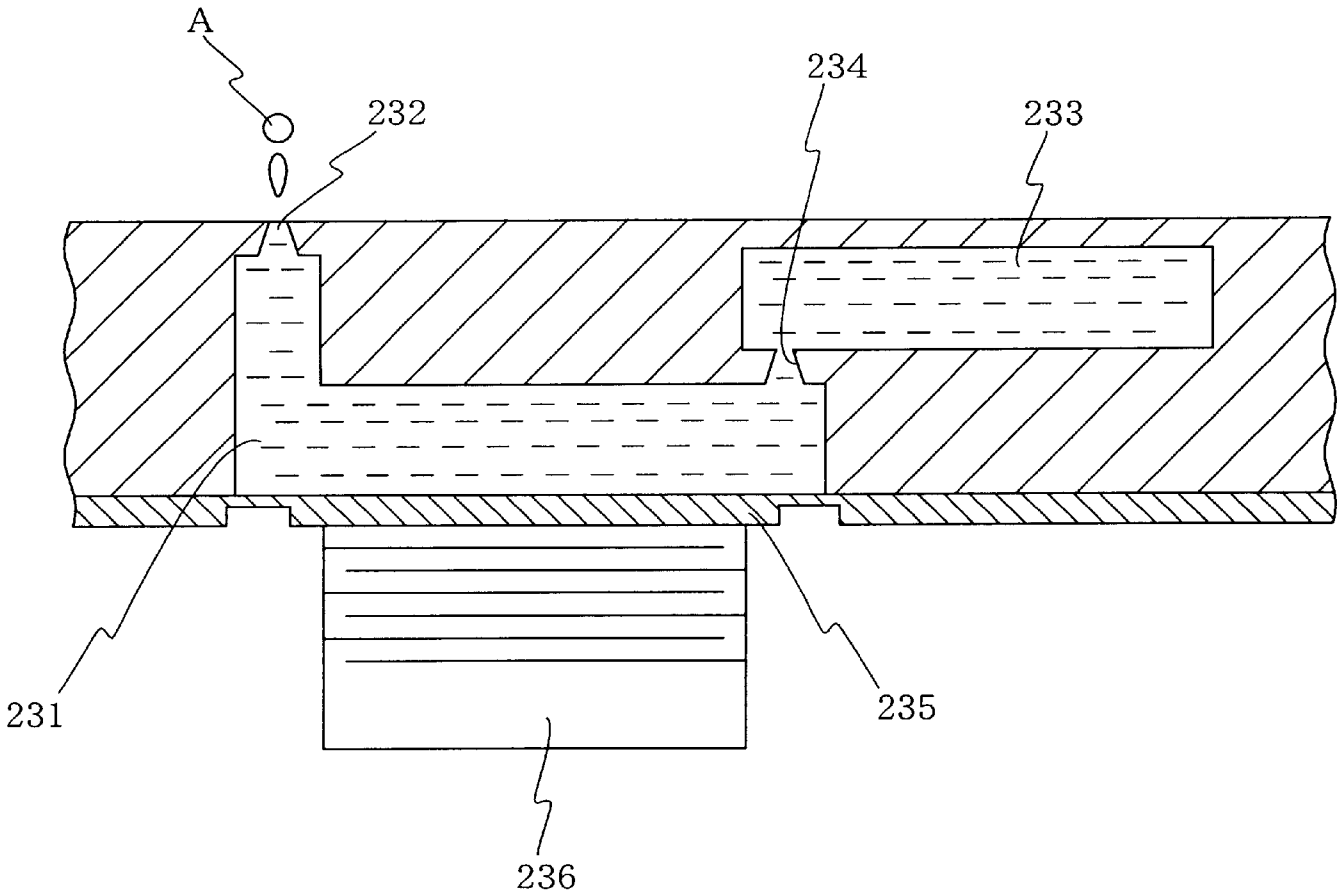
FIG. 30 is a front view of a conventional ink jet recording head.
Figure 31:
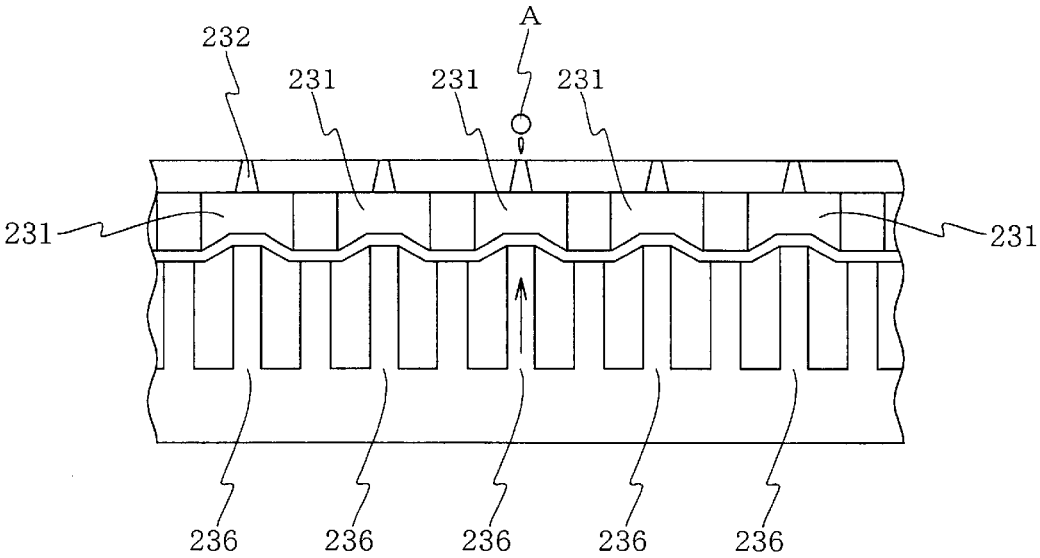
FIG. 31 is a side view of the recording head of FIG. 30.
Figure 32:
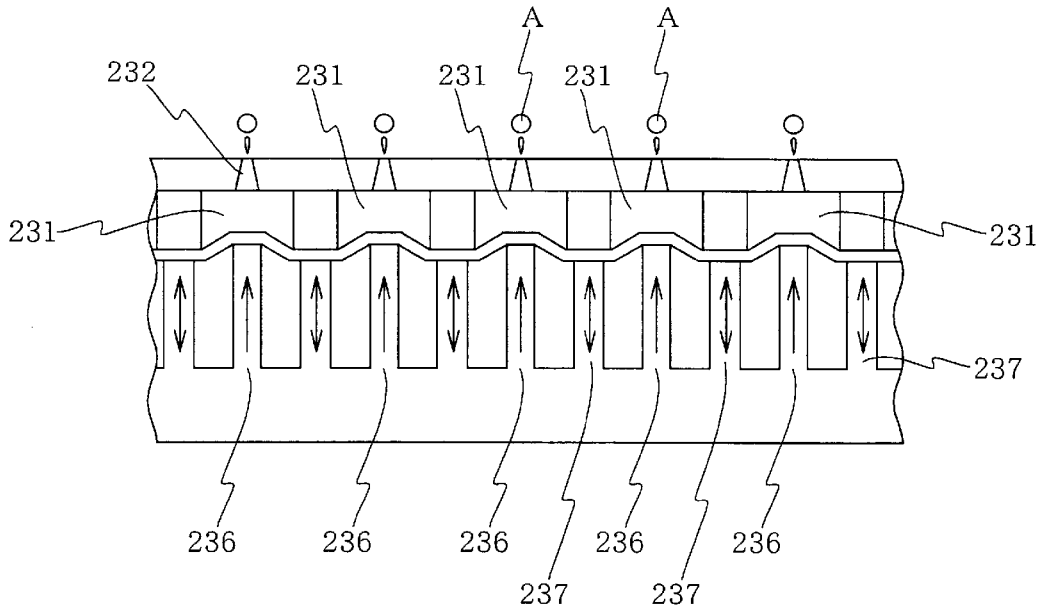
FIG. 32 is a side view of the recording head of FIG. 30 showing that adjacent piezoelectric actuators are simultaneously driven.

Moreover, in the aforementioned embodiments, a Kyser type ink jet recording head as shown in FIG. 30 is used. However, the present invention can also be applied to other types of in jet recording head such as a recording head in which a groove provided in the piezoelectric actuator serves as a pressure generation chamber.

Furthermore, the present invention can also be applied to an ink jet recording head using an actuator other than a piezoelectric actuator, such as an actuator utilizing an electrostatic force and magnetic force, for example. Moreover, in the aforementioned embodiments, the ink jet recording apparatus ejects a colored ink onto a recording paper to record a character and an image. However, the present invention is not to be limited to recording of a character and an image onto a recording paper and the ink is not to be limited to a colored ink.

According to the present invention, a drive voltage waveform is generated according to an ink droplet diameter, and the drive voltage waveform is applied to vibration generation unit provided for the respective pressure generation chambers with a time difference. Accordingly, when an ink droplet is ejected from a pressure generation chamber, the vibration will not affect the other pressure generation chamber. Thus, an ink droplet of a desired diameter is generated in each of the pressure generation chambers and ejected from a nozzle at a desired speed. This significantly improves the recorded image quality.

Moreover, since a drive voltage waveform is generated according to an ink droplet diameter, it is possible to eject ink droplets of different diameter successively within a short period of time. Accordingly, there is no need of prolonging the recording time than is necessary.

[Fourth Embodiments]

Hereinafter, explanation will be given on embodiments of the present invention with reference to the attached drawings. The explanation will be given on specific examples.

[First Example of Fourth Embodiments]

Firstly, explanation will be given on a fourth embodiment of the present invention.

Figure 12A:
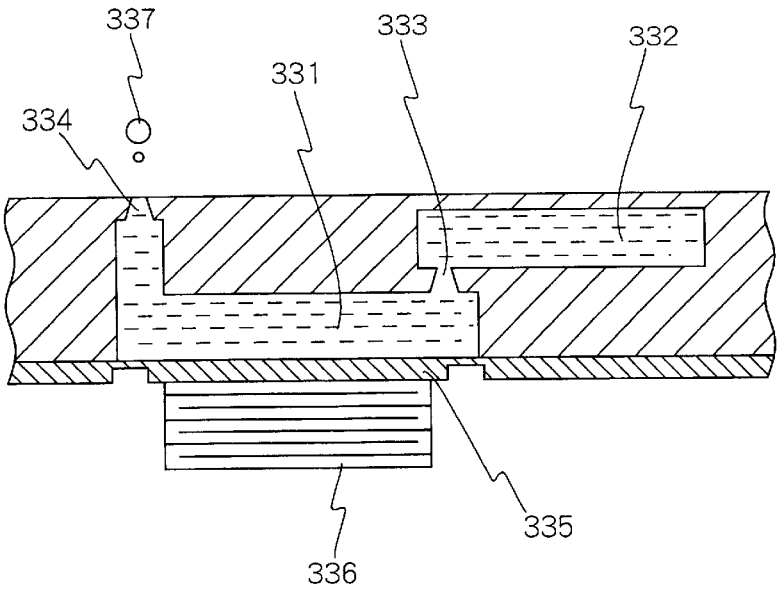
FIG. 12(*a*) is a cross sectional view of an example of an ink jet recording head mounted on an ink jet recording apparatus using an ink jet recording head drive method according to forth embodiment of the present invention, and FIG. 12(*b*) is an exploded cross sectional view of the ink jet recording head.
Figure 12B:
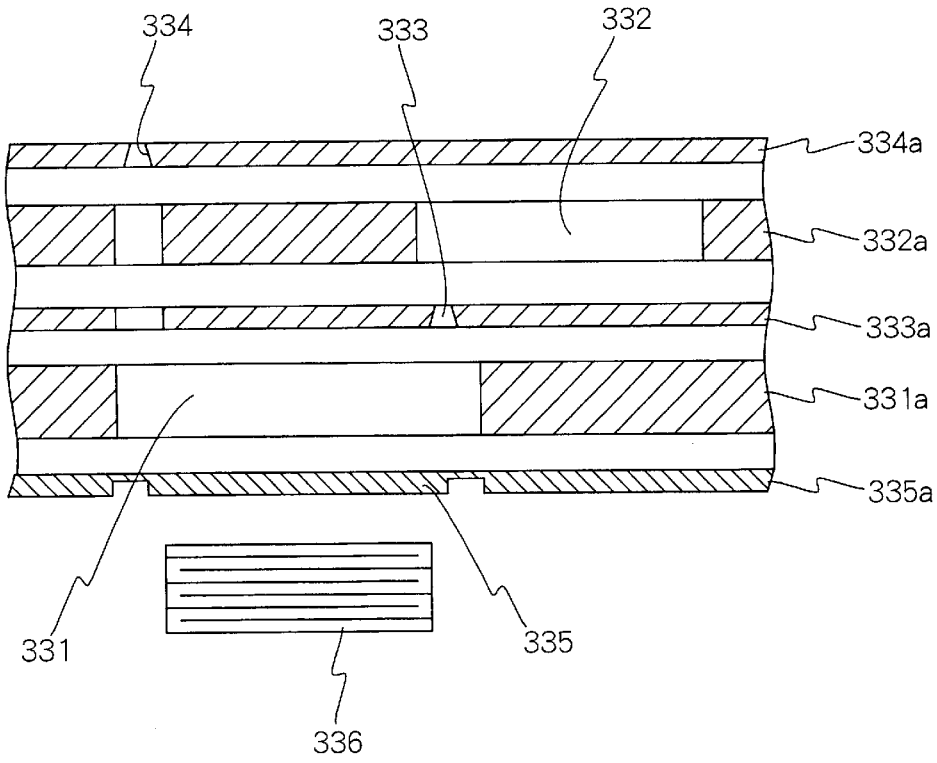

FIG. 12(*a*) is a cross section showing an example of configuration of an ink jet recording head mounted on an ink jet recording apparatus using the ink jet recording head drive method according to the fourth embodiment of the present invention. FIG. 12(*b*) is an exploded cross section of the ink jet recording head.

As shown in FIG. 12(*a*), the ink jet recording head in this example is a drop-on-demand Kyser type multi-nozzle recording head in which an ink droplet 337 is ejected when necessary to print a character or an image on a recording medium. The ink jet recording head includes: a plurality of pressure generation chambers 331 each having a configuration of parallelopiped arrange in the vertical direction to the page space; diaphragms 335 each constituting the bottom of the respective pressure generation chambers 331; a plurality of piezoelectric actuators 336 arranged at the back of the diaphragms 335 so as to correspond to the respective pressure generation chambers 331; a common ink chamber (ink pool) 332 connected to an ink tank (not depicted) for supplying ink to the respective pressure generation chambers 331; a plurality of ink supply holes (ink supply paths) 333 for communication between the ink pool 332 and the respective pressure generation chambers 331; and a plurality of nozzles each arranged to correspond to the respective pressure generation chambers 331, for discharging the ink droplet 337 from the tip end protruding from the bent portion of each of the pressure generation chambers 331. Here, the ink pool 332, the ink supply holes 333, the pressure generation chambers 331, and the nozzles 334 constitute an ink flow section while the piezoelectric actuators 336 and the diaphragms 335 constitute a drive section for applying a pressure wave to the ink in the pressure generation chambers. The contact point between the flow section and the drive section is the bottom of the pressure generation chambers 331 (i.e., the upper surface of the diaphragm in the figure).

The piezoelectric actuator 336 is in the longitudinal vibration mode utilizing a piezoelectric constant d333, made from a layered type piezoelectric ceramic, and having a drive column configuration: length (L) 690 micrometers, width (W) 1.8 micrometers, and depth (vertical direction to the page space of FIG. 12) 120 micrometers for displacing the pressure generation chamber 331. The piezoelectric actuator 336 is made from a piezoelectric material having a density ρp of $8.0\times10^3$ [kg/m$^3$] and an elastic coefficient Ep of 68 GPa. The piezoelectric actuator 336 itself was measured to have a natural period $T_a$ of 1.0 microseconds.

The head in this embodiment is produced as follows. As shown in FIG. 12(*b*), etching or the like is performed to prepare a nozzle plate 334*a* having a plurality of nozzles 334 arranged in columns or chess configuration, a pool plate 332*a* having a space for the ink pool 332, a supply hole plate 333*a* having ink supply holes 333, a pressure generation chamber plate 331*a* having spaces for a plurality of pressure generation chambers, and a vibration plate 335*a* constituting a plurality of diaphragms 335. These plates 331*a* to 335*a* are bonded together using a thermosetting resin (not depicted) having a thickness of about 5 micrometers, so as to produce a layered plate. Next, the layered plate is bonded to the piezoelectric actuators 336 using a thermosetting resin adhesive layer or epoxy adhesive layer, so as to produce the ink jet recording head having the aforementioned configuration. It should be noted that in this example, the vibration plate 335*a* is made from a nickel plate formed by electroforming so as to have a thickness of 50 to 75 micrometers while the other plates 331*a* to 334*a* are made from stainless steel having a thickness of 50 to 75 micrometers. Moreover, a nozzle in this example has an opening top diameter of 30 micrometers, opening bottom diameter of 65 micrometers, and length of 75 micrometers, i.e., formed in a taper configuration where the diameter is gradually increased toward the pressure generation chamber 331. The ink supply hole 333 is formed with the same configuration as the nozzle 334.

Next, referring to FIG. 13 and FIG. 14, explanation will be given on an electric configuration of the drive circuit for driving the ink jet recording head having the aforementioned configuration and constituting an ink jet recording apparatus.

The ink jet recording apparatus in this example have a CPU (central processing unit) and memory such as ROM and RAM. The CPU executes a program stored in the ROM and, using various registers and flags in the RAM, controls the respective components for recording a character or an image on a recording medium according to an image data supplied from an upper node apparatus such as a personal computer via an interface.

Figure 13:
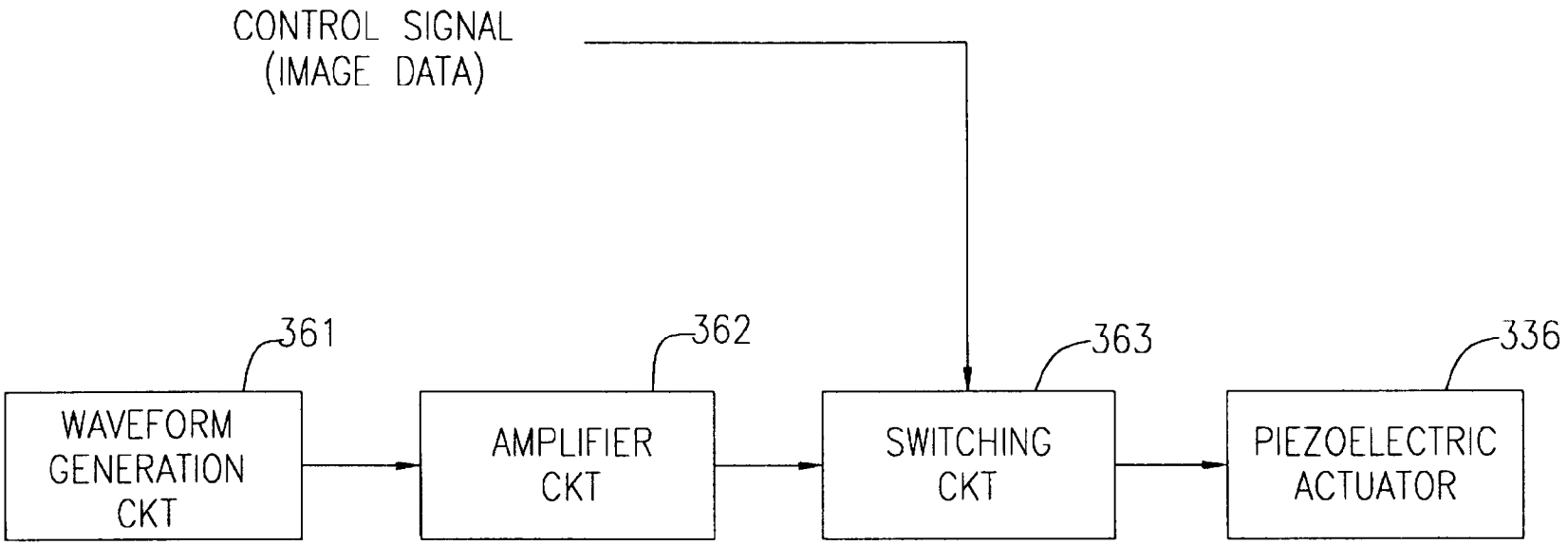
FIG. 13 is a block diagram showing an electric configuration of a fixed droplet diameter type drive circuit for driving the ink jet recording head.

Firstly, FIG. 13 shows a drive circuit including a waveform generation circuit 361, an amplification circuit 362, and a switching circuit 363. The drive circuit generates a drive waveform corresponding to the amplified drive waveform signal shown in FIG. 15 and amplifies the signal before supplying it to the piezoelectric actuator 336, so that an ink droplet 337 of an identical diameter is always ejected to record a character or an image on a recording medium.

The waveform generation circuit 361 consists of a digital-analog conversion circuit and an integration circuit. A drive waveform data read by the CPU from a predetermined storage area of the ROM is converted into an analog data and then subjected to integration processing to generate a drive waveform signal corresponding to the amplified drive waveform signal shown in FIG. 15. The amplification circuit 362 amplifies the drive waveform signal supplied from the waveform generation circuit 361 and output the signal as the amplified drive waveform signal shown in FIG. 15. The switching circuit 363 consists of, for example, a transfer gate having an input terminal connected to an output terminal of the amplification circuit 362, an output terminal connected to one end of the piezoelectric actuator 336, and a control terminal. When the control terminal is supplied with a control signal generated in a drive control circuit (not depicted) according to an image data, the transfer gate becomes ON and applies the amplified drive waveform signal (see FIG. 15) from the amplification circuit 362 to the piezoelectric actuator 336. Here, the piezoelectric actuator 336 displaces the diaphragm 335 corresponding to the amplified drive waveform signal applied. The displacement of the diaphragm 335 causes a sudden volume change (increase or decrease) of the pressure generation chamber 331, so as to generate a predetermined pressure wave in the pressure generation chamber 331 filled with ink. This pressure wave functions to eject a very small ink droplet 337 having a diameter of about 20 micrometers. It should be noted that in the ink jet recording head of this embodiment, the pressure wave in the pressure generation chamber 331 filled with ink has a natural period T, of 10 microseconds. The ink droplet 337 ejected reaches a recording medium to form a recording dot. Such a recording dot formation is repeatedly performed according to an image data so as to record a character or an image on the recording medium.

Figure 14:
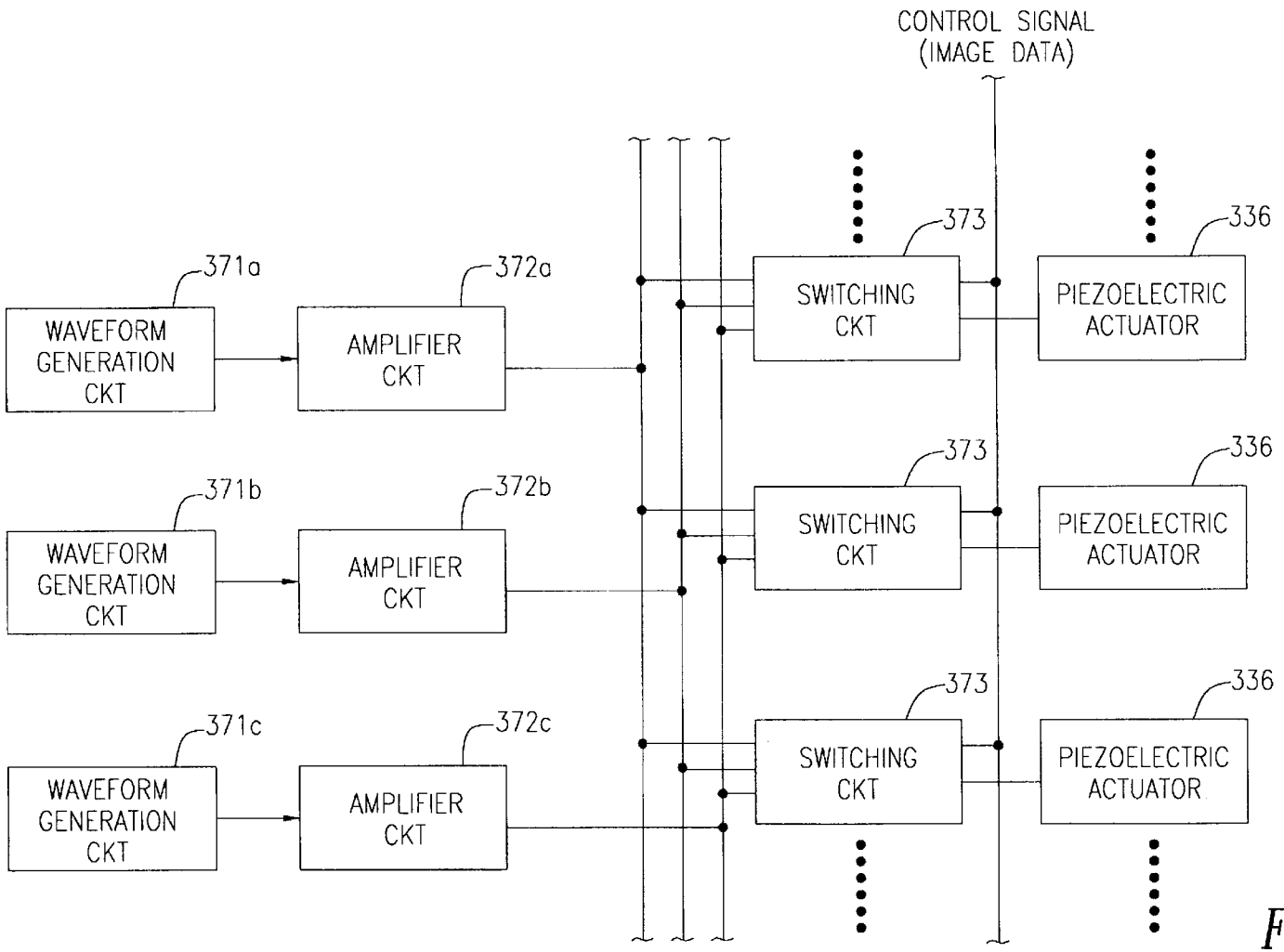
FIG. 14 is a block diagram showing an electric configuration of a droplet diameter modulation type drive circuit for driving the ink jet recording head.

Next, the drive circuit shown in FIG. 14 is a so-called droplet diameter modulation type drive circuit for switching the ink diameter ejected from the nozzle 334 in multiple steps (in this example, a large droplet of 40 micrometer, an intermediate droplet of 30 micrometers, and a small droplet of 20 micrometers) for recording a character or an image with a multiple gradation. The drive circuit includes three types of waveform generation circuits 371*a*, 371*b*, 371*c*, amplification circuits 372*a*, 372*b*, 372*c* connected to the waveform generation circuits 371*a*, 371*b*, 371*c*, respectively, and a plurality of switching circuits 373, 373, 373 each connected to the piezoelectric actuators 336, 336, 336.

Each of the waveform generation circuits 371*a* to 371*c* consists of a digital-analog conversion circuit and an integration circuit. of these waveform generation circuits 371*a* to 371*c*, the waveform generation circuit 371*a* converts to an analog data the drive waveform data for discharging a large droplet which has been read from a predetermined storage area of the ROM by the CPU and performs integration of the data to generate a drive waveform signal for discharging the large droplet. The waveform generation circuit 371*b* converts to an analog data the drive waveform data for discharging an intermediate droplet which has been read from a predetermined storage area of the ROM by the CPU and performs integration of the data to generate a drive waveform signal for discharging the intermediate droplet. Moreover, the waveform generation circuit 371*c* converts to an analog data the drive waveform data for discharging a small droplet which has been read from a predetermined storage area of the ROM by the CPU and performs integration of the data to generate a drive waveform signal for discharging the small droplet.

The amplification circuit 372*a* amplifies the drive waveform signal for the large droplet ejection supplied from the waveform generation circuit 371*a* and outputs it as the amplified drive waveform signal for the large droplet ejection. The amplification circuit 372*b* amplifies the drive waveform signal for the intermediate droplet ejection supplied from the waveform generation circuit 371*b* and outputs it as the amplified drive waveform signal for the intermediate droplet ejection. Moreover, the amplification circuit 372*c* amplifies the drive waveform signal for the small droplet ejection supplied from the waveform generation circuit 371*c* and outputs it as the amplified drive waveform signal for the small droplet ejection (see FIG. 15).

Moreover, the switching circuit 373 consists of a first, a second, and a third transfer gate. The first transfer gate has an input terminal connected to the output terminal of the amplification circuit 372*a*. The second transfer gate has an input terminal connected to the output terminal of the amplification circuit 372*b*. The third transfer gate has an input terminal connected to the output terminal of the amplification circuit 372*c*. The first, second, and third transfer gates have their output terminals connected to a terminal of the corresponding common piezoelectric actuator 336.

When the first transfer gate control terminal is supplied with a gradation control signal generated in a drive control circuit (not depicted) according to an image data, the first transfer gate turns on and applies the amplified drive waveform signal from the amplification circuit 372*a* for the large droplet, to the piezoelectric actuator 336. The piezoelectric actuator 336 displaces the diaphragm 335 corresponding to the amplified drive waveform signal applied, so that the displacement of the diaphragm 335 suddenly changes (increases or decreases) the volume of the pressure generation chamber 331 so as to generate a pressure wave in the pressure generation chamber 331 filled with ink. This pressure wave causes to eject a large ink droplet from the nozzle 334.

When the second transfer gate control terminal is supplied with a gradation control signal generated in a drive control circuit (not depicted) according to an image data, the second transfer gate turns on and applies the amplified drive waveform signal from the amplification circuit 372*b* for the intermediate droplet, to the piezoelectric actuator 336. The piezoelectric actuator 336 displaces the diaphragm 335 corresponding to the amplified drive waveform signal applied, so that the displacement of the diaphragm 335 suddenly changes (increases or decreases) the volume of the pressure generation chamber 331 so as to generate a pressure wave in the pressure generation chamber 331 filled with ink. This pressure wave causes to eject an intermediate ink droplet from the nozzle 334.

Moreover, when the third transfer gate control terminal is supplied with a gradation control signal generated in a drive control circuit (not depicted) according to an image data, the third transfer gate turns on and applies the amplified drive waveform signal from the amplification circuit 372*c* for the small droplet, to the piezoelectric actuator 336. The piezoelectric actuator 336 displaces the diaphragm 335 corresponding to the amplified drive waveform signal applied, so that the displacement of the diaphragm 335 suddenly changes (increases or decreases) the volume of the pressure generation chamber 331 so as to generate a pressure wave in the pressure generation chamber 331 filled with ink. This pressure wave causes to eject a small ink droplet from the nozzle 334. The ejected ink droplet 337 reaches a recording medium and forms a recording dot. Such a recording dot is repeatedly formed according to an image data, thus recording a character or an image in multiple gradation on the recording medium.

In this embodiment, the drive circuit of FIG. 14 is mounted on an ink jet recording apparatus performing gradation recording, while the drive circuit of FIG. 13 is mounted on an ink jet recording apparatus dedicated to binary recording and not performing the gradation recording.

Figure 15:
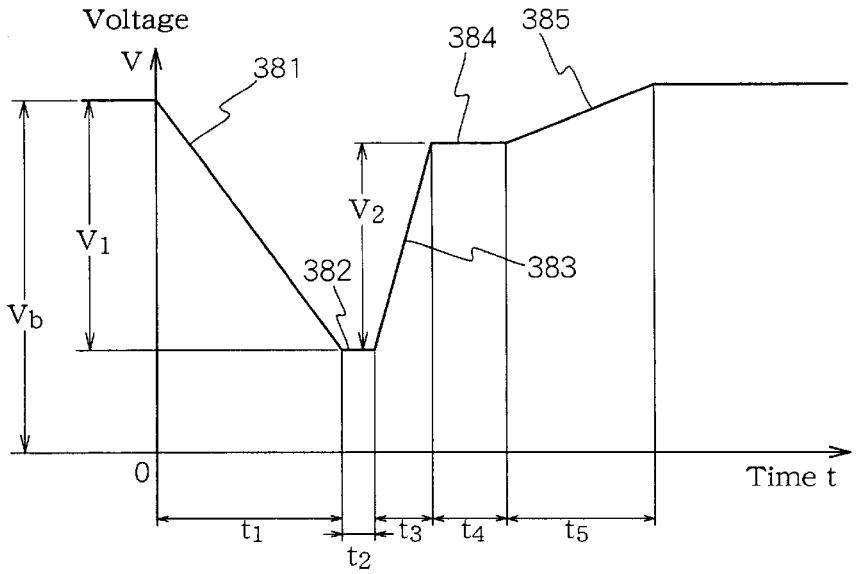
FIG. 15 shows an example of waveform profile of an amplified drive waveform signal used in the ink jet recording head drive method.

As shown in FIG. 15, the aforementioned amplified drive waveform signal consists of: a first voltage change process 381 for increasing the volume of the pressure generation chamber 331 so as to make the meniscus retreat by reducing the voltage $V_b$ applied to the piezoelectric actuator 336 from the reference voltage $V_b$ to a voltage $(V_b-V_1)$ within a trailing time $t_1$=½of the natural period $T_c$, of the pressure wave generated in the pressure generation chamber 331; a first voltage maintaining process 382 for maintaining the application voltage V at voltage $(V_b-V_1)$ for a certain period of time $(t_2)$ a second voltage change process 383 for decreasing the volume of the pressure generation chamber and forming a liquid column at the center of the meniscus by increasing the voltage V applied to the piezoelectric actuator 336, up to $(V_b-V_1+V_2)$ within a rise time $t_3$; a second voltage maintaining process 384 for maintaining the application voltage V at $(V_b-V_1+V_2)$ for a certain period of time (time $t_4$); and a third voltage change process for increasing the voltage V applied to the piezoelectric actuator 336, up to the reference voltage V so as to decrease the volume of the pressure generation chamber 331 to eject an ink droplet 337 and get ready for the subsequent eject operation.

Next, according to this ink jet recording head drive method, an ejection experiment of the ink droplet 337 was performed by setting the drive waveform signal at the waveform conditions as follows:

Reference voltage $V_b$=25V

Voltage change amount $v_1$ in the first voltage change process 381=15V,

Voltage change time $v_2$ in the second voltage change process 383=12V,

Voltage maintaining time $t_2$ in the first voltage change process 381=0.3 microseconds, Voltage change time $t_1$ in the first voltage change process 381=5 microseconds, Voltage change time $t_3$ in the second voltage change process 381=1.5 microseconds, Voltage maintaining time $t_4$ in the second voltage maintaining process 382=6 microseconds, and Voltage change time $t_5$ in the third voltage change process 385=20 microseconds.

By changing the voltage change time t, in the first voltage change process 381 and the droplet diameter change was examined. It should be noted that the voltage maintaining time $t_2$ was set to satisfy Equation (3) given below. The voltage change amount $V_1$ in the first voltage change process 381 was set so as to obtain a constant meniscus retreat amount. The voltage change amount $V_2$ in the second voltage change process 381 was adjusted so as to obtain a droplet velocity of 6 m/s.

[Equation 3]

$$t_1+t_2=\tfrac{1}{2}\cdot T_c \tag{3}$$

Figure 16:
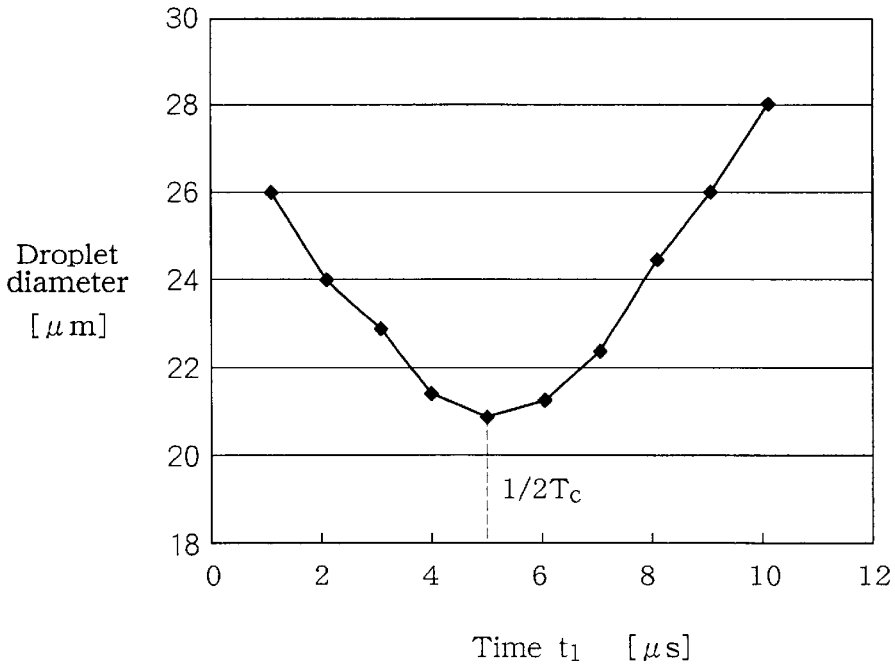
FIG. 16 shows the relationship between the voltage change time $t_1$ in the first voltage change process 1 and the ink droplet diameter.

FIG. 16 shows the relationship between the voltage change time $t_1$ in the first voltage change process 381 and the diameter of the ink droplet 337. Referring to FIG. 16, it can be understood that the ink droplet 337 has the smallest diameter when the voltage change time $t_1$ is ½of the natural period $T_c$ of the pressure wave generated in the pressure generation chamber 331 and this is the optimal condition for discharging a small ink droplet. In the experiment, it was observed that an ink droplet having a diameter of 321 micrometers was ejected at droplet velocity of 6.2 m/s.

For comparison, in the amplified drive waveform signal of FIG. 15, the voltage change time $t_1$ was set to 2 microseconds and the voltage maintaining time $t_2$ was set to 3 microseconds for performing the ejection experiment of the ink droplet 337. The result was that the smallest diameter obtained was 25 micrometers in spite of various adjustments of the voltage change amount $V_1$ and $V_2$.

As can be seen from FIG. 16, the voltage change time $t_1$ need not be accurately ½of the natural period $T_c$ but can be roughly around ½of the natural period $T_c$ for obtaining a small ink droplet. More specifically, it is preferable that the voltage change time $t_1$ satisfy Equation 4 given below.

[Equation 4]

$$\tfrac{1}{3}\cdot Tc \leqq t_1 \leqq \tfrac{2}{3}T_c$$

Moreover, the voltage maintaining time $t_2$ in the first voltage maintaining process 382 is preferably as short as possible, so as to match the phases of particle velocities generated at the turning points B and C in FIG. 15. If the voltage maintaining time $t_2$ satisfies Equation (5), it is possible to eject a small ink droplet.

[Equation 5]

$$t_2 \leqq \tfrac{1}{5}\cdot T_c \tag{5}$$

Furthermore, the voltage change time $t_3$ in the second voltage change process 383 is preferably as short as possible, so as to obtain a sufficient particle velocity in the meniscus to form a liquid column. More specifically, it is preferable that the voltage change time $t_3$ satisfy the following Equation (6).

$$t_3 \leqq \tfrac{1}{3}\cdot T_c \tag{6}$$

Thus, with this configuration, in the amplified drive waveform signal shown in FIG. 15, if the voltage change time $t_1$ is set to about ½ of the natural period $T_c$ and the voltage maintaining time $t_2$ is set sufficiently short, it is possible to assure stable ejection of a small ink droplet having a diameter of about 20 micrometers.

Figure 38:
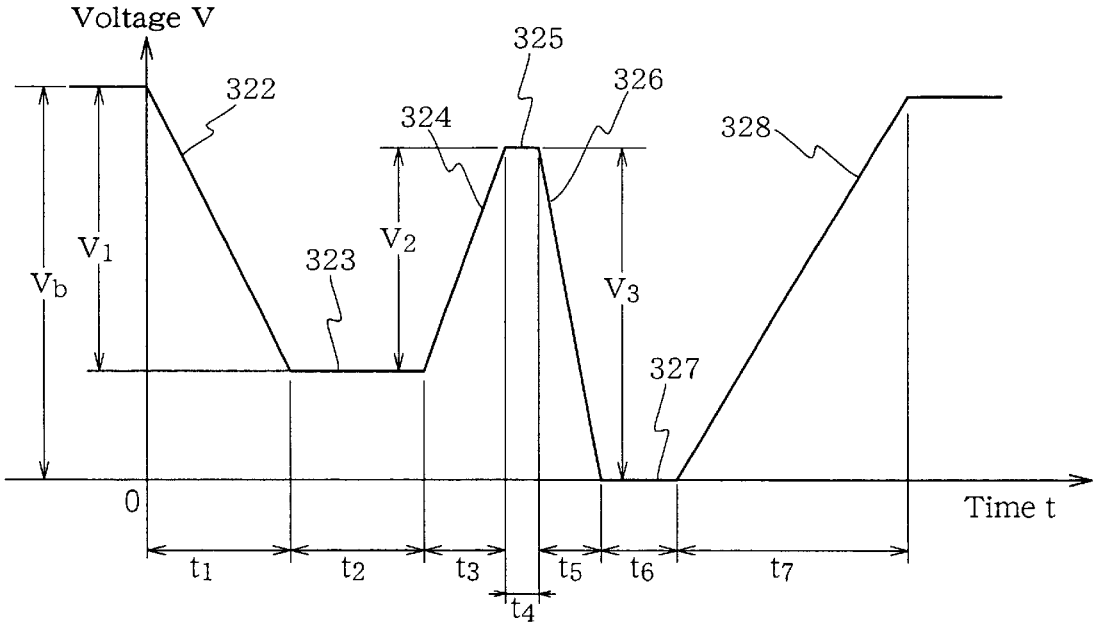
FIG. 38 shows still another example of waveform profile of a drive waveform signal used in the conventional ink jet recording head.

It should be noted that in this case, unlike the rise time $t_3$ and the trail time $t_5$ in the conventional drive waveform signal shown in FIG. 38, the voltage change time values $t_1$, $t_2$, and $t_5$ in the amplified drive waveform signal shown in FIG. 15 need not be set shorter than the natural period $T_a$ of the piezoelectric actuator 336. Accordingly, the natural vibration of the piezoelectric actuator 336 itself is not excited and there is no danger of increase of the current flowing into the piezoelectric actuator, which may deteriorate the actuator reliability and service life.

[Second Example of Fourth Embodiment]

Next, explanation will be given on a second example of the fourth embodiment.

Figure 17:
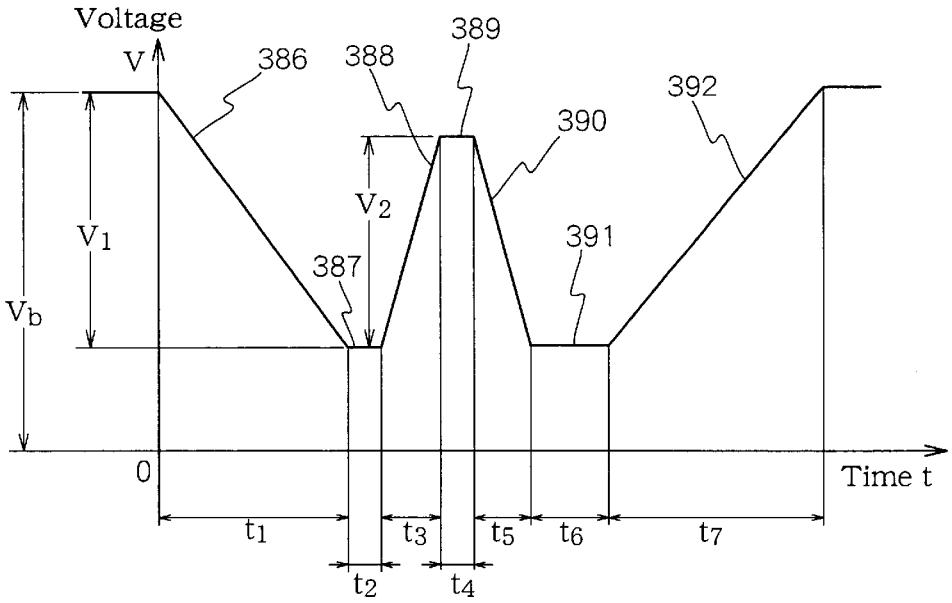
FIG. 17 shows an example of waveform profile of an amplified drive waveform signal used in an ink jet recording head drive method according to fourth embodiment of the present invention.

FIG. 17 shows an example of waveform profile of an amplified drive waveform signal used in the ink jet recording head drive method according to the second example of the fourth embodiment.

As shown in FIG. 17, in this embodiment, the amplified drive waveform signal consists of: a first voltage change process 386 for increasing the volume of the pressure generation chamber 331 and making the meniscus retreat by decreasing the voltage V applied to the piezoelectric actuator from the reference voltage $V_b$ to the voltage $(V_b-V_1)$ within a trail time $t_1$ which is ½ of the natural period $T_c$ of the pressure wave generated in the pressure generation chamber 331; a first voltage maintaining process 387 for maintaining the application voltage V at the voltage $(V_b-V_1)$ for a certain period of time (time $t_2$); a second voltage change process 388 for decreasing the volume of the pressure generation chamber 331 to form a liquid column at the center of the meniscus by increasing the voltage V applied to the piezoelectric actuator 336, up to $(V_b-V_1+V_2$ within a rise time $t_3$; a second voltage maintaining process 389 for maintaining the application voltage V at $(V_b-V_1+V_2)$ for a certain period of time (time $t_1$); a third voltage change process 390 for increasing the volume of the pressure generation chamber 331 and separating an ink droplet 337 from the tip end of the liquid column at an early stage, by reducing the application voltage V from $(V_b-V_1+V_2)$ down to $(V_b-V_1$ within a trailing time $t_5$; a third voltage maintaining process 391 for maintaining the application voltage V at $(V_b-V_1)$ for a certain period of time $(t_6)$; and a fourth voltage change process 392 for reducing the volume of the pressure generation chamber 331 to eject an ink droplet 337 and get ready for the subsequent eject operation, by increasing the voltage V applied to the piezoelectric actuator, up to the reference voltage $V_b$.

Next, according to the aforementioned ink jet recording head drive method, an ejection experiment of the ink droplet 337 was performed with the drive waveform signal set to waveform conditions as follows:

Reference voltage $V_b$=25V,

Voltage change time $V_1$ in the first voltage change process 386=15V,

Voltage change time $V_2$ in the second voltage change process 388=12V,

Voltage maintaining time $t_1$ in the first voltage change process 386=5 microseconds, Voltage maintaining time $t_2$ in the first voltage maintaining process 382=0.3 microseconds, Voltage change time $t_3$ in the second voltage change process 388=1.5 microseconds, Voltage maintaining time $t_4$ in the second voltage maintaining process 389=0.2 microseconds, Voltage change time $t_5$ in the third voltage change process 390=1.5 microseconds, Voltage maintaining time $t_6$ in the third voltage maintaining process 391=6 microseconds, and Voltage change time $t_7$ in the fourth voltage change process 382=20 microseconds.

As a result, it was observed that an ink droplet having a diameter of 316 micrometers was ejected at droplet velocity of 6.0 m/s.

Thus, with the aforementioned configuration, in the amplified drive waveform signal shown in FIG. 17, the third voltage change process 390 is provided immediately after the second voltage change process 388, so as to increase the volume of the pressure generation chamber 331 and separate the ink droplet 337 from the liquid column tip end at an early stage. Accordingly, it is possible to eject a further smaller ink droplet 337 compared to the amplified drive waveform signal (see FIG. 15) of the fourth embodiment.

It should be noted that the voltage maintaining time $t_4$, in the second voltage maintaining process 389 is preferably, as short as possible in order to separate the ink droplet 337 from the liquid column tip end at an early stage. More specifically, it is preferable that the voltage maintaining time $t_4$ satisfy Equation (7) given below.

[Equation 7]

$$t_4 \leqq \tfrac{1}{5} \cdot T_c \tag{7}$$

Moreover, the voltage change time $t_5$ in the third voltage change process 390 is preferably as short as possible, so as to obtain a sufficient particle velocity in the meniscus when the ink droplet 337 is separated from the liquid column tip end at an early stage. More specifically, it is preferable that the voltage change time $t_5$ satisfy the Equation (8) given below.

[Equation 8]

$$t_5 \leqq \tfrac{1}{3} \cdot T_c \tag{8}$$

[Third Example of Fourth Embodiment]

Next, explanation will be given on the third example of the fourth embodiment.

Figure 18:
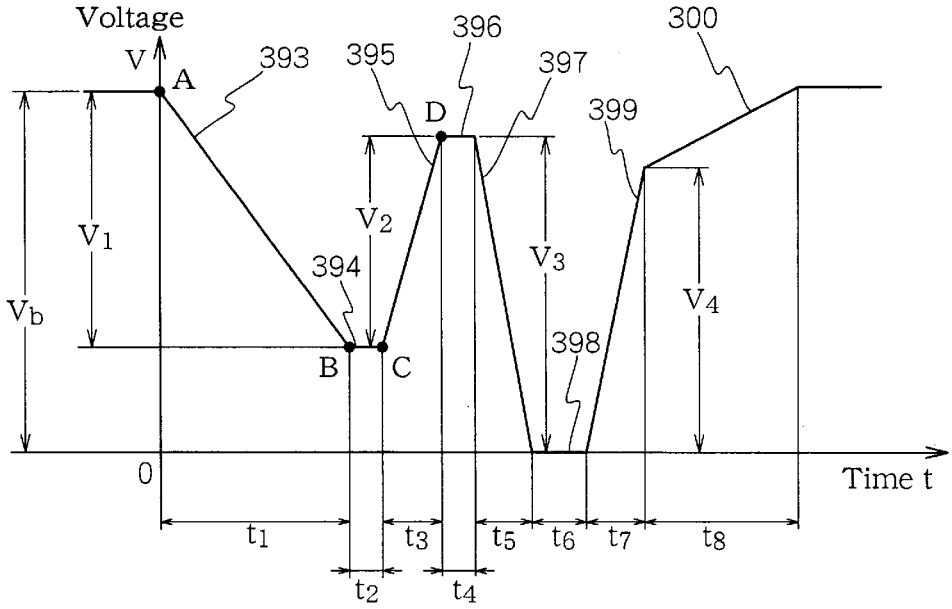
FIG. 18 shows an example of waveform profile of an amplified drive waveform signal used in an ink jet recording head drive method according to a fourth embodiment of the present invention.

FIG. 18 shows an example of waveform profile of an amplified drive waveform signal used in the ink jet recording head drive method according to the third example of the fourth embodiment.

As shown in FIG. 18, in this embodiment, the amplified drive waveform signal consists of: a first voltage change process 393 for increasing the volume of the pressure generation chamber 331 and making the meniscus retreat by decreasing the voltage V applied to the piezoelectric actuator from the reference voltage $V_b$ to the voltage $(V_b-V_1)$ within a trail time $+_1$ which is ½ of the natural period $T_c$ of the pressure wave generated in the pressure generation chamber 331; a first voltage maintaining process 394 for maintaining the application voltage V at the voltage $(V_b-V_1)$ for a certain period of time (time $t_2$); a second voltage change process 395 for decreasing the volume of the pressure generation chamber 331 to form a liquid column at the center of the meniscus by increasing the voltage V applied to the piezoelectric actuator 336, up to $(V_b-V_1+V_2)$ within a rise time $t_3$; a second voltage maintaining process 396 for maintaining the application voltage V at $(V_b-V_1+V_2)$ for a certain period of time (time $t_4$); a third voltage change process 397 for increasing the volume of the pressure generation chamber 331 and separating an ink droplet 337 from the tip end of the liquid column at an early stage, by reducing the application voltage V from $(V_b-V_1+V_2)$ down to 0V for example, within a trailing time $t_5$; a third voltage maintaining process 398 for maintaining the application voltage V at 0V for a certain period of time $(t_6)$; a fourth voltage change process 399 for reducing the volume of the pressure generation chamber 331 to suppress reverberation of the pressure wave remaining after eject of the ink droplet 337, by increasing the voltage V applied to the piezoelectric actuator, up-to voltage $V_4$; and a fifth voltage change process 300 for reducing the volume of the pressure generation chamber 331 to eject the ink droplet 337 and to get ready for the subsequent eject operation, by increasing the voltage to the reference voltage $V_b$.

Next, according to the aforementioned ink jet recording head drive method, an ejection experiment of the ink droplet 337 was performed with the drive waveform signal set to waveform conditions as follows:

Reference voltage $V_b$=25V,

Voltage change amount $V_1$ in the first voltage change process 393=15V,

Voltage change amount $V_2$ in the second voltage change process 395=12V,

Voltage change amount $V_3$ in the third voltage change process 397=16V,

Voltage change amount $V_4$ in the fourth voltage change process 399=14V,

Voltage change time $t_1$ in the first voltage change process 393=5 microseconds, Voltage maintaining time $t_2$ in the first voltage maintaining process 394=0.3 microseconds, Voltage maintaining time $t_2$ in the first voltage maintaining process 394=microseconds, Voltage change time $t_3$ in the second voltage change process 395=1.5 microseconds, Voltage maintaining time $t_4$ in the second voltage maintaining process 396=0.2 microseconds, Voltage change time $t_5$ in the third voltage change process 396=1.5 microseconds, Voltage maintaining time $t_6$ in the third voltage maintaining process 398=1.5 microseconds, Voltage maintaining time $t_7$ in the fourth voltage change process 392=2 microseconds, and Voltage change time $t_8$ in the fifth voltage change process 300=15 microseconds.

As a result, it was observed that an ink droplet having a diameter of 14 micrometers was ejected at droplet velocity of 6.3 m/s.

Figure 19:
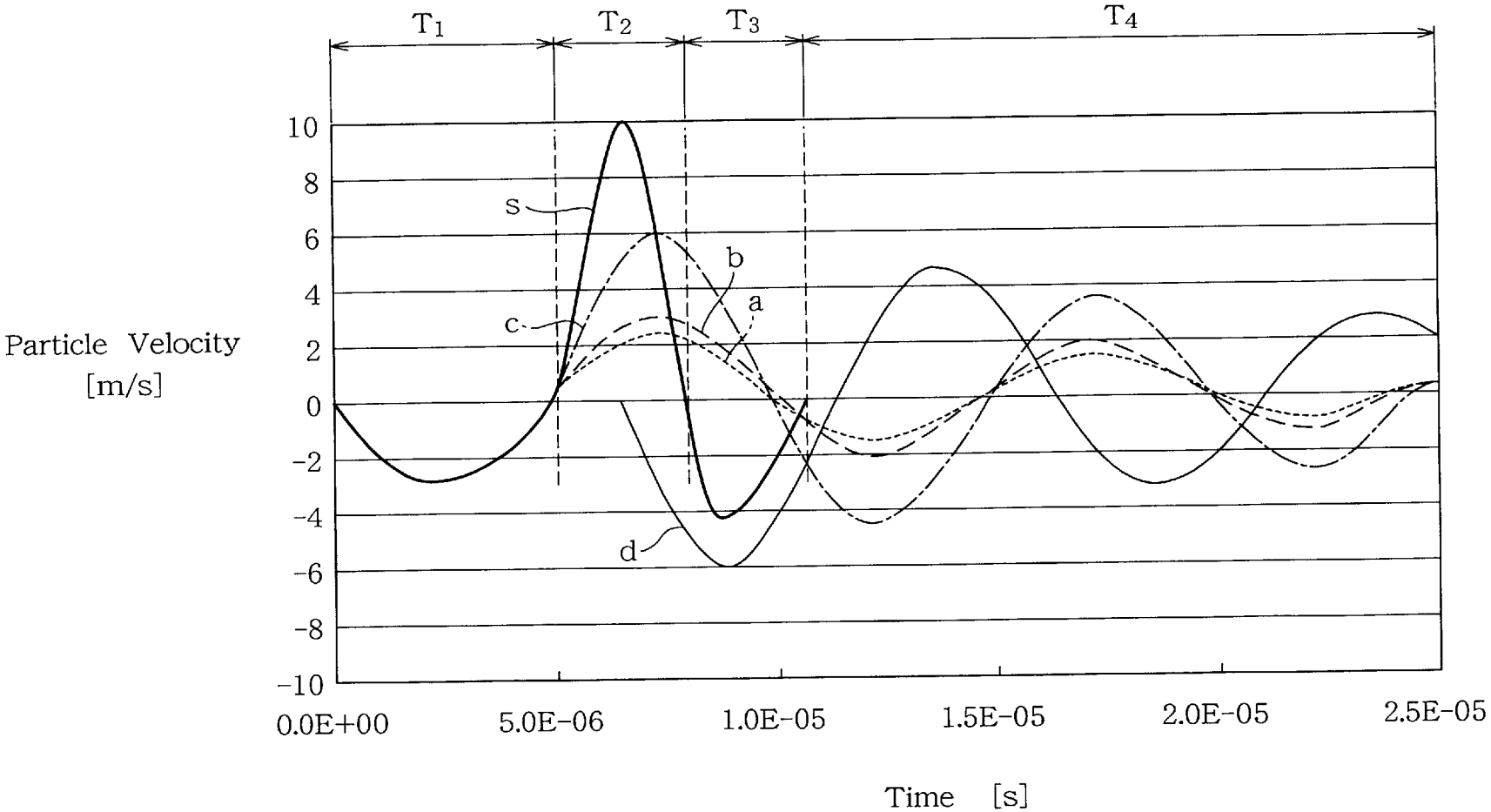
FIG. 19 shows an example of particle velocity change according to time when using the amplified drive waveform signal shown in FIG. 19.
Figure 20A:
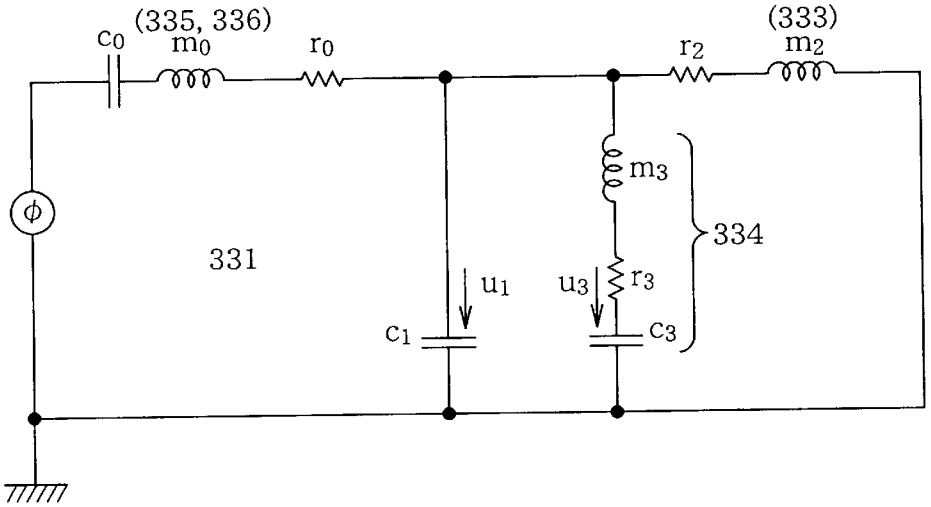
FIGS. 20(*a*)–(*b*) show an equivalent circuit to the ink jet recording head filled with ink used in the present invention.
Figure 20B:
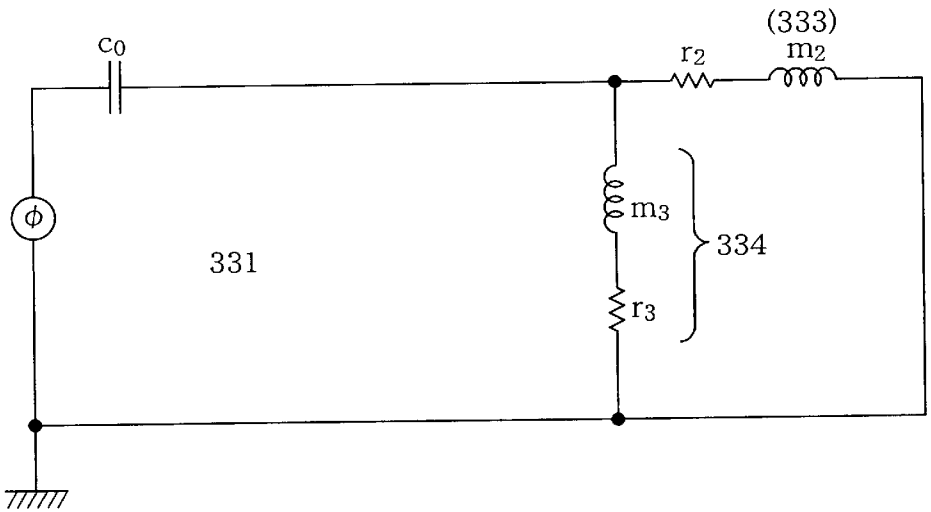
Figure 21A:
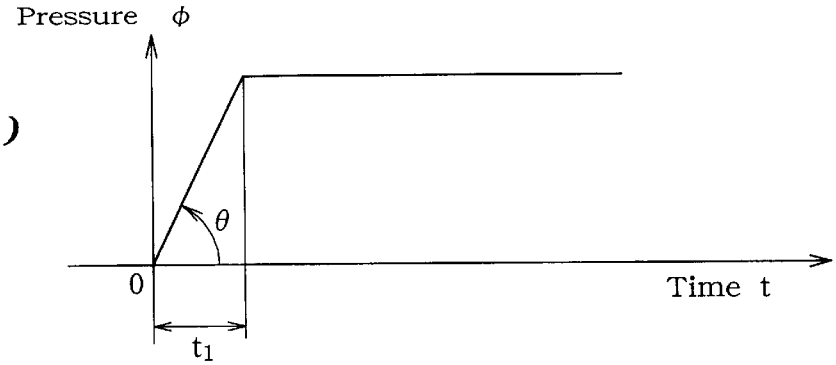
FIGS. 21(*a*)–(*b*) show waveforms for explaining a theoretical basis of the validity of the aforementioned ink jet recording head method.
Figure 21B:
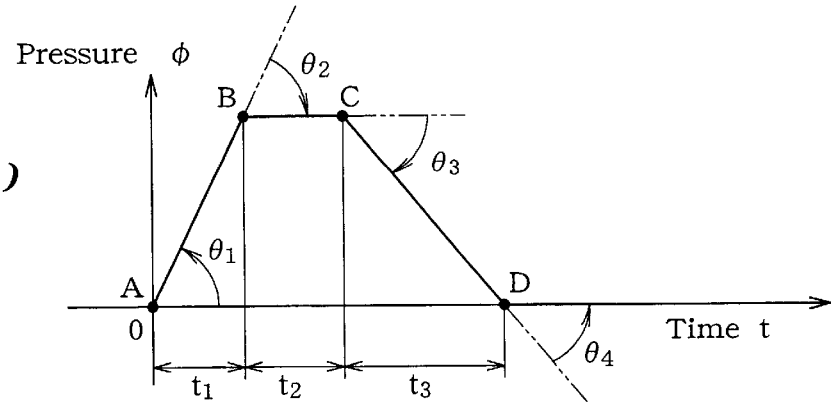
Figure 22:
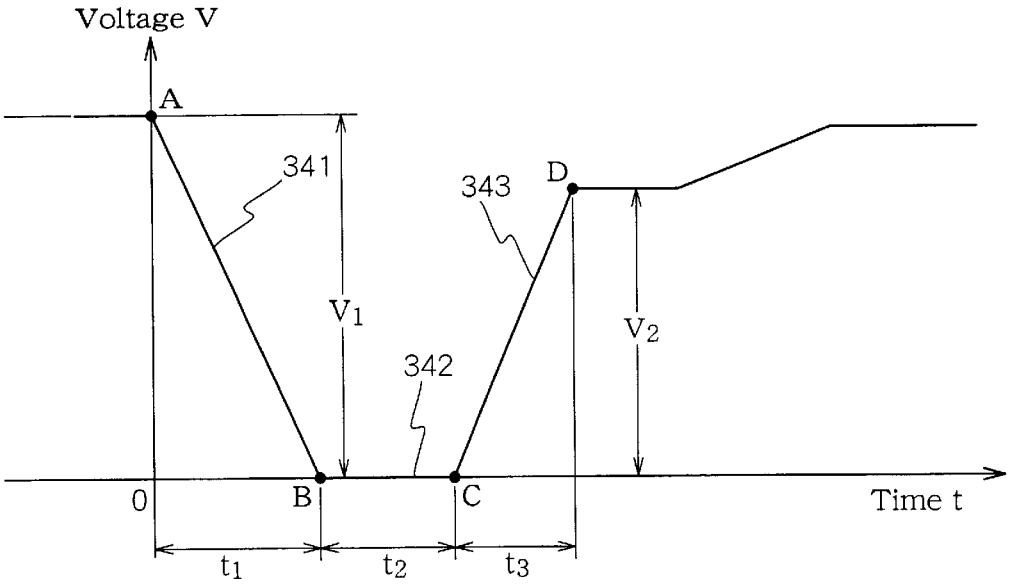
FIG. 22 shows a waveform for explaining a theoretical basis of the validity of the aforementioned ink jet recording head method.
Figure 23:
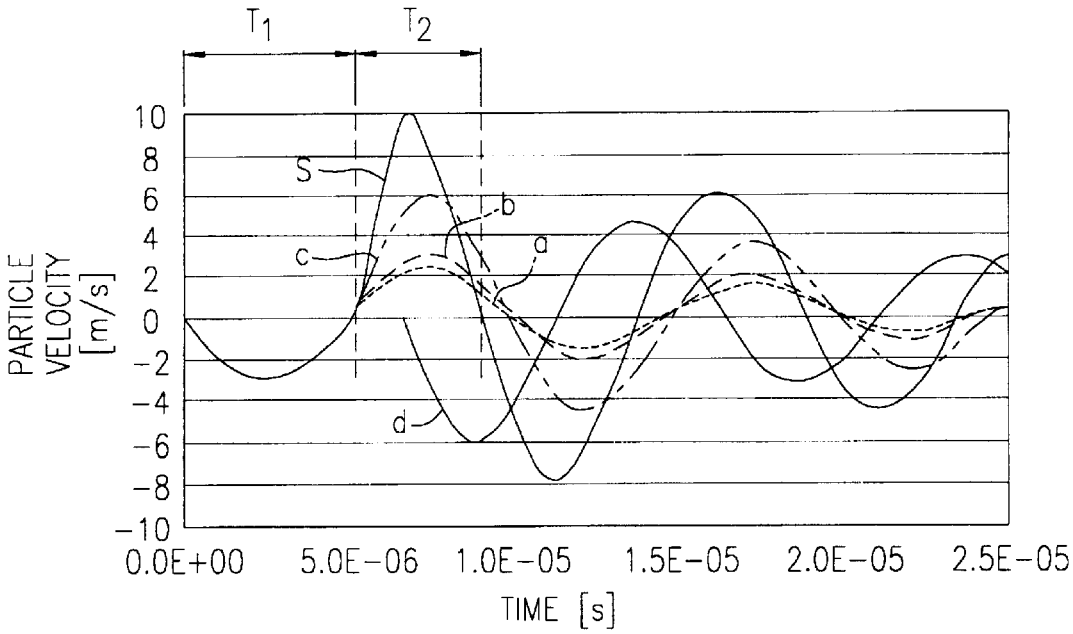
FIGS. 23(*a*)–23(*b*) show waveforms for explaining a theoretical basis of the validity of the aforementioned ink jet recording head method.
Figure 23:
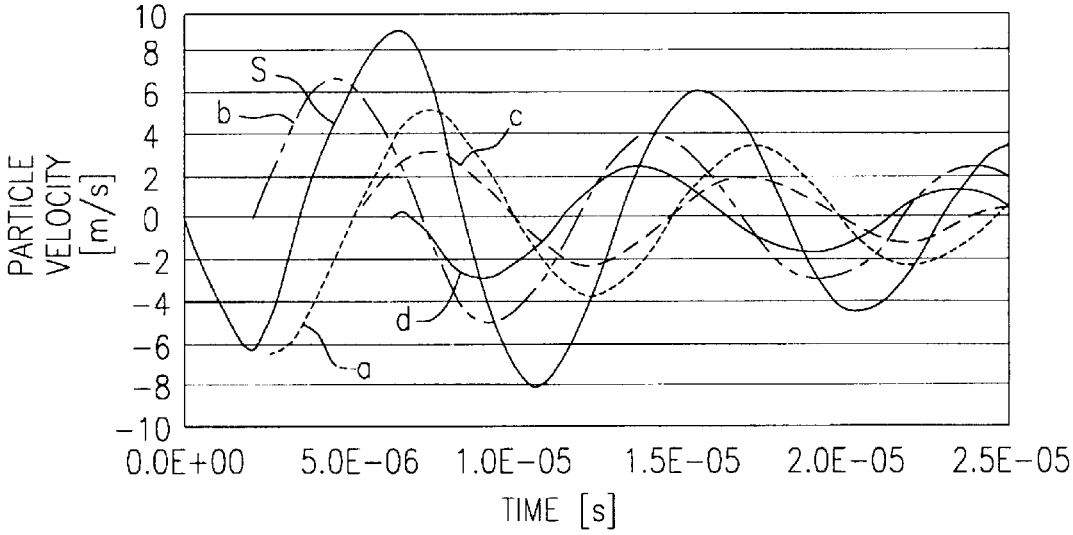
Figure 24A:
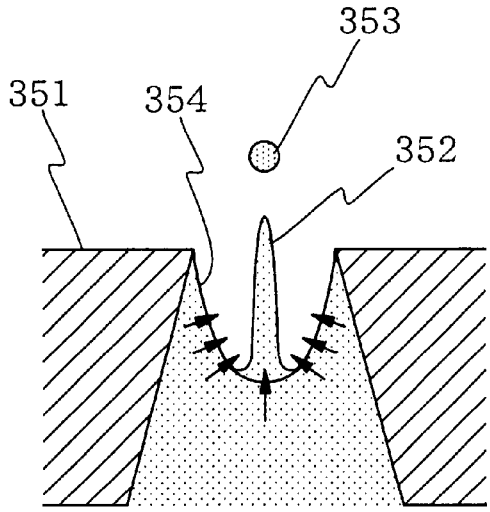
FIGS. 24(*a*)–(*b*) show a waveform for explaining a theoretical basis of the validity of the aforementioned ink jet recording head method.
Figure 24B:
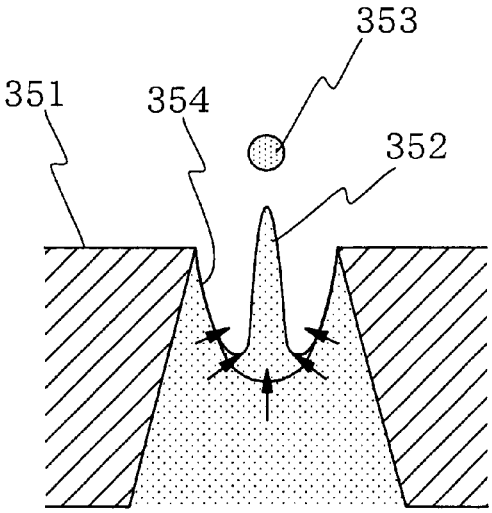

Here, FIG. 19 shows particle velocity change according to time using the amplified drive waveform signal shown in FIG. 18, which has been calculated using Equation (2) considering only the vibration component in Equation (1). In FIG. 19, slender lines "a" to "d" represent particle velocity changes generated at the turning points A, B, C, and D of the amplified drive waveform signal shown in FIG. 18, whereas the thick line "s" represents a sum of the particle velocity changes, i.e., actual particle velocity change generated in the meniscus.

With the configuration of this example, in the amplified drive waveform signal shown in FIG. 18, the voltage change time $t_1$ in the first voltage change process 393 is set to ½ of the natural period $T_c$ of the pressure wave generated in the pressure generation chamber. Accordingly, as is clear from FIG. 19, the phases of the particle velocity changes generated at the turning points A, B, and C are almost matched with one another. Consequently, in the time range $t_2$, a sudden increase of the particle velocity can be obtained.

Moreover, in the amplified drive waveform signal shown in FIG. 18, the third voltage change process 397 is provided. Because the voltage change amount $V_3$ in the third voltage change process 397 is set higher than the voltage change amount $V_2$ in the second voltage change process 395, the particle velocity is suddenly decreased in the time range $t_3$, as is clear from FIG. 19.

This enables to separate the ink droplet 337 at an earlier stage from the liquid column tip end, and to eject an ink droplet 337 having a diameter further smaller than in the amplified drive waveform signal of the second example (see FIG. 17).

Moreover, in this example of configuration, in the amplified drive waveform signal of FIG. 18, the third voltage change process 390 is followed by the fourth voltage change process 399 having a trailing time $t_7$ so as to suppress the reverberation of the pressure wave generated in the first to the third voltage change processes 393, 395, 397 and remaining after eject of the ink droplet 337. Accordingly, the pressure wave generated by the ink droplet 337 will not affect the following eject of the ink droplet 337. Consequently, even if the amplified drive waveform signal has a higher frequency, it is possible to obtain a stable eject of the ink droplet 337. When using the aforementioned first and second example (see FIG. 15 and FIG. 17), the eject state of the ink droplet 337 becomes slightly unstable if the frequency of the amplified drive waveform signal is set to 8 kHz or above. In contrast to this, when using the amplified drive waveform signal of the third example (see FIG. 18), it has been confirmed that stable eject of the ink droplet 337 can be obtained up to 12 kHz of frequency of the amplified drive waveform signal. FIG. 19 also shows that in the time range t,, the particle velocity change becomes very small.

Furthermore, according to the configuration of this example, the flying characteristic such as ejection direction of the ink droplet 337 can also be improved. As has been described above, in the amplified drive waveform signal of FIG. 18, the fourth voltage change process 399 is provided to suppress the reverberation of the pressure wave remaining after a ejection of the ink droplet 337. This makes stable the meniscus immediately after the ejection of the ink droplet 337 and satellite flying directions are made stable and uniform.

It should be noted that the voltage maintaining time $t_6$ in the third voltage maintaining process 398 is preferably as short as possible in order to suppress the reverberation. More specifically, it is preferable that the voltage maintaining time $t_6$ satisfy Equation (9) given below.

[Equation 9]

$$t_6 \frac{1}{3} \cdot T_c \tag{9}$$

Moreover, the voltage change time t, in the fourth voltage change process 399 is preferably as short as possible, in order to effectively generate a pressure wave for suppressing reverberation. More specifically, it is preferable that the voltage change time $t_7$ satisfy the Equation (10) given below.

[Equation 10]

$$t_7 \leqq \frac{1}{2} \cdot T_c \tag{8}$$

The present invention thus far been described is not to be limited to the aforementioned embodiments but can be modified in design without departing the scope of the invention.

For example, in the aforementioned embodiments, the ink jet recording head drive method according to the present invention is applied to an ink jet recording apparatus such as a printer, plotter, copying machine, facsimile, or the like in which color ink is ejected from a nozzle to record a character or image on a recording medium such as paper and OHP film. However, the present invention is not limited to these applications.

That is, the recording medium may be a high molecular film or glass and the liquid ejected from the nozzle may be molten solder. That is, the ink jet recording head drive method according to the present invention may be applied to a droplet eject apparatus in general such as a liquid droplet jet apparatus for discharging a color ink from a nozzle so as to prepare a color filter on a high molecular film or a glass; and a liquid droplet jet apparatus for discharging molten solder from a nozzle so as to form a bump on a substrate for parts mounting.

Moreover, in the aforementioned embodiments, the nozzle 334 has a tapered configuration but not to be limited to this configuration. Similarly, the opening of the nozzle 334 may have a shape other than a circle such as a rectangular or a rectangular shape. Moreover, the positional relationship between the nozzle 334, the pressure generation chamber 331, and the ink supply hole 333 is not to be limited to the one shown in the aforementioned embodiments. For example, the nozzle 334 may be arranged at the center of the pressure generation chamber 331.

Moreover, in the aforementioned embodiments, the pressure generation chamber 331 has a configuration of a parallelopiped but the configuration of the pressure generation chamber 331 is not to be limited to this.

Moreover, in the aforementioned embodiments, the bias voltage (reference voltage) $V_b$ is set so that the voltage applied to the piezoelectric actuator 336 is always positive. However, if a negative voltage can be applied to the piezoelectric actuator 336, the bias voltage $V_b$ may be set to other voltage such as 0V.

Moreover, in the aforementioned embodiments, the ink jet recording head of Kyser type was used. However, the ink jet recording head may be other than Kyser type if an ink droplet is ejected from a nozzle by changing pressure in the pressure generation chamber by the pressure generation unit. The ink jet recording head, for example, may be an ink jet recording head in which a groove provided in the piezoelectric actuator serves as the pressure generation chamber.

Moreover, in the aforementioned embodiments, experiments were performed with the pressure wave generated in the pressure generation chamber having the natural period $T_c$ of 10 microseconds. Even if the natural period $T_c$ is different from this, similar effects can be obtained. However, if the natural period $T_c$ is too long, it becomes difficult to form a small ink droplet. Accordingly, in order to eject an ink droplet in the order of 15 to 20 micrometer diameter, it is preferable that the natural period $T_c$ be set at 15 microseconds or below.

Moreover, in the aforementioned embodiments the piezoelectric actuator 336 was realized by a piezoelectric actuator of longitudinal vibration mode having a piezoelectric constant of $d_{33}$, but the piezoelectric actuator may be other type such as a piezoelectric actuator of longitudinal vibration mode having a piezoelectric constant of $d_{31}$.

Moreover, in the aforementioned embodiments, the pressure generation unit was the piezoelectric actuator 336 made from layered type piezoelectric ceramic. However, the pressure generation unit may be a piezoelectric actuator of other configuration such as a single plate type, or other type of electro-mechanical converter, magneto-striction element, or an electrostatic actuator. In such a case also, similar effects can be obtained.

Moreover, in the aforementioned embodiments, the drive circuits shown in FIG. 13 and FIG. 14 were used, but the present invention is not to be limited to these circuits. It is possible to use a drive circuit of other configuration I—I the amplified drive waveform signal's shown in FIG. 15, FIG. 17, or FIG. 18 can be applied to the piezoelectric actuator 336.

As has been described above, according to the present invention, in the drive waveform signal, the voltage change time in the first voltage change process is set within a range of ⅓ to ⅔ of the natural period $T_c$ of the pressure wave generated in the pressure generation chamber, and the second voltage change process start time is set immediately after the completion of the first voltage change process. This enables to obtain a stable eject of a small ink droplet in the order of 20 micrometer diameter. Moreover, because the natural vibration of the piezoelectric actuator itself is not excited, there is no danger of increase of the current flowing into the piezoelectric actuator, which deteriorates the reliability and service life of the piezoelectric actuator.

Thus, with a cheap and small configuration, it is possible to eject a small ink droplet having a diameter of 20 micrometers or below.

Moreover, according to another aspect of the invention, in the drive waveform signal, the second voltage change process is followed by the third voltage change process, so as to increase the volume of the pressure generation chamber and separate an ink droplet at an early stage from the liquid column tip end. This enables to obtain a further smaller ink droplet.

Moreover, according to still another aspect of the present invention, in the drive waveform signal, the third voltage change process is followed by the fourth voltage change process, so as to suppress the reverberation after an ink droplet eject. Accordingly, even when the drive waveform signal frequency is higher, it is possible to obtain a stable ink droplet eject and to improve the ink droplet eject direction and other flying characteristic.

The invention may be embodied in other specific forms without departing from the spirit, or essential characteristic thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to. be embraced therein.

The entire disclosure of Japanese Patent Application Nos. 11-064682 (Filed Mar. 11th, 1999), 11-188218 (Filed Jul. 1st, 1999) and 11-237791 (Filed Aug. 25, 1999) including specification, claims, drawings and summary are incorporated herein by reference in its entirety.

What is claimed is:

1. An ink jet recording head drive method comprising:

applying a drive voltage to an electro-mechanical converter which changes a pressure within a pressure generation chamber filled with ink so that an ink droplet is ejected from a nozzle opening communicating with the pressure generation chamber, wherein the drive voltage has a voltage waveform including a first voltage change process for increasing a volume of the pressure generation chamber so as to pull the ink meniscus from the nozzle opening toward the pressure generation chamber and a second voltage change process for decreasing the volume of the pressure generation chamber so as to eject the ink droplet; and the first voltage change process is preceded by a preparatory voltage change process for pulling the ink meniscus from the nozzle opening toward the pressure generation chamber to a lesser degree than that of the first voltage change process.

2. The ink jet recording head drive method as claimed in claim 1, wherein said preparatory voltage change process increases the volume of the pressure generation chamber and has a voltage change speed less than a voltage change speed of the first voltage change process.

3. The ink jet recording head drive method as claimed in claim 1, wherein said preparatory voltage change process includes a third voltage change process for decreasing the volume of the pressure generation chamber and a voltage maintaining process for maintaining a voltage for a predetermined period of time.

4. An ink jet recording head drive method comprising:

applying a drive voltage to an electro-mechanical converter which changes a pressure within a pressure generation chamber filled with ink, so that an ink droplet is ejected from a nozzle opening communicating with the pressure generation chamber, wherein the drive voltage has a voltage waveform including a first voltage change process for increasing a volume of the pressure generation chamber so as to pull the ink meniscus from the nozzle opening toward the pressure generation chamber and a second voltage change process for decreasing the volume of the pressure generation chamber so as to eject the ink droplet;

the first voltage change process is preceded by a preparatory voltage change process for slightly pulling the ink meniscus from the nozzle opening toward the pressure generation chamber; said preparatory voltage change process increasing the volume of the pressure generation chamber and having a voltage change speed less than a voltage change speed of the first voltage change process; and the voltage change speed of the first voltage change process for increasing the volume of the pressure generation chamber is set greater than a natural period of a pressure wave generated in the pressure generation chamber.

5. An ink jet recording head drive method comprising:

applying a drive voltage to an electro-mechanical converter which changes a pressure within a pressure generation chamber filled with ink, so that an ink droplet is ejected from a nozzle opening communicating with the pressure generation chamber, wherein the drive voltage has a voltage waveform including a first voltage change process for increasing a volume of the pressure generation chamber so as to pull the ink meniscus from the nozzle opening toward the pressure generation chamber and a second voltage change process for decreasing the volume of the pressure generation chamber so as to eject the ink droplet;

the first voltage change process is preceded by a preparatory voltage change process for slightly pulling the ink meniscus from the nozzle opening toward the pressure generation chamber, said preparatory voltage change process including a third voltage change process for decreasing the volume of the pressure generation chamber and a voltage maintaining process for maintaining a voltage for a predetermined period of time; and the third voltage change process for decreasing the volume of the pressure generation chamber having a voltage change time set greater than a natural period of a pressure wave generated in the pressure generation chamber.

6. An ink jet recording head drive method comprising:

applying a drive voltage to an electro-mechanical converter which changes a pressure within a pressure generation chamber filled with ink, so that an ink droplet is ejected from a nozzle opening communicating with the pressure generation chamber, wherein the drive voltage has a voltage waveform including a first voltage change process for increasing a volume of the pressure generation chamber so as to pull the ink meniscus from the nozzle opening toward the pressure generation chamber and a second voltage change process for decreasing the volume of the pressure generation chamber so as to eject the ink droplet;

the first voltage change process is preceded by a preparatory voltage change process for slightly pulling the ink meniscus from the nozzle opening toward the pressure generation chamber, said preparatory voltage change process including a third voltage change process for decreasing the volume of the pressure generation chamber and a voltage maintaining process for maintaining a voltage for a predetermined period of time; and the predetermined period of time of the voltage maintaining process is set to ⅓ to ⅔ of a natural period of the vibration of the ink droplet at the nozzle opening.

7. An ink jet recording apparatus comprising:

an ink jet recording head for applying a drive voltage to an electro-mechanical converter which changes a pressure within a pressure generation chamber filled with ink, so that an ink droplet is ejected from a nozzle opening communicating with the pressure generation chamber; and at least one waveform generation unit for generating a drive voltage to be applied to the electro-mechanical converter, wherein the drive voltage generated by the at least one waveform generation unit includes a first voltage change process for increasing the volume of the pressure generation chamber so as to pull the ink meniscus from the nozzle opening toward the pressure generation chamber and a second voltage change process for decreasing the volume of the pressure generation chamber to eject the ink droplet; and the first voltage change process is preceded by a preparatory voltage change process for pulling the ink meniscus from the nozzle opening toward the pressure generation chamber to a lesser degree than that of the first voltage change process.

8. The ink jet recording apparatus as claimed in claim 7, wherein the electro-mechanical converter is a piezoelectric actuator.

9. An ink jet recording head drive method for an ink jet recording head comprising: a plurality of pressure generation chambers filled with ink; nozzles provided in the pressure generation chambers for discharging the ink; and vibration generation unit provided for each of the pressure generation chambers for causing a pressure change in the pressure generation chambers, wherein drive voltage waveforms to be applied to the vibration generation unit are prepared according to a diameter of ink droplet to be ejected, so that the drive voltage waveforms corresponding to different ink droplet diameters are applied at predetermined different timings and the drive voltage waveforms are set so that a smaller diameter ink droplet is ejected earlier.

10. An ink jet recording head drive method for an ink jet recording head that includes a pressure generation chamber filled with ink, a pressure generation chamber filled with ink, a pressure generation unit for generating a pressure in the pressure generation chamber, and a nozzle opening communicating with the pressure generation chamber, the drive method comprising:

applying a drive waveform signal to the pressure generation unit so as to change the volume of the pressure generation chamber so that an ink droplet is ejected from the nozzle, the drive waveform signal having a waveform including:

a first voltage change process for applying a voltage to increase the volume of the pressure generation chamber; and a second voltage change process for applying a voltage to decrease the volume of the pressure generation chamber, wherein the first voltage change process has a voltage change time set within a range of about ⅓ to ⅔ of a natural period $T_c$ of a pressure wave generated in the pressure generation chamber, and the second voltage change process has a start time set after completion of the first voltage change process.

11. The ink jet recording head drive method as claimed in claim 10, wherein the first voltage change process has the voltage change time set to ½ of the natural period $T_c$.

12. The ink jet recording head drive method as claimed in claim 10, wherein the waveform of the drive waveform signal is such that a time interval between the end time of the first voltage change process and the start time of the second voltage change process is set to about ⅕ of the natural period $T_c$ or below.

13. The ink jet recording head drive method as claimed in claim 10, wherein the waveform of the drive waveform signal is such that the second voltage change process has a voltage change time set to about ⅓ of the natural period $T_c$ or below.

14. The ink jet recording head drive method as claimed in claim 10 wherein the waveform of the drive waveform signal is such that the second voltage change process is followed by a third voltage change process for applying a voltage to increase the volume of the pressure generation chamber.

15. The ink jet recording head drive method as claimed in claim 14, wherein the waveform of the drive waveform signal is such that the third voltage change process has a voltage change time set to about ⅓ of the natural period $T_c$ or below.

16. The ink jet recording head drive method as claimed in claim 14, wherein the waveform of the drive waveform signal is such that a time interval between the end time of the second voltage change process and the start time of the third voltage change process is set to about ⅕ of the natural period $T_c$ or below.

17. The ink jet recording head drive method as claimed in claim 14 wherein the waveform of the drive waveform signal is such that the third voltage change process has a voltage change amount set to be greater than a voltage change amount of the second voltage change process.

18. The ink jet recording head drive method as claimed in claim 14 wherein the waveform of the drive waveform signal is such that the third voltage change process is followed by a fourth voltage change process for applying voltage to reduce the volume of the pressure generation chamber.

19. The ink jet recording head drive method as claimed in claim 18, wherein the fourth voltage change process has a voltage change time as set to about ½ of the natural period $T_c$ or below.

20. The ink jet recording head drive method as claimed in claim 18 wherein a time interval between the end time of the third voltage change process and the start time of the fourth voltage change process is set to about ⅓ of the natural period $T_c$ or below.

21. The ink jet recording head drive method as claimed in claim 10, wherein the natural period $T_c$ is 15 microseconds or below.

22. The ink jet recording head drive method as claimed in claim 10, wherein the pressure generation unit is an electro-mechanical converter.

23. The ink jet recording head drive method as aimed in claim 22, wherein the electro-mechanical converter is a piezoelectric actuator.

24. An ink jet recording head drive circuit for an ink jet recording head having a pressure generation chamber filled with ink, a pressure generation unit for generating a pressure in the pressure generation chamber, and a nozzle communicating with the pressure generation chamber, wherein a drive waveform signal is applied to the pressure generation unit so as to change the volume of the pressure generation chamber so that an ink droplet is ejected from the nozzle, the circuit comprising:

a waveform generation unit operating according to the drive waveform signal, the drive waveform signal having a waveform including:

a first voltage change process for applying a voltage to increase the volume of the pressure generation chamber; and a second voltage change process for applying a voltage to decrease the volume of the pressure generation chamber, wherein the first voltage change process has a voltage change time set within a range of about ⅓ to ⅔ of a natural period $T_c$ of a pressure wave generated in the pressure generation chamber, and the second voltage change process has a start time set after completion of the first voltage change process.

25. The ink jet recording head drive circuit as claimed in claim 24, wherein the voltage change time of the first voltage change process is set to about ½ of the natural period $T_c$.

26. The ink jet recording head drive circuit as claimed in claim 24, wherein a time interval between the end time of the first voltage change process and the start time of the second voltage change process is set to about ⅕ of the natural period or below.

27. The ink jet recording head drive circuit as claimed in claim 24, wherein the pressure generation unit is an electro-mechanical converter.

28. The ink jet recording head drive circuit as claimed in claim 24, wherein the second voltage change process has a voltage change time set to about ⅓ of the natural period $T_c$ or below.

29. The ink jet recording head drive circuit as claimed in claim 24, wherein the second voltage change process is followed by a third voltage change process for applying a voltage to increase the volume of the pressure generation chamber.

30. The ink jet recording head drive circuit as claimed in claim 29, wherein the third voltage change process has a voltage change time set to about ⅓ of the natural period $T_c$ or below.

31. The ink jet recording head drive circuit as claimed in claim 29, wherein a time interval between the end time of the second voltage change process and the start time of the third voltage change process is set to about ⅕ of the natural period $T_c$ or below.

32. The ink jet recording head drive circuit as claimed in claim 29, wherein the third voltage change process has a voltage change amount set to be greater than a voltage change amount of the second voltage change process.

33. The ink jet recording head drive circuit as claimed in claim 29, wherein the third voltage change process is followed by a fourth voltage change process for applying voltage to reduce the volume of the pressure generation chamber.

34. The ink jet recording head drive circuit as claimed in claim 33, wherein the fourth voltage change process has a voltage change time set to about ½ of the natural period $T_c$ or below.

35. The ink jet recording head drive circuit as claimed in claim 33, wherein a time interval between the end time of the third voltage change process and the start time of the fourth voltage change process is set to about ⅓ of the natural period $T_c$ or below.

36. The ink jet recording head drive circuit as claimed in claim 24, wherein the natural period $T_c$ is 15 microseconds or below.

37. The ink jet recording head drive circuit as claimed in claim 27, wherein the electro-mechanical converter is a piezoelectric actuator.

* * * * *